United States Patent [19]

Fuchizawa et al.

[11] Patent Number: 4,851,327

[45] Date of Patent: Jul. 25, 1989

[54] PHOTOGRAPHIC COLOR PHOTOSENSITIVE MATERIAL WITH TWO LAYER REFLECTIVE SUPPORT

[75] Inventors: Tetsuro Fuchizawa, Fujimiya; Masaru Sano, Minami-Ashigara; Seiichi Taguchi, Minami-Ashigara; Keisuke Shiba, Minami-Ashigara; Tadashi Ogawa, Minami-Ashigara, all of Japan

[73] Assignee: Fuji Photo Film Co., Ltd., Ashigara, Japan

[21] Appl. No.: 73,977

[22] Filed: Jul. 15, 1987

[30] Foreign Application Priority Data

| | | | |
|---|---|---|---|
| Jul. 17, 1986 | [JP] | Japan | 61-168800 |
| Jul. 17, 1986 | [JP] | Japan | 61-168802 |
| Sep. 12, 1986 | [JP] | Japan | 61-215141 |

[51] Int. Cl.[4] ..... G03C 1/46

[52] U.S. Cl. ..... 430/503; 430/502; 430/524; 430/525; 430/526

[58] Field of Search ..... 430/524, 525, 502, 503, 430/526

[56] References Cited

U.S. PATENT DOCUMENTS

| | | | |
|---|---|---|---|
| 3,679,418 | 7/1972 | Stroszynski et al. | 430/524 |
| 4,054,453 | 10/1977 | Gobin | 430/524 |
| 4,178,181 | 12/1979 | Sawyer | 430/524 |
| 4,436,809 | 3/1984 | Akao et al. | 430/524 |
| 4,529,808 | 4/1986 | Held | 430/524 |
| 4,564,589 | 1/1986 | Hallman et al. | 430/524 |
| 4,582,208 | 5/1986 | Kadowaki et al. | 430/524 |
| 4,617,245 | 10/1986 | Tanaka et al. | 430/524 |

*Primary Examiner*—Jack P. Brammer

*Attorney, Agent, or Firm*—Burns, Doane, Swecker & Mathis

[57] ABSTRACT

The present invention relates to a photographic support having a secondary diffuse-reflective surface, and a color photosensitive material comprising at least one silver halide emulsion layer formed on the secondary diffuse-reflective surface of a photographic support. A photographic support of the present invention provides an image having remarkably improved brightness, saturation, tone reproducibility in shadow areas and sharpness. A color photosensitive material of the present invention provides an image having remakably improved brightness, saturation, tone reproducibility in shades and sharpness and also capable of rapid development.

13 Claims, 11 Drawing Sheets

PHOTOGRAPHIC COLOR PHOTOSENSITIVE MATERIAL WITH TWO LAYER REFLECTIVE SUPPORT

FIELD OF THE INVENTION

The present invention relates to a photographic support capable of providing an excellent image. In particular, the present invention relates to a photographic support capable of providing an image having remarkably improved brightness, saturation, tone reproducibility in shadow areas and sharpness.

Moreover the present invention relates to a color photosensitive material capable of providing an excellent color image. In particular, the present invention relates to a color photosensitive material for prints capable of providing an image having remarkably improved brightness, saturation, tone reproducibility in shades and sharpness and also capable of rapid development.

BACKGROUND OF THE INVENTION

Transparent plastic films such as TAC and PET films are known as photographic supports, and papers, synthetic papers, plastic films containing a white pigment, glass plates and metal plates (such as an aluminum plate having a surface processed by anodic oxidation) are known as reflective materials. To improve the whiteness of the support, it has been proposed to mix or to incorporate a fine powder of a metal oxide or an inorganic compound (such as titanium oxide, barium sulfate or magnesium oxide) as a sizing agent in the surface layer of the support. However, when the whiteness of the support is increased, the sharpness of the image is usually reduced, while the white reproducibility is improved. To solve this problem, it has been proposed to incorporate an anti-irradiation dye in a silver halide-containing photosensitive layer provided on the support or to provide an antihalation layer.

Further, so-called Daguerreotype has been known since the early nineteenth century. In this method, gaseous iodine is sprayed over a well polished silver plate to form an AgI layer by the chemical reaction and the development is conducted with gaseous mercury after the image exposure to form a photographic image. However, this method has defects that, since the silver plate used as the support is not well prepared and it is subjected directly to the chemical processes, the surface of the silver plate is stained and its initial mirror plane cannot be maintained and that since the silver/mercury image is deposited directly on the silver surface to mask the surface, the obtained image has only poor brighteness and sharpness.

When a photographic material comprising ordinary emulsion layers formed on an aluminum support having the surface having a metallic gloss which highly reflects the light is used, the obtained image is only slightly lighter than that obtained by using a baryta paper. When microcapsules of a silver halide emulsion are applied to the support to form a single layer, bright transparent grains could be seen (see, for example, Japanese Patent Publication No. 49-33783). The iamge thus formed cannot be seen easily due to the reflected light and very small flaws on the surface become conspicuous unfavorably.

Further, it is known to provide an antistatic layer of a metal such as aluminum or chromium by vacuum deposition (for example, British Pat. No. 1340403 and Japanese Patent Publication Nos. 59-41573 and 59-10420). However, these publications are silent on the improvement in or relating to the reproduction of the images and they have no relation with the present invention.

By the way, ordinary color photosensitive materials comprise, on a support (such as a film, film containing a white pigment, paper, e.g. baryta paper or paper having water-resistant resin layers on both surfaces), an antihalation layer, red-sensitive layer, green-sensitive layer, yellow filter layer, blue-sensitive layer, protective layer, etc. suitably. To form an excellent color image, investigations were made in or relating to transparency and reduction in the thickness of the layers, layer structure, prevention of irradiation or halation, spectral absorbing characters of colored dyes prepared from color couplers and transparency of the matrial. For improving particularly the sharpness, the silver halide emulsions such as halogen compositions and grain size are selected so as to exhibit the interlayer effects in the development, and investigations of the layer structure are made. It was proposed also that a material which releases a compound having an effect of inhibiting or accelerating the development in the color development step is used. However, they are yet insufficient particularly when a color image is formed on a reflective support such as a color photographic printing paper.

It is known that a bright image can be obtained by using a photosensitive material prepared by applying microcapsules of a silver halide emulsion on an aluminum substrate surface which reflects a light well and which has a metallic gloss (see, for example, Japanese Patent Publication No. 49-33783). However, although the brightness of the image thus obtained by using the photosensitive material comprising, on the aluminum support, a laminate of ordinary emulsion layers is improved slightly, it is yet unsatisfactory. It is known also that the image thus formed cannot be seen easily due to the reflected light and that very small flaws on the surface become conspicuous unfavorably.

A lithographic plate comprising, on an aluminum support, silver halide emulsion layers is known (see, for example, British Pat. No. 1227603 and Japanese Patent Public Disclosure No. 54-90053). The aluminum support used in the lithography has the surface processed by, for example, graining and, therefore, it does not have the above-described effects. Under these circumstances, processes for overcoming the defects by, for example, preventing the halation have been proposed (for example, Japanese Patent Public Disclosure No. 54-124927). Further, color image-forming materials do not have these effects. It is also known that a layer of a metal such as aluminum or chromium is formed by vacuum deposition for obtaining antistatic effects (for example, British Pat. No. 130403, and Japanese Patent Publication Nos. 59-41573 and 59-10420). However, they are silent on the improvement of the color image and they have no relation with the present invention.

SUMMARY OF THE INVENTION

The first object of the present invention is to improve the brightness and saturation of an image and particularly to widen the angle at which the image can be seen well. The second object of the present invention is to improve the sharpness of the image to an extent that could not be attained in the prior art.

The third object of the present invention is to provide a color photographic material capable of forming an excellent color image having a saturation and gradation reproduction in shades improved to an extent that could not be attained in the prior art. The forth object of the present invention is to provide a color photographic material capable of forming a color image having a remarkably improved sharpness particularly in a high frequency region. The fifth object of the present invention is to provide a color photographic material which can be processed by an ordinary color photographic developing process, particularly a rapid process.

Other objects of the present invention will be apparent from the description in this specification.

The objects of the present invention are attained by a photographic support having a secondary diffuse-reflective surface or a photographic support comprising, on the substrate, a thin solid film layer having a secondary diffusion-reflective surface and a color photosensitive material having at least one silver halide emulsion layer formed on the secondary diffuse-reflective surface of a photographic support.

DETAILED DESCRIPTION OF THE INVENTION

Figure 1:
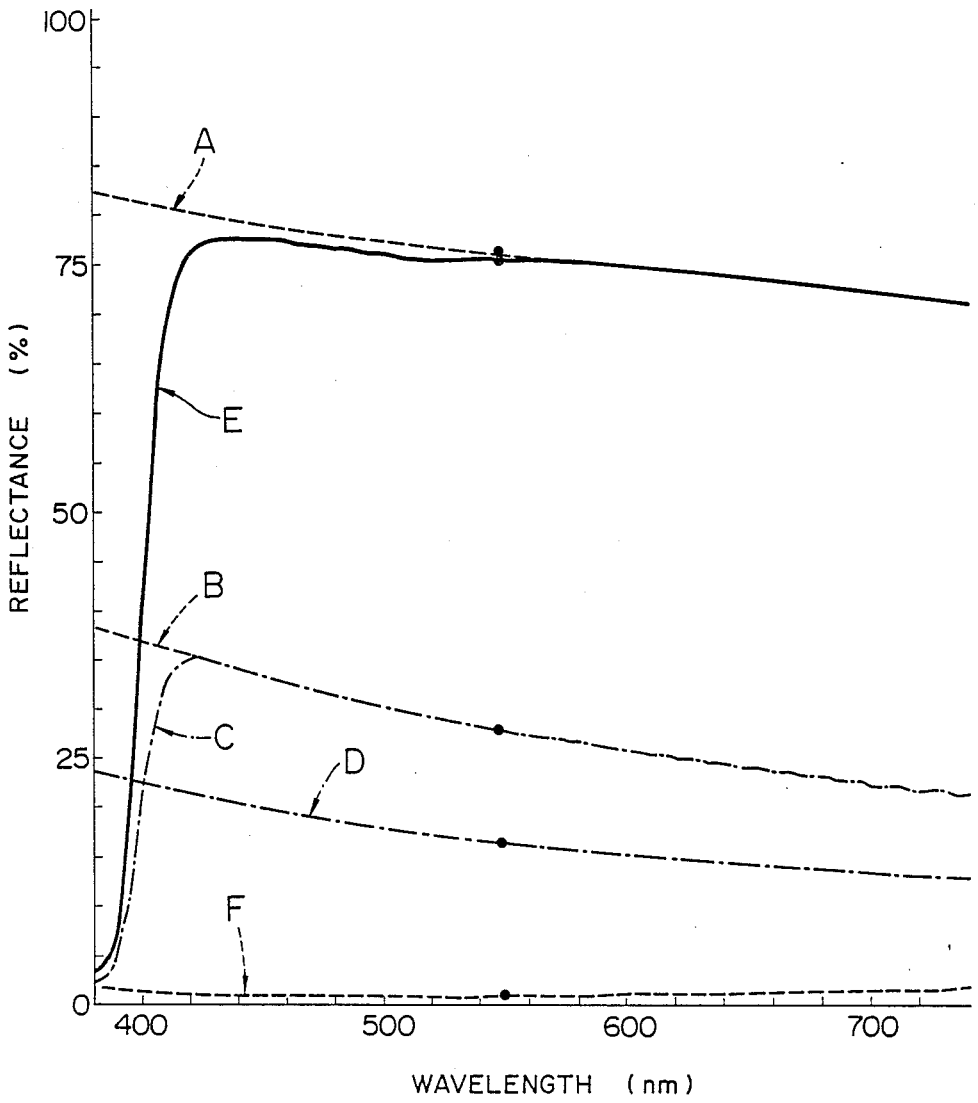
FIG. 1 shows spectral reflectance curves.

Now, the detailed description will be made on the support and the color photosensitive material of the present invention.

(Photographic support)

The reflection on the surfaces of substances are usually roughly classified into a mirror reflection and diffuse reflection. Further, the diffuse reflection can be classified into the primary diffuse reflection and the secondary diffuse reflection. The mirror reflection is the reflection on a smooth surface in accordance with the regular reflection law. The diffuse reflection is observed on the surfaces of papers, coatings, woods and walls, wherein incident light reflects not only regularly but also irregularly on the surface.

The secondary diffuse reflection is observed on all the surfaces having minute slant boundaries such as the surface of a ground glass or abraded metal surface. The term "secondary diffuse-reflection" herein indicates a reflection occurring on a smooth mirror surface but on which very small unevennesses are provided to form boundaries thereon. The diffuse-reflected light can be deemed as a collection of regularly reflected lights on the respective, very small reflection surfaces. This is why the secondary diffuse reflection is called "(collected) reflections on small mirror planes" as defined in paragraph 1, chapter 18 in "Shikisai Kagaku Handbook" Edition 5 edited by Nippon Shikisai Gakkai and published by Tokyo Daigaku Shuppan-kai in 1985.

The primary diffuse reflection can be distinguished from the secondary diffuse reflection by a difference in the reflectance R. The term "secondary diffuse reflection" herein indicates that the reflectance R is at least 0.5. Therefore, the secondary diffuse-reflective surface according to the present invention has the reflectance R of at least 0.5, preferably 0.7 to 1.0.The reflectance R of a light of rectangular irradiation on the smooth surface of a given material can be determined by means of a spectrophotometer. The secondary diffuse-reflective surface can also be estimated, according to the total reflection measured by a spectrophotometer having an integrating shere. The term "primary diffuse reflection" means that when a light-transmitting solid is finely pulverized and irradiated with a light, the incident light is diffused by the total reflection or the reflection on a part of the surface.

The mirror reflection can be distinguished from the diffuse reflection according to a difference in the spectral reflectance. The spectral reflectance is determined as follows:

Monochromatic light of 550 nm is irradiated at an angle of 7° from normal line of a sample. A regular reflection fraction is eliminated by providing a trap located at a circumferential angle of 10° from center of incident light and fraction ranging within a circumferential angle of 90° from normal line other than the fraction eliminated by the trap are integrated by an integrating shere. The spectral reflectance is shown by percentage on the basis of incident light. The secondary diffuse-reflection is the present invention indicates that the spectral reflectance (determined with a monochromatic light of 550 nm) is at least 5%. Therefore, the secondary diffuse-reflective surface according to the present invention has a spectral reflectance (monochromatic light of 550 nm) of at least 5%, preferably at least 10% and more preferably at least 20%. The spectral reflectance can be determined with, for example, Color Analyzer 307 of Hitachi, Ltd.

Thus, the secondary diffuse-reflection of the present invention can be distinguished from the mirror reflection or the primary diffuse-reflection according to a difference in the reflectance R of the light of the rectangular irradiation on the surface-constituting material and the spectral reflectance determined by means of a spectrophotometer such as the above-mentioned Hitachi Color Analyzer with the trap.

The solids, preferably metals, used for providing the secondary diffuse-reflective surface include, for example, metals described on pages 174 to 184 of F. Benford et al., J. Opt. Soc. Amer., 32 (1942) such as silver, aluminum, gold, copper, chromium/nickel alloy, platinum and alloys of them, e.g. aluminum/magnesium alloy, aluminum/copper alloy, aluminum/antimony alloy and brass.

The surface of the thin solid film layer, preferably thin metal film layer, having the secondary diffuse-reflecting properties is formed as follows: The mirror-reflective surface of a metal plate is patterned at the time of rolling; it is mechanically processed with, for example, a brush having a suitable rigidity; a jet stream of fine particles of an abrasive such as PUMICE is injected to conduct the graining; or it is etched by an electrolytic method. The thin metal film layer having such reflective properties can be formed on a substrate by lamination to form the support of the present invention. For the formation of a thin metal film layer, various methods are known such as vacuum deposition method, sputtering method, ion plating method, electrodeposition method and nonelectrolytic plating method. One or more thin film layers can be formed on a given substrate by these methods. When the product has a mirror reflective surface, it can be converted to the secondary diffuse-reflective surface by the above-mentioned method.

The surface unevennesses can be examined by embedding and fixing a sample in a resin, cutting the obtained product according to ultramicrotomy and observing the section of the piece with an electron microscope. The surface unevennesses can be determined directly with a sectional shape-measuring device by the irradiation with electron rays. The degree of accuracy is up to submicrons. The number of unevennesses can be determined in terms of the frequency of the surface roughness. The average frequency is preferably 0.1 to 2000/mm and more preferably 1 to 1000/mm.

When the support of the present invention is used, the visual angle in the observation of the image is widened and the light source is enlarged from points into planes to provide a clearer image. The visual angle can be optimized, according to the directivity of rflected light from the surface. Further, the brightness in the highlights in the image, saturation of the image and the reproducibility of the gradation in shadows are remarkably improved. In addition, the sharpness of the image is surprisingly improved.

The substrates of the supports of the present invention may be those usually used heretofore such as plastic films, papers, RC-papers, synthetic papers and metal plates. Among them, papers and RC-papers are preferred. An aluminum foil having the unevennesses previously provided according to the present invention can be laminated with the RC paper having a low-density polyethylene layer. The thickness of the support is preferaby from 50 to 300 μm.

A silver halide emulsion layer can be formed on the support of the present invention via a priming layer. The priming layer comprises a thermoplastic resin such as polyethylene or polypropylene or an ionomer resin containing an epoxy adhesive. A gelatin or gelatin/silver halide emulsion layer can be formed thereon after corona discharge process or without this process.

The prime layer has effects of increasing the adhesion of the silver halide emulsion layer and inhibiting harmful effects of the support on the silver halide emulsion layer such as spot formation, fogging and deterioration of the storage stability. The prime layer is formed uniformly and it is preferably thin. The thickness of the layer is less than 5μ, preferaby less than 2μ.

It necessary, a small amount (such as 1 g/m$^2$ or less) of fine grains having the primary diffuse-reflecting properties can be incorporated in the layers such as the priming layer or, alternatively, fine dispersed particles of latexes or a high-boiling organic solvent having the primary diffuse-reflecting properties can be incorporated therein.

Further, it is also possible to incorporate a fine powder of titanium oxide or barium sulfate in the substrate and pores are provided in the thin metal film layer provided on the surface thereof according to the present invention to partially replace the secondary diffuse-reflection with the primary diffuse-reflection. As a result, the visual angle of the observation can be widened without reducing the sharpness.

The support having the secondary diffuse-reflective surface of the present invention can be prepared by patterning a metal film in the rolling step as described above. The metals include, for example, silver, aluminum, gold, copper, chromium-nickel, platinum and alloys of them.

The supprot of the present invention is usable widely as a photographic reflective supprot. It is possible to form a silver halide emulsion layer for black-and-white printing paper on the support, via a priming layer if necessary, and to form a protective layer thereon. Further, a photosensitive material for color photographic paper can be prepared by forming two or more photosensitive silver halide emulsion layers having different spectral sensitivities and containing different color cooplers, which emulsions are the same as those used in the preparation of ordinary color photographic papers. The support of the present invention is usable for the preparation of reversal color photosensitive materials, color photographic papers of direct positive type and color copying materials of direct positive type by photo-fogging method. The support of the present invention is usable also for the preparation of printing photosensitive materials of SDB system by forming, on the support, red-sensitive, green-sensitive and blue-sensitive silver halide emulsion layers each comprising silver halide grains having a different spectral sensitivity and a dye usable in silver dye bleech (SDB) method.

A mordanting layer can be formed on the support of the present invention to prepare a material for forming a color image by diffusing a color releasing dye and transferring it. Physical development centers can be provided in the priming layer on the support of the present invention to prepare a silver image-forming material of silver diffuse transfer type.

The photographic support of the present invention can be used for the preparation of heat development-type photosensitive materials and/or dye-fixing materials (image-receiving materials) described in U.S. Pat. No. 4,500,626, Japanese Patent Public Disclosrue Nos. 60-133449 and 59-218443 and Japanese Patent Application No. 60-79709 (Japanese Patent Public Disclosure No. 61-238056).

(Silver halide emulsion layers)

At least one silver halide emulsion layer is formed on the secondary diffuse-reflective surface of the support in the present invention.

The description will be made on the silver halide emulsion layers.

(a) Silver halide emulsion layer RL

This layer mainly comprises silver halide grains having a spectral sensitivity in a wave length region of 580 to 700 mμ and a cyan coupler. The cyan couplers contained in the RL layer are classified into oil-protecting naphthol couplers and phenol couplers. Typical examples of the naphthol couplers include those described in U.S. Pat. No. 2,474,293 and preferably oxygen-linked coupling-off type 2-equivalent naphthol couplers described in U.S. Pat. Nos. 4,052,212, 4,146,396, 4,228,233 and 4,296,200. Examples of the phenol couplers are described in U.S. Pat. Nos. 2,369,929, 2,801,171, 2,772,162 and 2,895,826. Cyan couplers having excellent fastness to humidity and temperature are preferably used in the present invention. Typical examples of them include phenolic cyan couplers having an alkyl group higher than ethyl group inclusive at m-position of the phenol nucleus as described in U.S. Pat. No. 3,772,002, 2,5-diaclylamino-substituted phenolic couplers described in U.S. Pat. Nos. 2,772,162, 3,758,308, 4,126,396, 4,334,011 and 4,327,173, West German Patent Public Disclosure No. 3,329,729 and European Pat. No. 121,365 and phenolic couplers having a phenylureido group at position 2 and an acylamino group at position 5 as described in U.S. Pat. Nos. 3,446,622, 4,333,999, 4,451,559 and 4,427,767.

The couplers of the following general formulae (I) and (II) are particularly preferred:

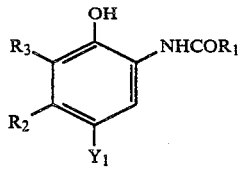

general formula (I)

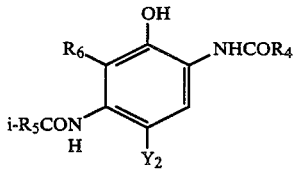

general formula (II)

(b) Silver halide emulsion layer GL

This layer mainly comprises silver halide grains having a spectral sensitivity in a wave length region of 500 to 580 mμ and a magenta coupler.

Examples of the magenta couplers contained in GL include oil-protecting indazolone and cyanoacetyl couplers, preferably 5-pyrazolone and pyrazoloazole couplers such as pyrazolotriazoles. Among the 5-pyrazolone couplers, those having an arylamino group or an acylamino group at position 3 are preferred from the viewpoint of the hue of the colored dye or the color density. Typical examples of them are described in U.S. Pat. Nos. 2,311,082, 2,343,703, 2,600,788, 2,908,573, 3,062,653, 3,152,896 and 3,936,015. As the release groups of the 2-equivalent 5-pyrazolone couplers, nitrogen-linked coupling-off group described in U.S. Pat. No. 4,310,619 and arylthio groups described in U.S. Pat. No. 4,351,897 are particularly preferred. When 5-pyrazolone couplers having a ballast group described in European Pat. No. 73,636 are used, a high color density can be obtained.

Examples of the pyrazoloazole couplers include pyrazolobenzimidazoles described in U.S. Pat. No. 3,061,432 and preferably pyrazolo(5,1-c)(1,2,4)triazoles described in U.S. Pat. No. 3,725,067, pyrazolotetrazoles described in Research Disclosure No. 24220 (June, 1984) and pyrazolopyrazoles described in Research Disclosrue No. 24230 (June, 1984) and Japanese Patent Public Disclosure No. 60-43659. Imidazo(1,2-b)pyrazoles described in U.S. Pat. No. 4,500,630 are preferred because of low yellow sub-absorption and excellent light fastness of the developed dye, and pyrazolo(1,5-b)(1,2,4)triazole described in U.S. Pat. No. 4,540,654 is particularly preferred.

Couplers of the following general formulae (III) and (IV) are particularly preferred:

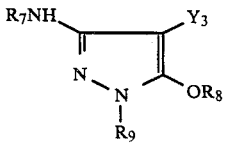

general formula (III)

-continued

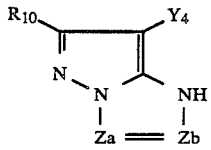

general formula (IV)

(c) Silver halide emulsion layer BL

This layer mainly comprises silver halide grains having a spectral sensitivity in a wave length region of 400 to 500 mμ and a yellow coupler. Typical examples of the yellow couplers contained in BL include oil-protecting acylacetamide couplers. Examples of them are described in U.S. Pat. Nos. 2,407,210, 2,875,057 and 3,265,506. 2-Equivalent yellow couplers are preferably used in the present invention. They include, for example, yellow couplers of oxygen-linking coupling-off type as described in U.S. Pat. Nos. 3,408,194, 3,447,928, 3,933,501 and 4,022,620 and yellow couplers of nitrogen-linked coupling-off type as described in Japanese Patent Publication No. 58-10739, U.S. Pat. Nos. 4,401,752 and 4,326,024, RD 18053 (April, 1979), British Pat. No. 1,425,020, West German Patent Public Disclosure Nos. 2,219,917, 2,261,361, 2,329,587 and 2,433,812. α-Pivaloylacetanilide couplers are excellent in fastness, particularly light fastness, of the colored dye.

Couplers of the following general formula (V) are particularly preferred:

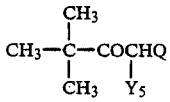

general formula (V)

In formulae (I)–(V), $R_1$, $R_4$ and $R_5$ each represent an aliphatic group, aromatic group, heterocyclic group, aromatic amino group or heterocyclic amino group, $R_2$ represents an aliphatic group, $R_3$ and $R_6$ each represent a hydrogen atom, halogen atom, aliphatiac group, aliphataic oxy group or acylamino group, p $R_7$ and $R_9$ each represent a substituted or unsubstituted phenyl group, $R_8$ represents a hydrogen atom, aliphatic or aromatic acyl group or aliphatic or aromatic sulfonyl group, $R_{10}$ represents a hydrogen atom or a substituent, Q represents a substituted or unsubstituted N-phenylcarbamoyl group, Za and Zb each represent a methine, substituted methine or =N—, $Y_1$, $Y_2$ and $Y_4$ each represent a halogen atom or a group which can be released upon the coupling reaction with an oxidation product of a developing agent (hereinafter referred to as release group), $Y_3$ represents a hydrogen atom or a release group, $Y_5$ represents a release group, $R_2$ and $R_3$ or $R_5$ and $R_6$ in the general formulae (I) and (II) may form together a 5-, 6- or 7-membered ring, and a dimer or a higher polymer can be formed through $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; Q or $Y_5$, the aliphatiac group herein being a straight chain, branched or cyclic alkyl, alkenyl or alkynyl group.

The dye-forming couplers and the above-described special couplers may be in the form of dimers or higher polymers. Typical examples of the polymerized dye-forming couplers are described in U.S. Pat. Nos. 3,451,820 and 4,080,211. Typical examples of the polymerized magenta couplers are described in British Pat. No. 2,102,173 and U.S. Pat. No. 4,367,282.

These couplers are dispersed in at least one high-boiling organic solvent and contained in the emulsion layers. High-boiling organic solvents of the following general formulae (A) to (E) are preferably used:

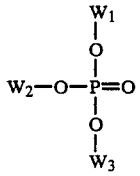

general formula (A)

$W_1-COO-W_2$ general formula (B)

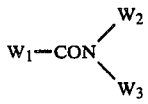

general formula (C)

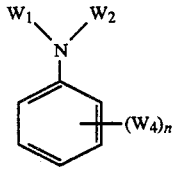

general formula (D)

$W_1-O-W_2$ general formula (E)

wherein $R_1$, $W_2$ and $W_3$ each represent a substituted or unsubstituted alkyl, cycloalkyl, alkenyl, aryl or heterocyclic ring, $W_4$ represents $W_1$, $OW_1$ or $S-W_1$ and n represents an integer of 1 to 5, and when n is 2 or larger, the groups $W_4$ may be either the same or different, and $W_1$ and $W_2$ in the general formula (E) may form together a condensed ring.

It is preferred to use a colored coupler in combination with a photographing color sensitive material so as to compensate an unnecessary absorption of a colored dye formed by magenta and cyan coupler in a short wave length region. Typical examples of them include yellow-colored magenta couplers described in U.S. Pat. No. 4,163,670 and Japanese Patent Publication No. 57-39413, and magenta-colored cyan couplers described in U.S. Pat. Nos. 4,004,929 and 4,138,258 and British Pat. No. 1,146,368.

The standard amount of the color coupler is 0.001 to 1 mol per mol of the photosensitive silver halide, preferably 0.01 to 0.5 mol (yellow coupler), 0.003 to 0.3 mol (magenta coupler) or 0.002 to 0.3 mol (cyan coupler). The standard amount of the color coupler to be applied to a color paper is in the range of 4 to $14\times10^{-4}$, 2 to $8\times10^{-4}$ and 2 to $9\times10^{-4}$ mol/m$^2$ for yellow, magenta and cyan couplers, respectively.

For the spectral sensitization of the silver halide emulsion of the present invention in a given wave length region, a dye selected from the group consisting of the following dyes can be used: cyanine, merocyaninre, complex cyanine, complex mercoyanine, holopolar cyanine, hemicyanine, styryl and hemioxonol dyes. Particularly useful dyes are cyanine, mercocyanine and complex merocyanine dyes. These dyes may have any of nuclei which are contained in cyanine dyes as basic heterocyclic nuclei. Examples of the nuclei include pyrroline, oxazoline, thiazoline, pyrrole, oxazole, thiazole, selenazole, imidazole, tetrazole and pyridine nuclei; and the nuclei fused with an alicyclic hydrocarbon ring or an aromatic hydrocarbon ring such as indolenine, benzindoleninre, indole, benzoxazole, naphthoxazole, benothiazole, naphthothiazole, benzoselenazole, benzimidazole and quinoline nuclei. These nuclei may have a substituent bonded with the hydrocarbon part.

The merocyanine or complex mercocyanine dyes may have a 5- or 6-membered heterocyclic nucleus having a ketonethylene structure such as pyrazolin-5-one, thiohydantoin, 2-thiooxazolidin-2,4-dione, thiazolidin-2,4-dione, rhodanine or thiobarbituric acid nucleus.

These sensitizing dyes may be used either singly or in combination of them. The combination of the sensitizing dyes is frequently used for the purpose of supersensitization. The emulsion contains, in addition to the sensitizing dye, a dye which per se does ot have the spectral sensitization effect or a supersensitizing substance which does substantially not absorb visible rays. Examples of them include aminostilbene compounds substituted with a nitrogen-containing heterocyclic nucleus group (such as those described in U.S. Pat. Nos. 2,933,390 and 3,635,721), aromatic organic acid/formaldehyde condensates (such as those described in U.S. Pat. No. 3,743,510), cadmium salts and azaindene compounds. Combinations described in U.S. Pat. Nos. 3,615,613, 3,615,641, 3,617,295 and 3,635,721 are particularly useful.

It is preferred to use a sensitizing dye or supersensitizer selected from the group consisting of compounds of the following general formulae (VI), (VII), (VIII), (IX), (X), (XI) and (XII):

general formula (VI)

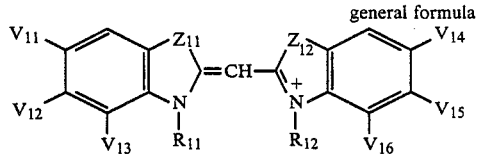

$(X_{11})_{m11}$ wherein $Z_{11}$ represents an oxygen atom, sulfur atom or selenium atom, $Z_{12}$ represents a sulfur atom or selenium atom, $R_{11}$ and $R_{12}$ each represents a substituted or unsubstituted alkyl or alkenyl group having 6 or less carbon atoms and one of $R_{11}$ and $R_{12}$ represents a sulfo-substituted alkyl group. Preferably at least one of $R_{11}$ and $R_{12}$ represents a 3-sulfopropyl group, 2-hydroxy-3-sulfopropyl group, 3-sulfobutyl group or sulfoethyl group. The substituents include, for example, alkoxy groups having 4 or less carbon atoms, halogen atoms, hydroxy group, carbamoyl group, substituted or unsubstituted phenyl groups having 8 or less carbon atoms, carboxy group, sulfo group and alkoxycarbonyl groups having 5 or less carbon atoms. Examples of $R_{11}$ and $R_{12}$ include methyl, ethyl, ethyl, propyl, allyl, pentyl, hexyl, methoxyethyl, ethoxyethyl, phenethyl, 2-p-triethyl, 2-p-sulfophenethyl, 2,2,2-trifluoroethyl, 2,2,3,3-tetrafluoropropyl, carbamoylethyl, hydroxyethyl, 2-(2-hydroxyethyl)ethyl, carboxymethyl, carboxyethyl, ethoxycarbonylmethyl, 2-sulfoethyl, 2-chloro-3-sulfopropyl, 3-sulfopropyl, 2-hydroxy-3-sulfopropyl, 3-sulfobutyl and 4-sulfobutyl groups.

When $Z_{11}$ represents an oxygen atom, $V_{11}$ and $V_{13}$ each represent a hydrogen atom and $V_{12}$ represents a phenyl group, an alkyl or alkoxy group having 3 or less carbon atoms or pheny group substituted with chlorine atom (particularly preferably $V_{12}$ is the phenyl group). $V_{11}$ and $V_{12}$ or $V_{12}$ and $V_{13}$ may be connected together to form a condensed benzene ring. It is most preferred that $V_{11}$ and $V_{13}$ each represent the hydrogen atom and $V_{12}$ represents the phenyl group.

When $Z_{11}$ represents a sulfur atom or selenium atom, $V_{11}$ represents an alkyl or alkoxy group having 4 or less carbon atoms or a hydrogen atom, $V_{12}$ represents an alkyl group having 5 or less carbon atoms, an alkoxy group having 4 or less carbon atoms, chlorine atom, hydrogen atom, substituted or unsubstituted phenyl group (such as tolyl, anisyl or phenyl group) or hydroxy group, and $V_{13}$ represents a hydrogen atom or $V_{11}$ and $V_{12}$ or $V_{12}$ and $V_{13}$ may form together a condensed benzene ring. Preferably $V_{11}$ and $V_{13}$ each represent a hydrogen atom and $V_{12}$ represents an alkoxy group having 4 or less carbon atoms, phenyl group or chlorine atom; or $V_{11}$ represents an alkoxy or alkyl group having 4 or less carbon atoms and $V_{12}$ represents a hydroxy group or alkyl group having 4 or less carbon atoms; or $V_{12}$ and $V_{13}$ form together a condensed benzene ring.

When $Z_{12}$ represents a selenium atom, the meanings of $V_{14}$ and $V_{11}$, $V_{15}$ and $V_{12}$, and $V_{16}$ and $V_{13}$ are the same. When $Z_{12}$ represents a sulfur atom and $Z_{11}$ represents a selenium atom, $V_{14}$ represents a hydrogen atom or alkoxy group having 4 or less carbon atoms, $V_{15}$ represents an alkoxy group having 4 or less carbon atoms, substituted or unsubstituted phenyl group (such as tolyl or anisyl group or preferably phenyl group), alkyl group having 4 or less carbon atoms, chlorine atom or hydroxy group, $V_{16}$ represents a hydrogen atom; or $V_{14}$ and $V_{15}$, or $V_{15}$ and $V_{16}$ together form a condensed benzene ring. Preferably $V_{14}$ and $V_{16}$ each represent a hydrogen atom and $V_{15}$ represents an alkoxy group having 4 or less carbon atoms, chlorine atom or phenyl group; or $V_{15}$ and $V_{16}$ together form a condensed benzene ring. When both $Z_{11}$ and $Z_{12}$ represent a sulfur atom, $V_{14}$ and $V_{16}$ each represent a hydrogen atom and $V_{15}$ represents an unsubstituted or substituted phenyl group (such as phenyl of tolyl group); or alternatively, $V_{14}$ represents a hydrogen atom and $V_{15}$ and $V_{16}$ can form together a condensed benzene ring. When $Z_{11}$ represents an oxygen atom and $Z_{12}$ represents a sulfur atom, $V_{14}$ and $V_{16}$ each represent a hydrogen atom and $V_{15}$ represents a chlorine atom, unsubstituted or substituted phenyl group or alkoxy group having 4 or less carbon atoms; or $V_{15}$ and $V_{16}$ can form together a condensed benzene ring; or preferably $V_{14}$ and $V_{16}$ each represent a hydrogen atom and $V_{15}$ represents a phenyl group; or $V_{15}$ and $V_{16}$ form together a condensed benzene ring.

$X_{11}$ represents a residual group of an acid anion, and $m_{11}$ represents 0 or 1 (when the compound is an inner salt, $m_{11}$ represents 1).

general formula (VII)

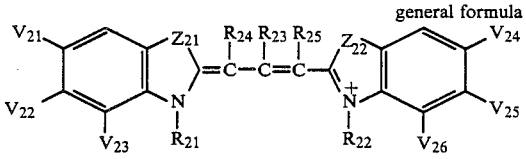

$(X_{21})_{m21}$ wherein $Z_{21}$ represents an oxygen, sulfur or selenium group or n—$R_{26}$, $Z_{22}$ represents an oxygen atom or >N—$R_{27}$, $R_{21}$ and $R_{22}$ have the same meaning as that of $R_{11}$ or $R_{12}$ in the above general formula I, or $R_{21}$ can be bonded with $R_{24}$ to form a 5- or 6-membered carbon ring and $R_{22}$ can be bonded with $R_{25}$ to form this ring.

$R_{23}$ represents a hydrogen atom when at least one of $Z_{21}$ and $Z_{22}$ represents >N—$R_{26}$, or $R_{23}$ represents an ethyl, propyl or butyl group (preferably ethyl group) in other cases, and $R_{24}$ and $R_{25}$ each represent a hydrogen atom.

$R_{26}$ and $R_{27}$ have the same meaning as that of $R_{21}$ and $R_{22}$ with the proviso that both of $R_{21}$ and $R_{26}$ cannot have a substituent having sulfo group at the same time or $R_{22}$ and $R_{27}$ cannot have a substituent having sulfo group at the same time.

$V_{21}$ represents a hydrogen atom when $Z_{21}$ represents an oxygen atom, $V_{21}$ represents a hydrogen atom or alkyl or alkoxy group having 5 or less carbon atoms when $Z_{21}$ represents a sulfur or selenium atom, or $V_{21}$ represents a hydrogen or chlorine atom when $Z_{21}$ represents >N—$R_{26}$.

$V_{22}$ represents a hydrogen atom, alkyl or alkoxy group having 5 or less carbon atoms, chlorine atom or unsubstituted or substituted phenyl group (such as tolyl, anisyl or phenyl group) or $V_{22}$ can form a condensed benzene ring together with $V_{21}$ or $V_{23}$ (preferably $V_{22}$ represents an alkoxy or phenyl group or $V_{22}$ forms a condensed benzene ring together with $V_{21}$ or $V_{23}$) when $Z_{21}$ represents an oxygen atom and $Z_{22}$ represents >N—$R_{27}$; $V_{22}$ represents an unsubstituted or substituted phenyl group (such as tolyl, anisyl or phenyl group; the phenyl group being preferred) or $V_{22}$ forms a condensed benzene ring together with $V_{21}$ or $V_{23}$ when $Z_{21}$ and $Z_{22}$ each represent an oxygen atom; $V_{22}$ represents a hydrogen atom, alkyl or alkoxycarbonyl group having 5 or less carbon atoms, alkoxy or acylamino group having 4 or less carbon atoms, chlorine atom or unsubstituted or substituted phenyl group (preferably an alkyl or alkoxy group having 4 or less carbon atoms, chlorine atom or phenyl group) when $Z_{21}$ represents a sulfur or selenium atom; or $V_{22}$ can form a condensed benzene ring together with $V_{23}$ when $Z_{21}$ represents a sulfur atom. Further, $V_{22}$ represents a chlorine atom, trifluoromethyl or cyano group or alkylsulfonyl group having 4 or less carbon atoms or alkoxycarbonyl group having 5 or less carbon atoms when $Z_{21}$ represents >N—$R_{26}$ (preferably $V_{21}$ represents a chlorine atom and $V_{22}$ represents a chlorine atom or trifluoromethyl or cyano group when $Z_{21}$ represents >N—$R_{26}$).

$V_{24}$ represents a hydrogen atom when $Z_{22}$ represents an oxygen atom, or $V_{24}$ represents a hydrogen or chlorine atom when $Z_{22}$ represents >N—$R_{27}$.

$V_{25}$ represents an alkoxy group having 4 or less carbon atoms, chlorine atom or unsubstituted or substituted phenyl group (such as anisyl, tolyl or phenyl group) or $V_{25}$ can form a condensed benzene ring together with $V_{24}$ or $V_{26}$ when $Z_{22}$ represents an oxygen atom; preferably $V_{25}$ represents an alkoxy group having 4 or less carbon atoms or phenyl group or $V_{25}$ can form a condensed benzene ring together with $V_{24}$ or $V_{26}$ when $Z_{21}$ represents $>N—R_{26}$; and more preferably $V_{25}$ represents a phenyl group or it forms a condensed benzene ring together with $V_{25}$ or $V_{26}$ when $Z_{21}$ represents an oxygen, sulfur or selenium atom. Further, $V_{25}$ represents a chlorine atom, trifluoromethyl or cyano group, alkylsulfonyl group having 4 or less carbon atoms or carboxyalkyl group having 5 or less carbon atoms when $Z_{22}$ represents $>N—R_{27}$. It is most preferred that $V_{24}$ represents a chlorine atom and $V_{25}$ represents a chlorine atom or trifluoromethyl or cyano group.

$V_{26}$ represents a hydrogen atom.

$X_{21}^-$ represents a residual group of an acid anion.

$m_{21}$ represents 0 or 1 (when the compound is an inner salt, $m_{21}$ represents 0).

general formula VIII

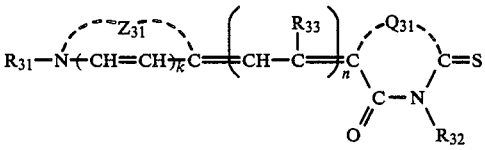

wherein $Z_{31}$ represents an atomic group forming a thiazoline, thiazole, benzothiazole, naphthothiazole, selenasoline, selenasole, benzoselenasole, naphthoselenasole, benzimidazole, naphthoimidazole, oxazole, benzoxazole, naphthoxazole or pyridine nucleus. These heterocyclic nuclei can be substituted. In case of forming benzimidazole nucleus or naphthoimidazole nucleus, substituents of nitrogen at position 1 other than $R_{31}$ are the same as those described above as $R_{26}$ or $R_{27}$ in the general formula II. The substituents of the condensed benzene ring of the benzimidazole include chlorine atom, cyano group, alkoxycarbonyl groups having 5 or less carbon atoms, alkylsulfonyl groups having 4 or less carbon atoms and trifluoromethyl group. Particularly preferred is the compound having a chlorine atom at position 5, and cyano group, chlorine atom or trifluoromethyl group at position 6. Examples of the substituents of the heterocyclic nuclei other than the benzimidazole, selenazoline and thiazoline nuclei include unsubstituted or substituted alkyl groups having 8 or less carbon atoms in total (the substituents being, for example, hydroxy group, chlorine or fluorine atom or alkoxy, carboxy, alkoxycarbonyl, phenyl or substituted phenyl group), hydroxy group, alkoxycarbonyl groups having 5 or less carbon atoms, halogen atoms, carboxy, furyl, thienyl, pyridyl, phenyl group and substituted phenyl groups (such as tolyl, anisyl and chlorophenyl groups). Examples of the substituents of the selenasoline or thiazoline nucleus include alkyl groups having 6 or less carbon atoms, hydroxyalkyl groups having 5 or less carbon atoms and alkoxycarbonylalkyl groups having 5 or less carbon atoms.

$R_{31}$ has the same meaning as $R_{11}$ or $R_{12}$ in the general formula I.

$R_{32}$ has the same meaning as $R_{11}$ or $R_{12}$ in the general formula I or it represents a hydrogen atom, furfuryl group or an unsubstituted or substituted monocyclic aryl group (such as phenyl, tolyl, anisyl, carboxyphenyl, hydroxyphenyl, chlorophenyl, sulfophenyl, pyridyl, 5-methyl-2-pyridyl, 5-chloro-2-pyridyl, thienyl or furyl group). At least one of $R_{31}$ and $R_{32}$ represents a substituent having a sulfo or carboxy group and the other represents a sulfo-free group.

$R_{33}$ represents a hydrogen atom, alkyl group having 5 or less carbon atoms, or phenethyl, phenyl or 2-carboxyphenyl group. Among them, hydrogen atom or methyl or ethyl group is preferred.

$Q_{31}$ represents an oxygen, sulfur or selenium atom or $>N—R_{34}$. Preferably $Q_{31}$ represents a sulfur or selenium atom or $>N—R_{34}$ when $Z_{31}$ represents an atomic group forming thiazoline, selenazoline or oxazole nucleus.

$R_{34}$ represents a pyridyl or phenyl group, substituted phenyl group (such as tolyl or anisyl group) or aliphatic hydrocarbon group having 8 or less carbon atoms in total which may have (1) an oxygen, sulfur or nitrogen atom in the carbon chain and (2) a substituent such as hydroxy group, halogen atom or alkylaminocarbonyl, alkoxycarbonyl or phenyl group. Preferably $R_{34}$ represents a hydrogen atom, phenyl or pyridyl group or alkyl group which can contain (1) an oxygen atom in the carbon chain and (2) hydroxy group.

k represents 0 or 1, and n represents 0 or 1.

$Q_{31}$ represents an oxygen atom when n represents 1 and $Z_{31}$ represents a pyridyl-forming atomic group.

Examples of the compounds of the general formulae VI, VII and VIII are as follows:

VI-1

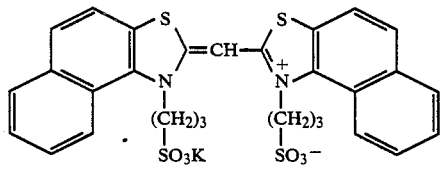

VI-2

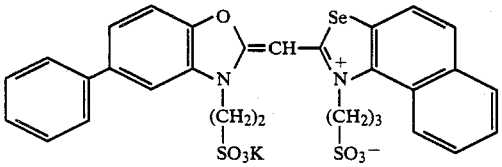

-continued
VI-3
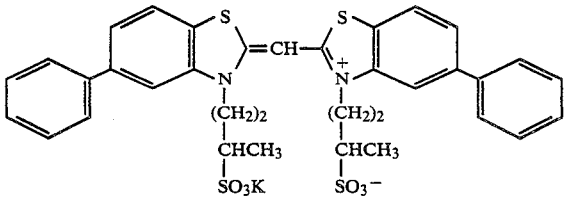
VI-4
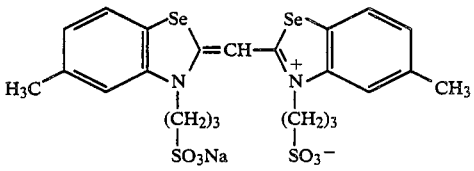
VI-5
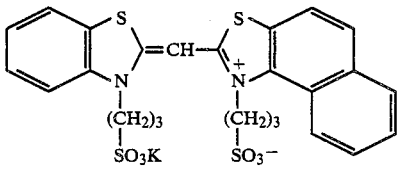
VI-6
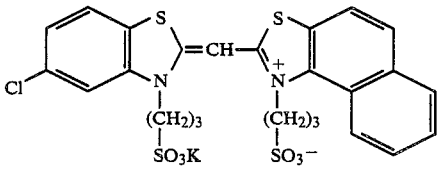
VI-7
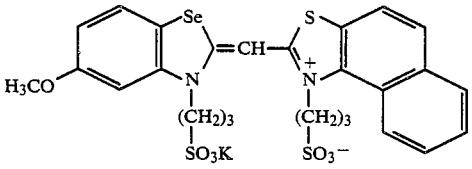
VI-8
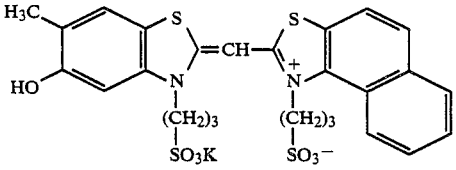
VI-9
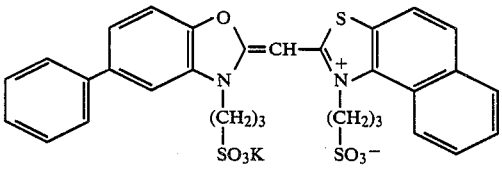
VI-10
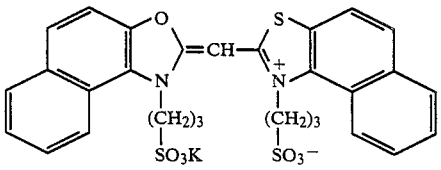

-continued
VI-11
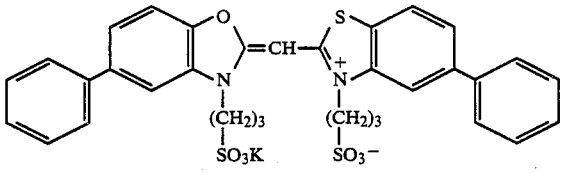
VI-12
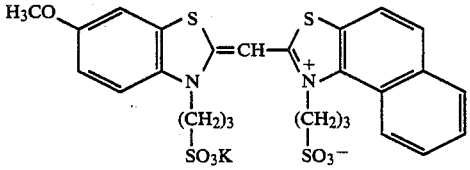
VI-13
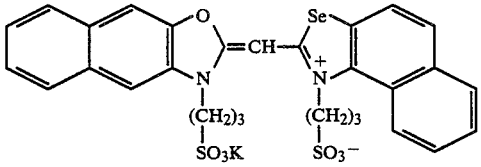
VI-14
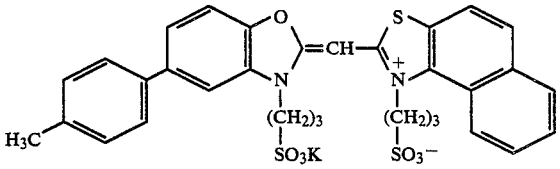
VI-15
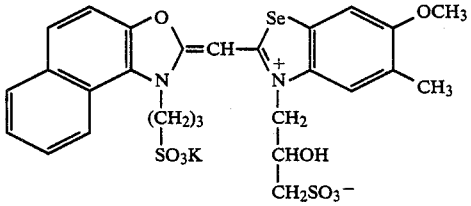
VI-16
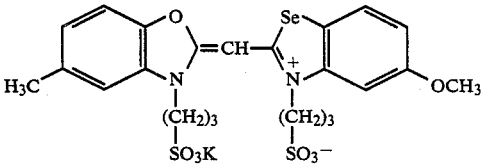
VII-1
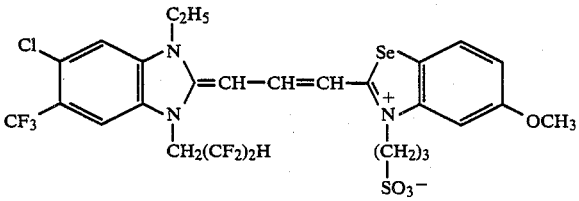
VII-2
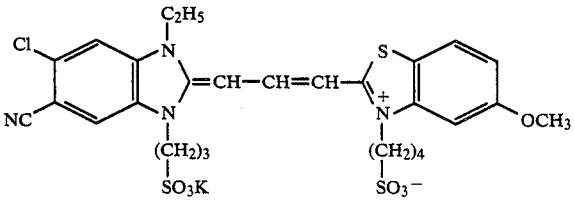

-continued
VII-3
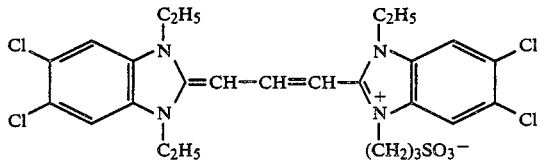
VII-4
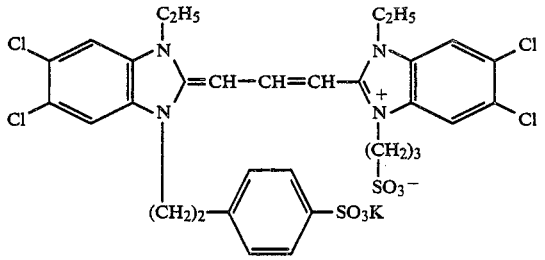
VII-5
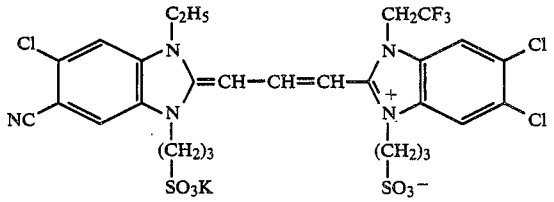
VII-6
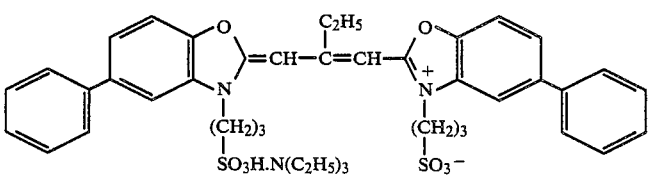
VII-7
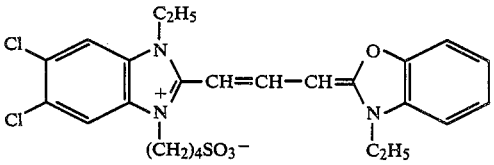
VII-8
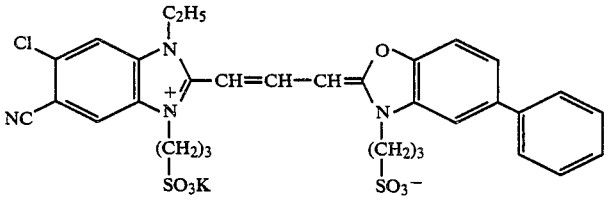
VII-9
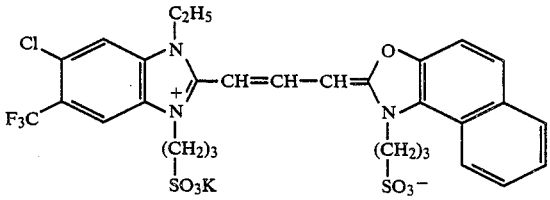
VII-10
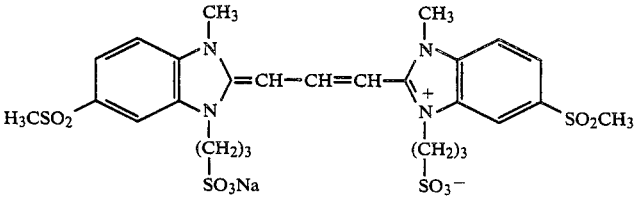

-continued
VII-11
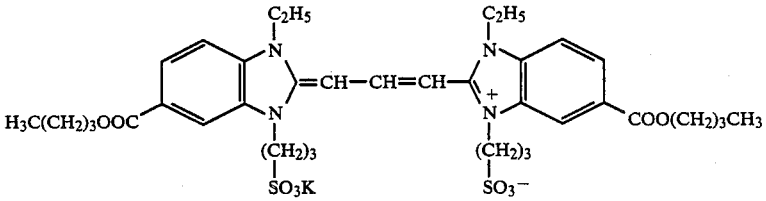
VII-12
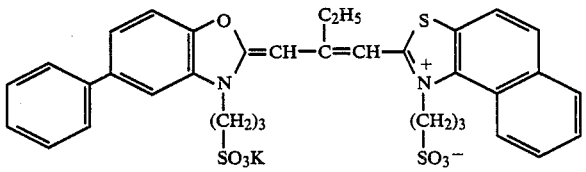
VII-13
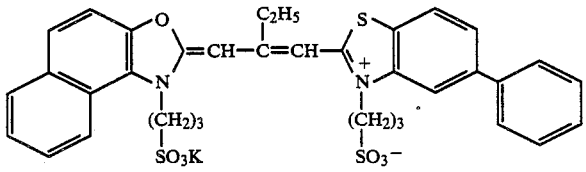
VII-14
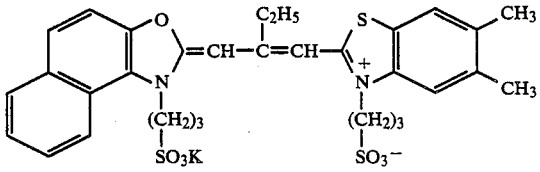
VII-15
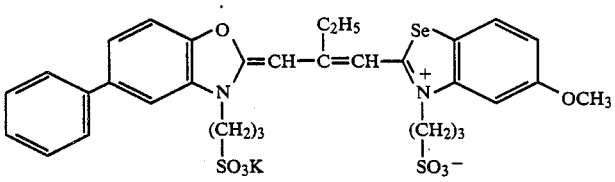
VII-16
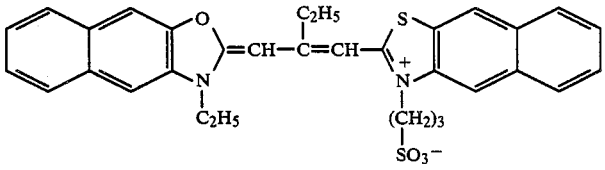
VII-17
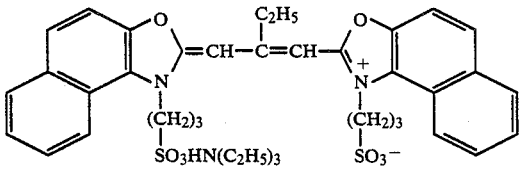
VII-18
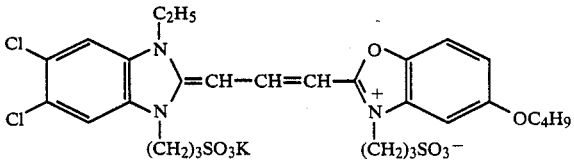

-continued
VII-19
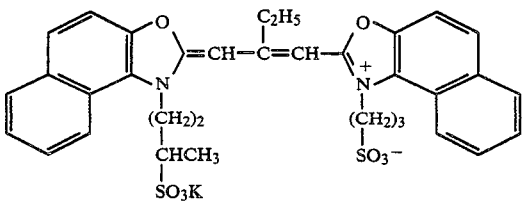
VII-20
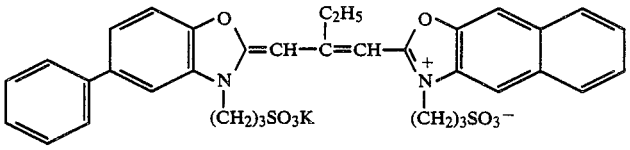
VII-21
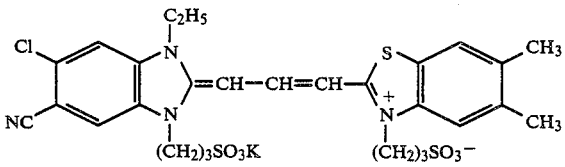
VII-22
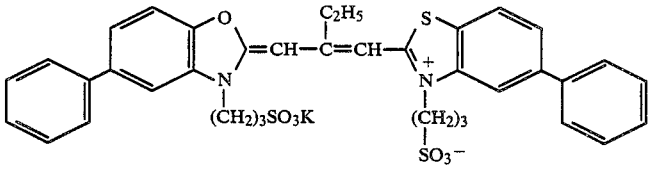
VII-23
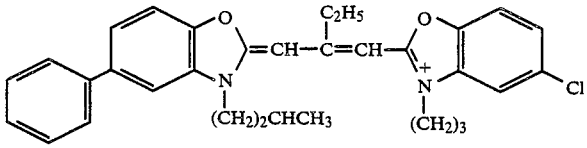
VIII-1
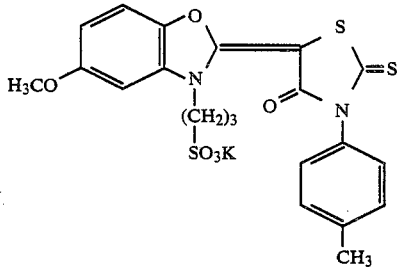
VIII-2
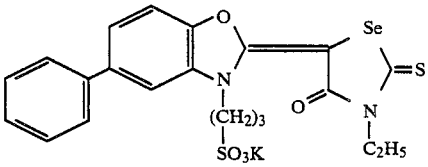
VIII-3
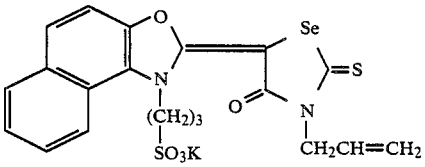

-continued
VIII-4
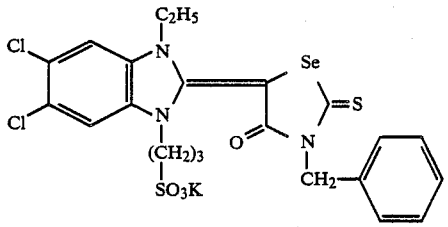
VIII-5
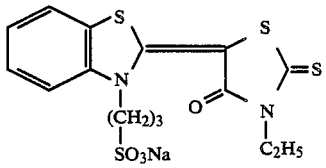
VIII-6
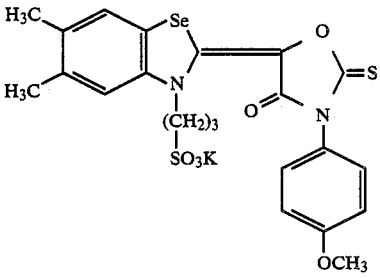
VIII-7
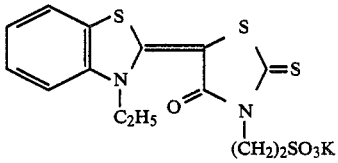
VIII-8
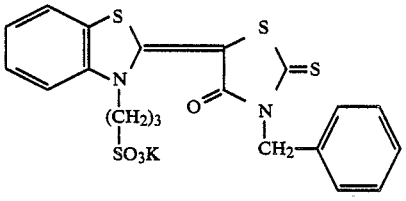
VIII-9
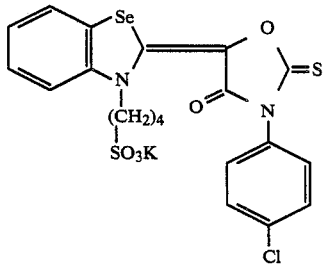
VIII-10
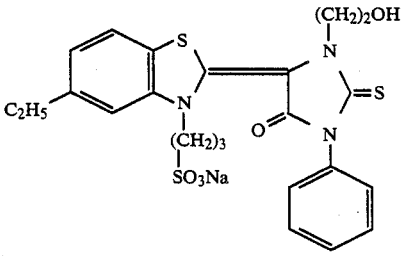

-continued
VIII-11
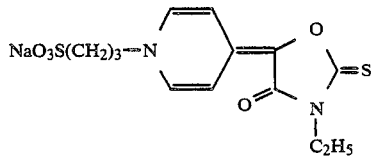
VIII-12
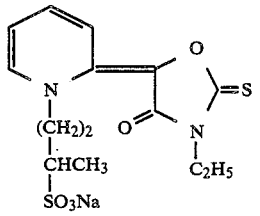
VIII-13
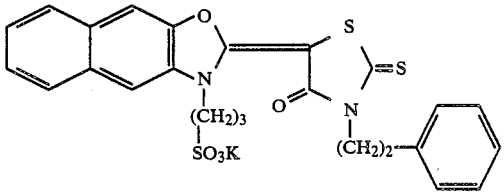
VIII-14
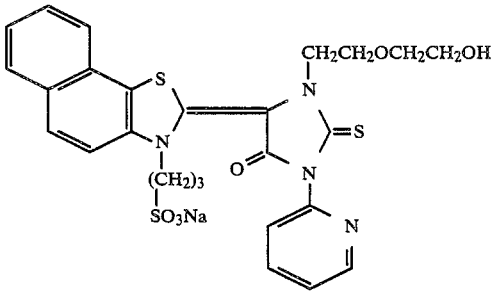
VIII-15
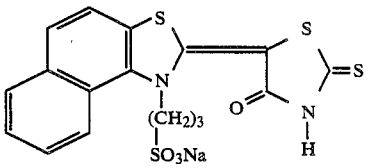
VIII-16
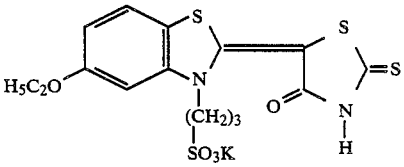
VIII-17
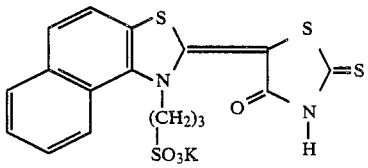

-continued
VIII-18
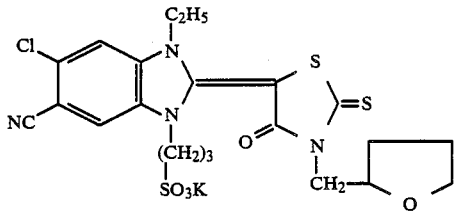
VIII-19
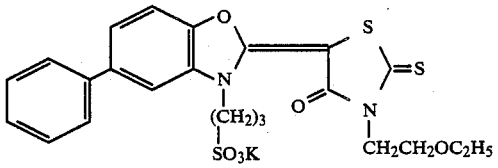
VIII-20
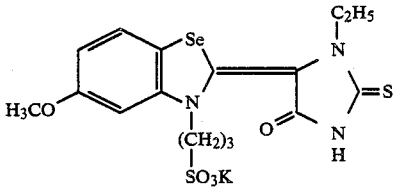
VIII-21
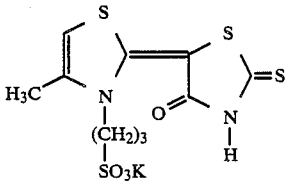
VIII-22
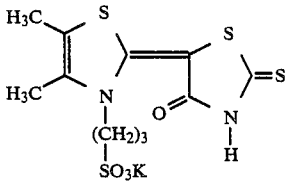
VIII-23
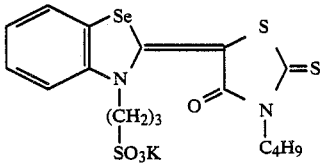
VIII-24
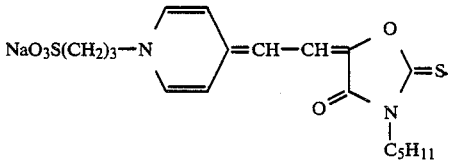
VIII-25
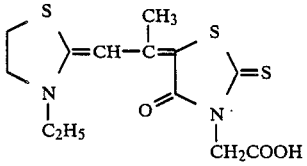

-continued
VIII-26
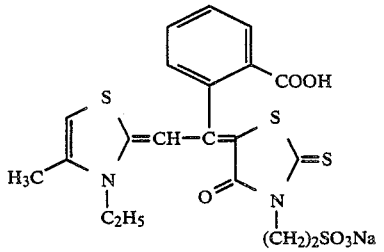
VIII-27
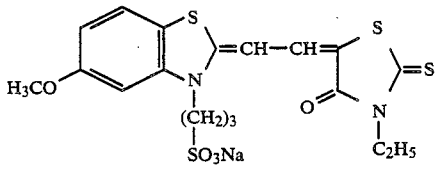
VIII-28
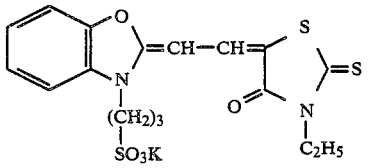
VIII-29
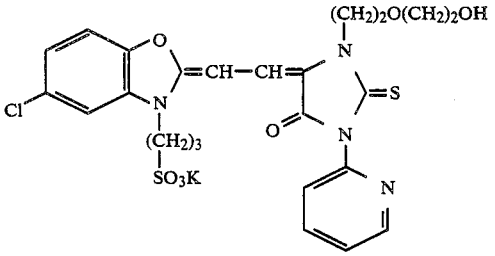
VIII-30
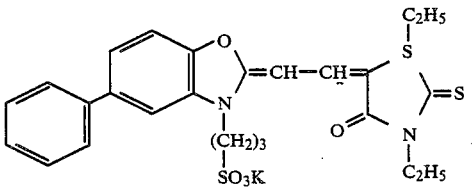
VIII-31
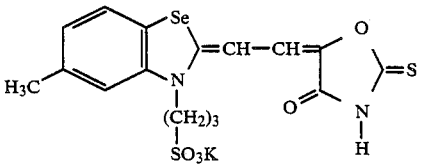
VIII-32
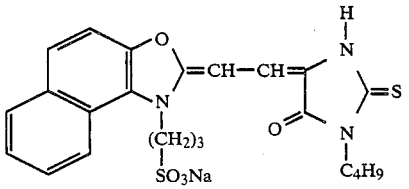

-continued

VIII-33

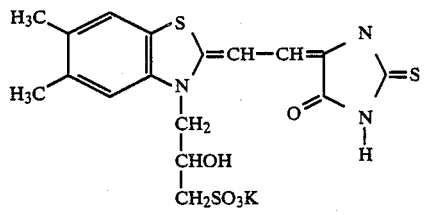

VIII-34

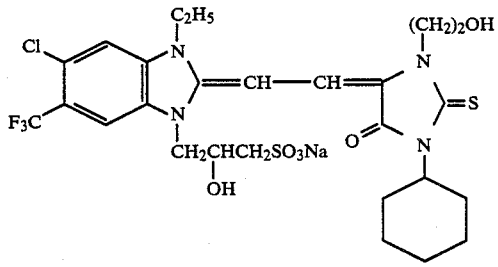

VIII-35

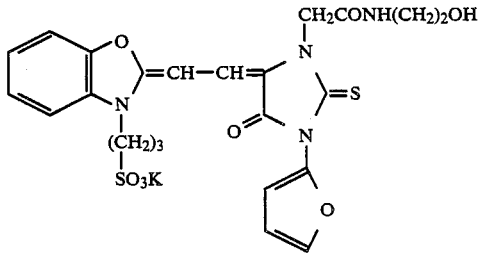

VIII-36

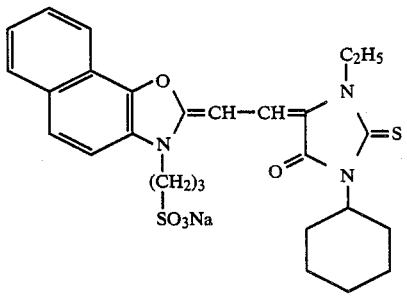

VIII-37

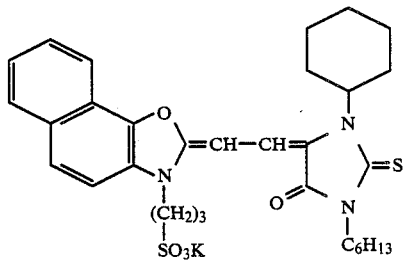

general formula IX

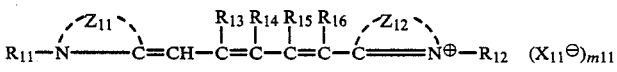

In the above formulae, $Z_{11}$ represents an atomic group forming benzoxazole, naphthoxazole, benzothiazole, naphthothiazole, dihydronaphthothiazole, benzoselenazole, naphthoselenazole or dihydronaphthoselenazole, and $Z_{12}$ represents an atomic group forming benzothiazole, naphthothiazole, dihydronaphthothiazole, benzoselenazole, naphthoselenazole or dihydronaphthoselenazole.

The nitrogen-containing heterocyclic nucleus represented by $Z_{11}$ or $Z_{12}$ can have one or more substituents. Examples of the preferred substituents include lower alkyl groups (more preferably alkyl groups having 6 or less carbon atoms), lower alkoxy groups (more preferably alkoxy groups having 6 or less carbon atoms), chlorine atom, lower alkoxycarbonyl groups (more preferably alkoxycarbonyl groups having 5 or less carbon atoms), unsubstituted or substituted phenyl groups (such as phenyl, tolyl, anisyl and chlorophenyl groups) and hydroxy group.

Examples of the compounds having the nitrogen-containing heterocyclic nucleus represented by $Z_{11}$ or $Z_{12}$ include 5-hydroxybenzoxazole, 5-methoxyoxazole, 5-ethoxybenzoxazole, 5-phenylbenzoxazole, 5,6-dimethylbenzoxazole, 5-methyl-6-methoxybenzoxazole, 6-ethoxy-5-hydrobenzoxazole, naphtho(1,2-d)oxazole, naphtho(2,3-d)oxazole, naphtho(2,1-d)oxazole, 5-methylbenzothiazole, 5-methoxybenzothiazole, 5-ethylbenzothiazole, 5-p-tolylbenzothiazole, 6-methylbenzothiazole, 6-ethylbenzothiazole, 6-butylbenzothiazole, 6-methoxybenzothiazole, 6-butoxybenzothiazole, 5,6-dimethylbenzothiazole, 5,6-dimethoxybenzothiazole, 5-hydroxy-6-methylbenzothiazole, 5-ethoxycarbonylbenzothiazole, 5-chlorobenzothiazole, 5-chloro-6-methylbenzothiazole, naphtho(1,2-d)thiazole, naphtho(2,1-d)thiazole, 5-methylnaphtho(2,1-d)thiazole, 8,9-dihydronaphtho(1,2-d)thiazole, 8-methoxynaphtho(1,2-d)thiazole, benzothiazole, benzoselenasole, 5-methylbenzoselenasole, 6-methylbenzoselenasole, 5-methoxybenzoselenasole, 6-methoxybenzoselenasole, 5,6-dimethylbenzoselenasole, 5-ethoxy-6-methylbenzoselenazole, 5-hydroxy-6-methylbenzoselenazole, naphtho(1,2-d)selenazole and naphtho(2,1-d)selenazole.

$R_{11}$ and $R_{12}$ may be the same or different and they each represent an unsubstituted or substituted alkyl or alkenyl group having 10 or less carbon atoms. At least one of $R_{11}$ and $R_{12}$ has a sulfo group. Examples of the substituents of the alkyl and alkenyl groups include the above-mentioned sulfo group, alkoxy groups having 6 or less carbon atoms, halogen atoms, hydroxy group, unsubstituted or substituted aryl group having 8 or less carbon atoms (such as phenyl, furyl, thienyl, tolyl, p-butylphenyl, xylyl, anisyl, sulfophenyl, hydroxyphenyl, carboxyphenyl and chlorophenyl groups), unsubstituted or substituted phenoxy groups having 8 or less carbon atoms (the substituents being, for example, a fluorine or chlorine atom or sulfo, hydroxy, carboxy, alkoxycarbonyl, alkyl or alkoxy groups), acyl groups having 8 or less carbon atoms (such as phehylsulfonyl, tosyl, methylsulfonyl, benzoyl, acetyl and propionyl groups) alkoxycarbonyl groups having 6 or less carbon atoms and carboxy group.

$R_{13}$ and $R_{16}$ each represent a hydrogen atom or $R_{13}$ can form a 5- or 6-membered ring together with $R_{15}$.

$R_{14}$ represents a hydrogen atom, or when $R_{13}$ and $R_{16}$ each represent a hydrogen atom, $R_{14}$ represents an alkyl group having 4 or less carbon atoms or a phenylalkyl group having 10 or less carbon atoms.

Preferably, $R_{14}$ represents a hydrogen atom and $R_{13}$ and $R_{15}$ together form a 5- or 6-membered ring or, alternatively, $R_{13}$ and $R_{15}$ each represent a hydrogen atom and $R_{14}$ represents a benzyl group.

$R_{16}$ represents a hydrogen atom or it can form a 5- or 6-membered carbon ring together with $R_{12}$.

Among the nitrogen-containing heterocyclic nucleus-forming atomic groups represented by $Z_{11}$, preferred are naphthoxazoles, benzothiazoles having at least one electron-donating group having a negative Hammett's $\delta_p$ value, dihydronaphthothiazoles, naphthothiazoles and benzoselenazoles.

$X_{11}^{\ominus}$ represents a residual group of an acid anion.

$m_{11}$ represents 0 or 1 (when the compound is an inner salt, $m_{11}$ represents 0).

general formula X

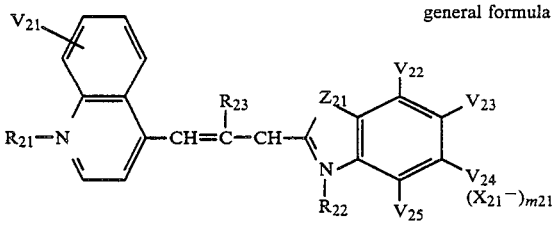

wherein $Z_{21}$ represents a sulfur atom or selenium atom.

$R_{21}$ and $R_{22}$ have the same meaning as that of $R_{11}$ or $R_{12}$ in the general formula I and at least one of them represents a substituent having a sulfo or carboxy group.

$R_{23}$ represents a hydrogen atom or lower alkyl group having 4 or less carbon atoms.

$V_{21}$ represents a hydrogen atom, alkyl or alkoxy group having 6 or less carbon atoms, fluorine or chlorine atom or hydroxy group.

$V_{22}$ and $V_{25}$ each represent a hydrogen atom.

$V_{23}$ represents a hydrogen atom, lower alkyl group (having preferably 6 or less carbon atoms), lower alkoxy group (having preferably 6 or less carbon atoms) or hydroxy group.

$V_{24}$ represents a hydrogen atom, lower alkyl group (having preferably 6 or less carbon atoms), lower alkoxy group (having preferably 6 or less carbon atoms), chlorine atom, lower alkoxycarbonyl group, unsubstituted or substituted phenyl group (such as phenyl, tolyl or anisyl group) or hydroxy group.

$V_{22}$ and $V_{23}$; $V_{23}$ and $V_{24}$; or $V_{24}$ and $V_{25}$ can form together a condensed benzene ring which may have a substituent. Examples of the substituents include chlorine atom, lower alkyl groups (having preferably 4 or less carbon atoms) and lower alkoxy groups (having preferably 4 or less carbon atoms).

Among the nitrogen-containing heterocyclic nuclei containing $Z_{21}$, the most preferred are naphtho(1,2-d)thiazole, naphtho(2,1-d)thiazole, naphtho(1,2-d)selenazole, naphtho(2,1-d)selenazole and benzoselenazoles having at least one electron-donating group having a negative Hammett's $\delta_p$ value.

$X_{21}^{\ominus}$ represents a residual group of an acid anion.

$m_{21}$ represents 0 or 1 (when the compound is an inner salt, $m_{21}$ represents 0).

XI

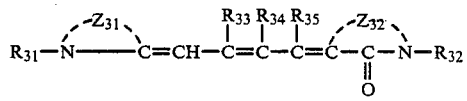

wherein $Z_{31}$ has the same meaning as that of $Z_{12}$ in the general formula I or it represents a naphthoxazole. The nitrogen-containing heterocyclic nucleus formed by $Z_{31}$ may have a substituent which is selected from the above-mentioned substituents of the nitrogen-containing heterocyclic nucleus represented by $Z_{11}$ or $Z_{12}$ in the general formula I.

$Z_{23}$ represents a sulfur or selenium atom or $>N-R_{36}$.

$R_{36}$ represents a hydrogen atom, pyridyl or phenyl group, substituted phenyl group (such as tolyl, anisyl or hydroxyphenyl group) or an aliphatic hydrocarbon group having 8 or less carbon atoms which may have (1) an oxygen, sulfur or nitrogen atom in the carbon chain and (2) a substituent such as a hydroxy group, halogen atom or alkylaminocarbonyl, alkoxycarbonyl or phenyl group. Preferably $R_{36}$ represents a hydrogen atom, phenyl or pyridyl group or alkyl group which can contain (1) an oxygen atom in the carbon chain and (2) hydroxy group.

$R_{31}$ has the same meaning as that of $R_{11}$ or $R_{12}$ in the general formula I.

$R_{32}$ has the same meaning as that of $R_{11}$ or $R_{12}$ in the general formula I or it represents a hydrogen atom, furfuryl group, unsubstituted or substituted monocyclic aryl group (such as phenyl, tolyl, anisyl, carboxyphenyl, hydroxyphenyl, chlorophenyl, sulfophenyl, pyridyl, 5-methyl-2-pyridyl, 5-chloro-2-pyridyl, furyl or thienyl group).

$R_{33}$ and $R_{35}$ each represent a hydrogen atom or they form together a 5- or 6-membered ring.

$R_{34}$ has the same meaning as that of $R_{14}$ in the general formula VI.

At least one of $R_{31}$ and $R_{32}$ represents a sulfo group-free group and the other represents a group containing a sulfo or carboxy group.

IX-1

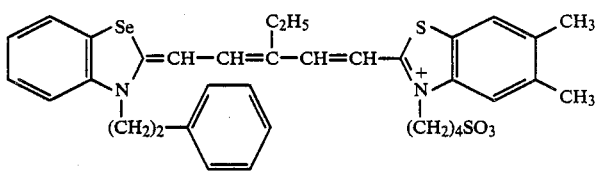

IX-2

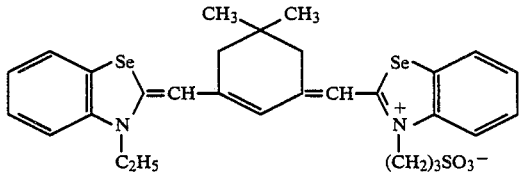

IX-3

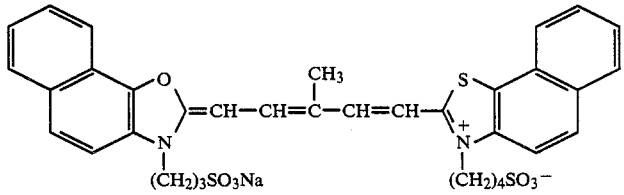

IX-4

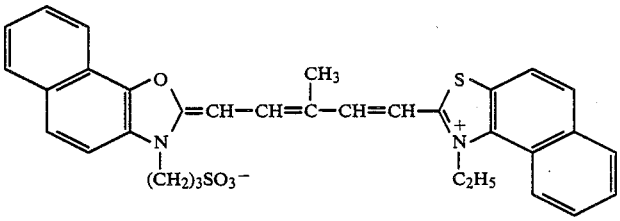

IX-5

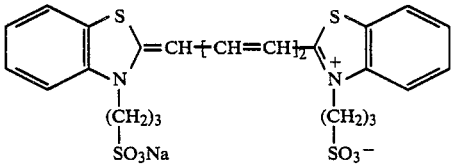

IX-6

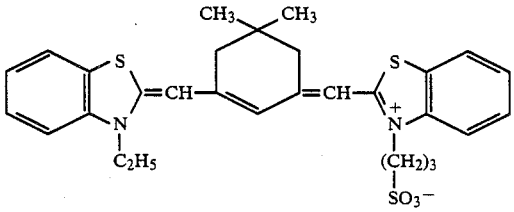

-continued
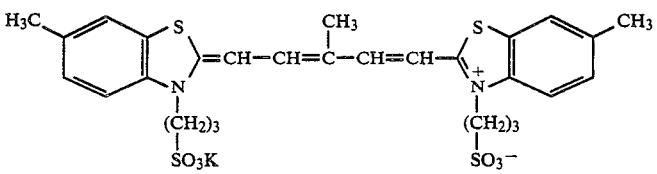
IX-7
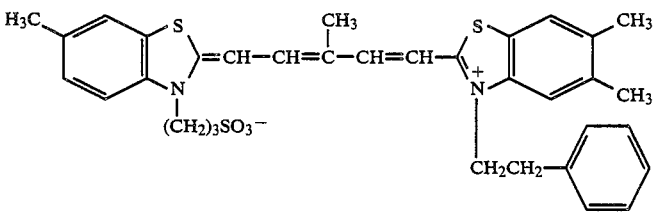
IX-8
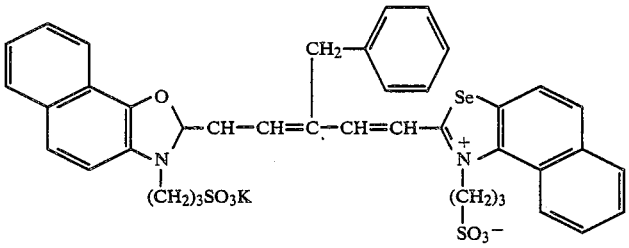
IX-9
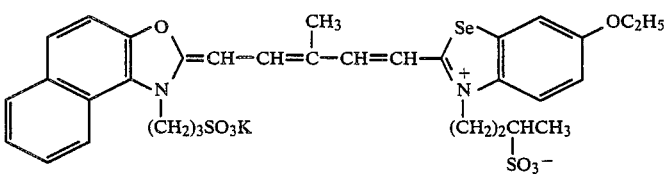
IX-10
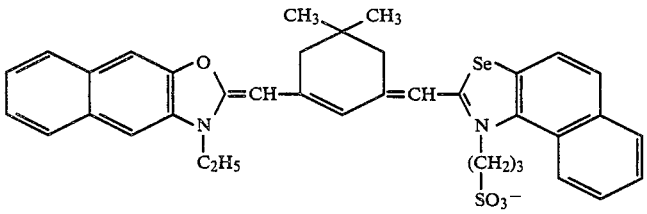
IX-11
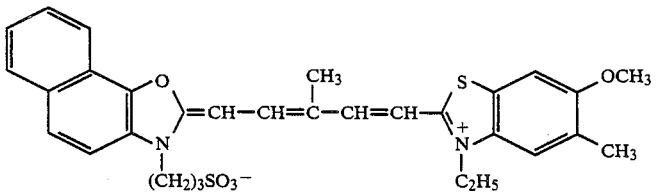
IX-12
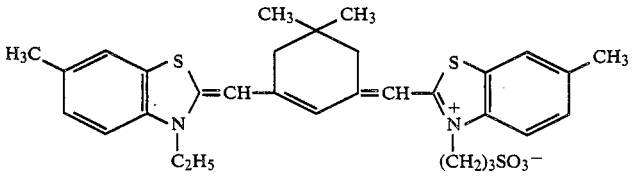
IX-13

-continued
IX-14
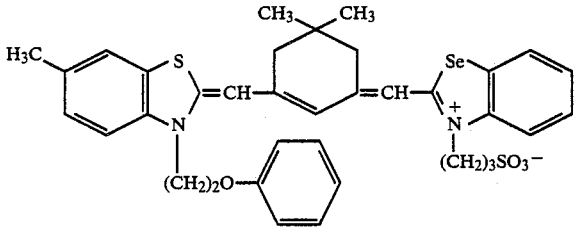
IX-15
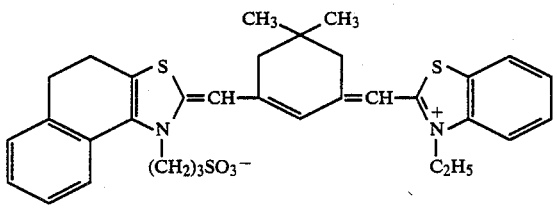
IX-16
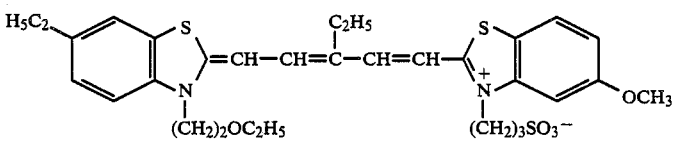
X-1
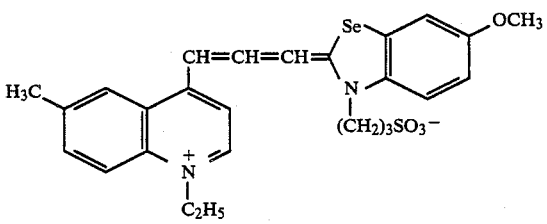
X-2
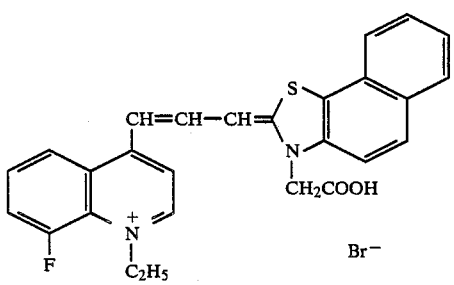
X-3
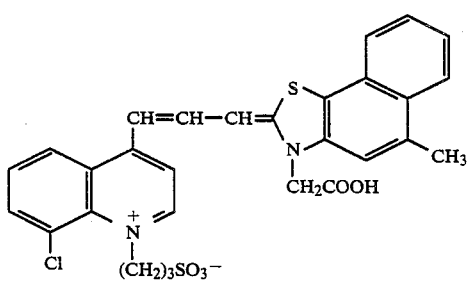
X-4
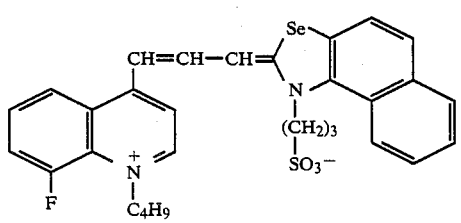

-continued
X-5
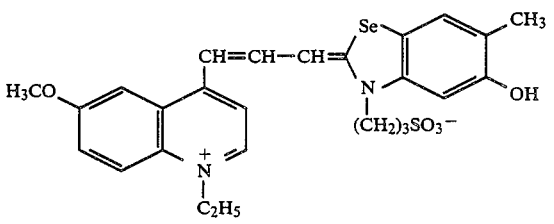
XI-1
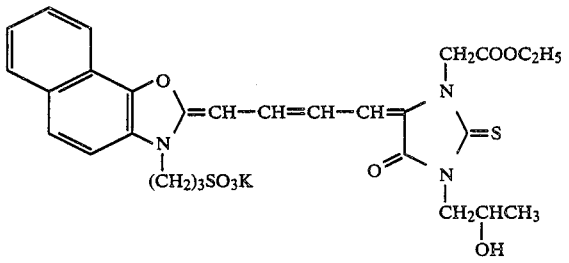
XI-2
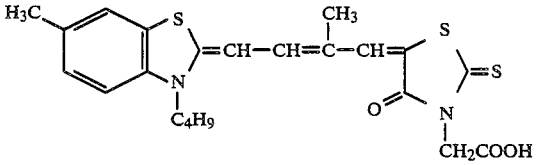
XI-3
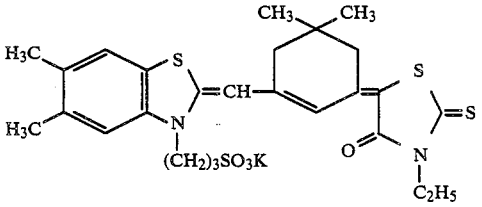
XI-4
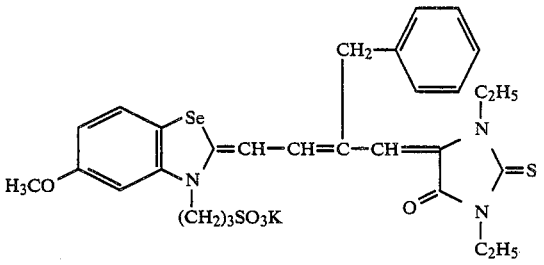
XI-5
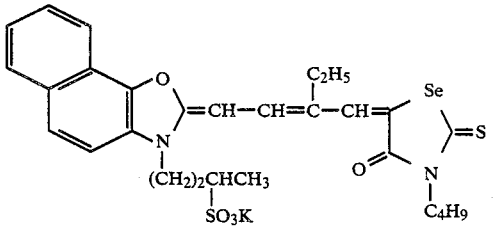
XI-6
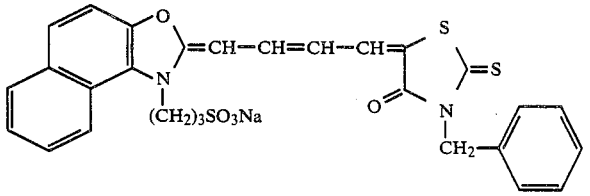

-continued
XI-7
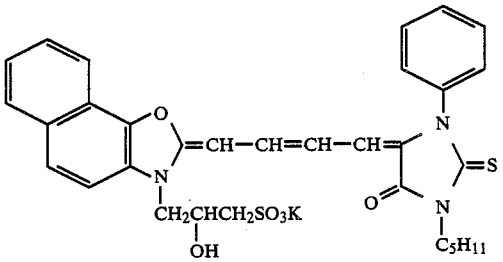
XI-8
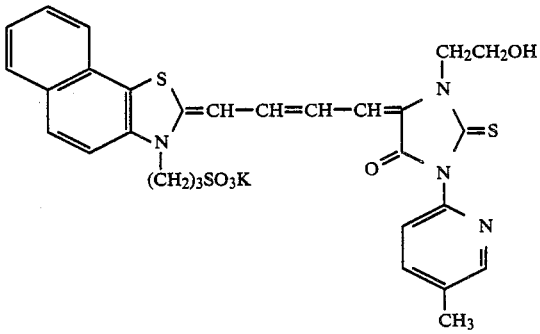
XI-9
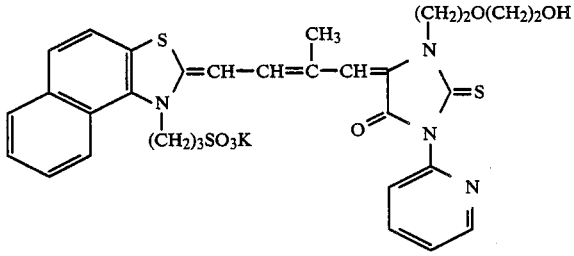
XI-10
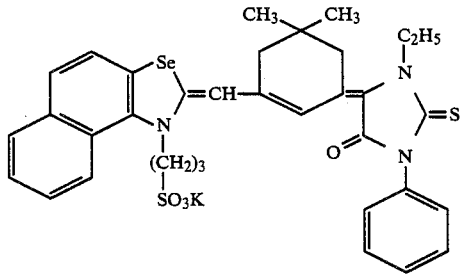
XI-11
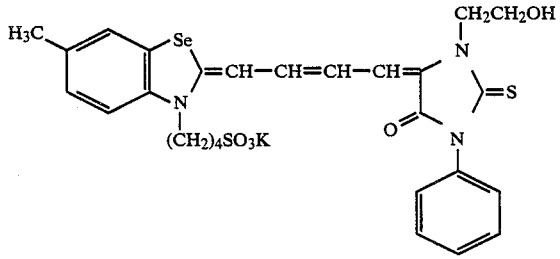
XI-12
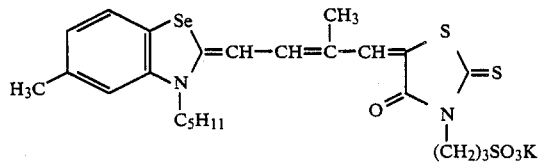

-continued

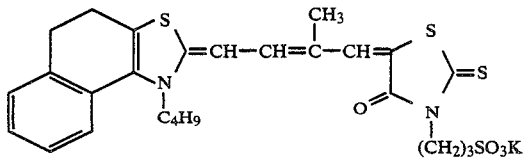

XI-13

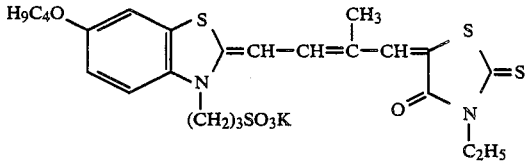

XI-14

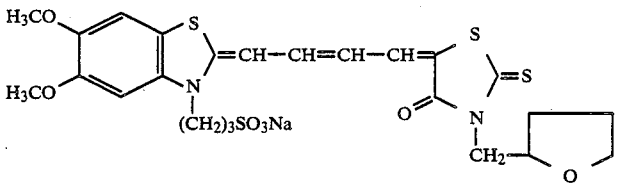

XI-15

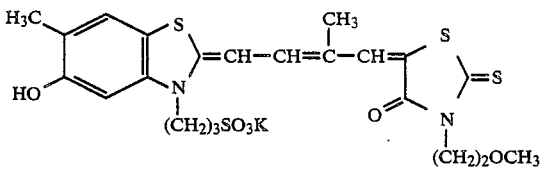

XI-16

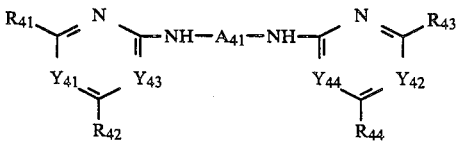

general formula XII wherein $Y_{41}$, $Y_{42}$, $Y_{43}$ and $Y_{44}$ may be the same or different and each represent =CH— or =N—, and at least one of $Y_{41}$ and $Y_{43}$ and at least one of $Y_{42}$ and $Y_{44}$ represent =N—.

$R_{41}$, $R_{42}$, $R_{43}$ and $R_{44}$ may be the same or different and each represent a hydrogen atom, hydroxy group, lower alkoxy group (having preferably 10 or less carbon atoms), aryloxy group (such as phenoxy, tolyloxy, sulfophenoxy, β-naphthoxy, α-naphthoxy or 2,4-dimethylphenoxy group), halogen atom (such as chlorine or bromine atom), heterocyclic nucleus (such as morpholinyl or piperidine group), alkylthio group (such as methylthio or ethylthio group), heterocyclylthio group (such as benzothiazylthio group), arylthio group (such as phenylthio or tolylthio group), amino, alkylamino or substituted alkylamino group (such as methylamino, ethylamino, propylamino, dimethylamino, diethylamino, dodecylamino, cyclohexylamno, β-hydroxyethylamino, di-β-hydroxyethylamino or β-sulfoethylamino group), arylamino or substituted arylamino group (such as anilino, o-sulfoanilino, m-sulfoanilino, p-sulfoanilino, o-anisylamino, m-anisylamino, p-anisylamino, o-methylanilino, p-tert-amylanilino, o-carboxyanilino, m-carboxyanilino, p-carboxyanilino, hydroxyanilino, naphthylamino, sulfonaphthylamino, heterocyclylamino (such as 2-benzothiazolamino or 2-pyridylamino), aryl (such as phenyl) or mercapto group.

$A_{41}$ represents a group having an arylene group such as those shown below:

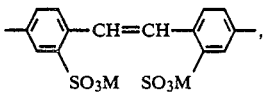

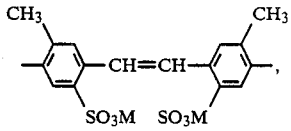

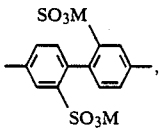

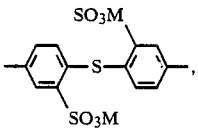

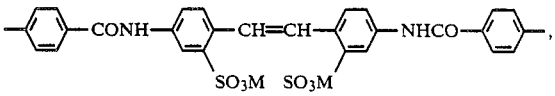

-continued
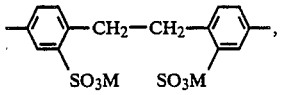
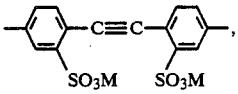
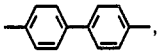
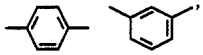
-continued
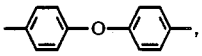
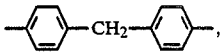
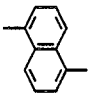
wherein M represents a hydrogen atom or a cation which contributes to the water solubility.
At least one of $R_{41}$, $R_{42}$, $R_{43}$, $R_{44}$ and $A_{41}$ in the above general formula IV contains a sulfo group.
The most preferred compounds of the general formula IV are stilbene derivatives.

XII-1
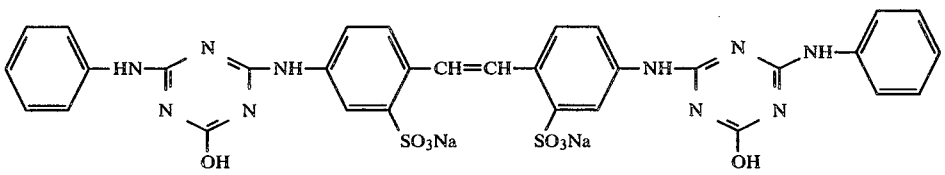
XII-2
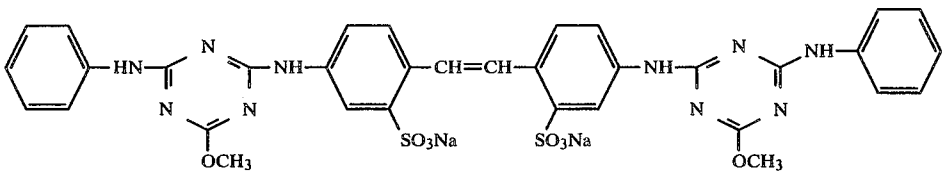
XII-3
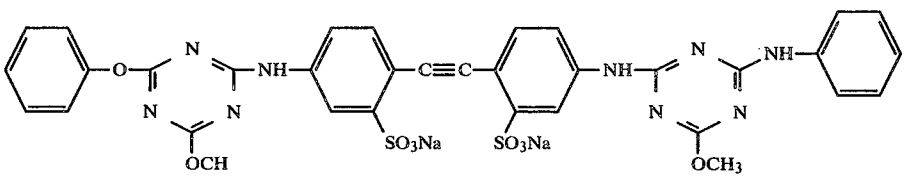
XII-4
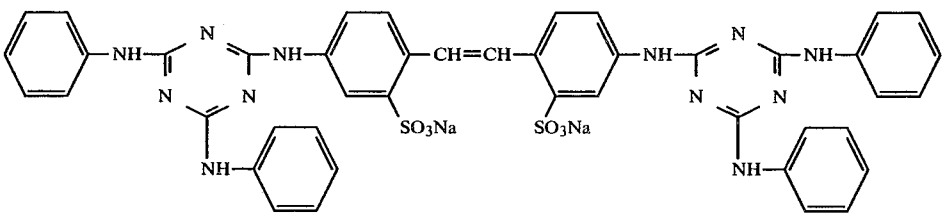
XII-5
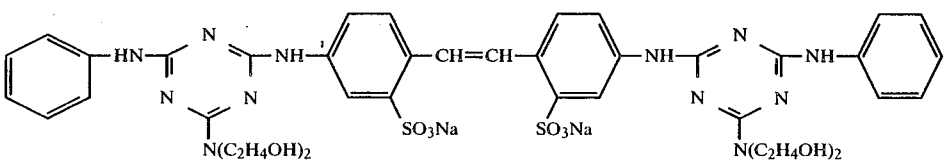

-continued
XII-6
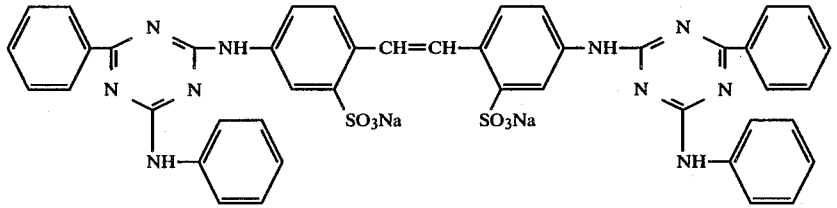
XII-7
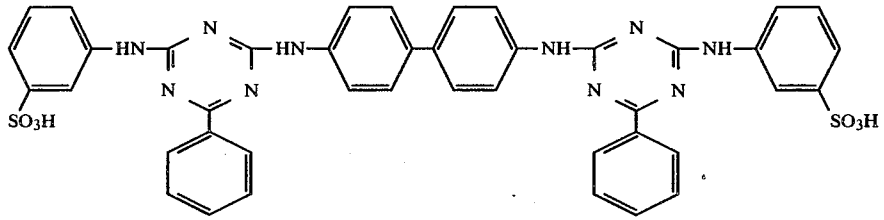
XII-8
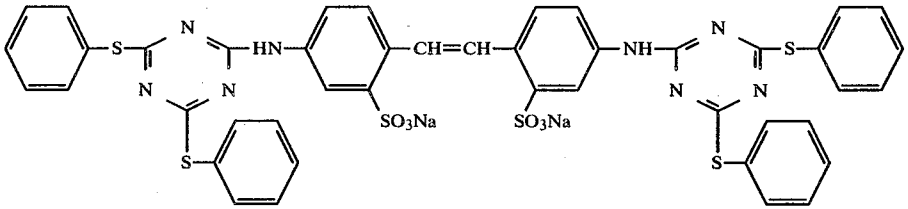
XII-9
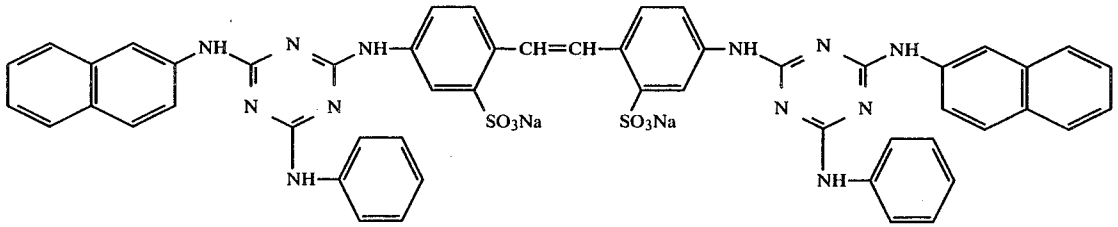

-continued
XII-10
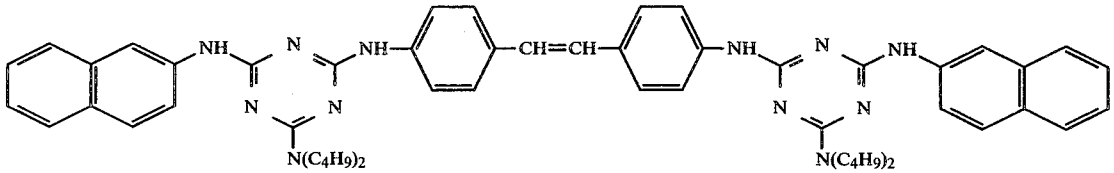
XII-11
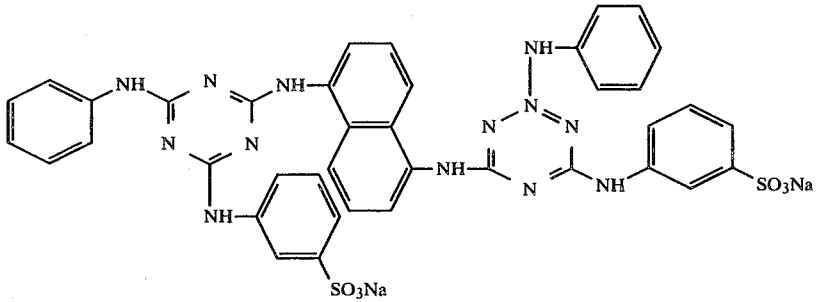
XII-12
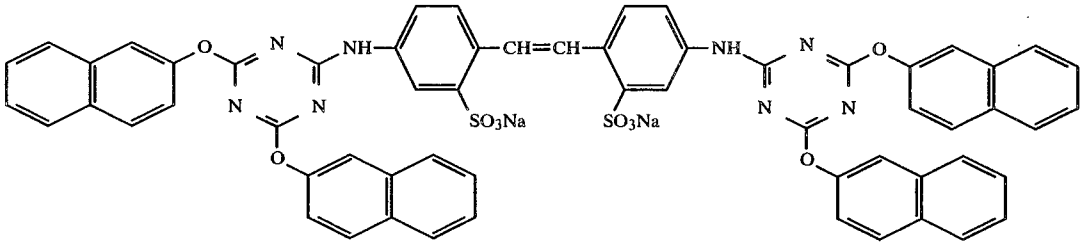
XII-13
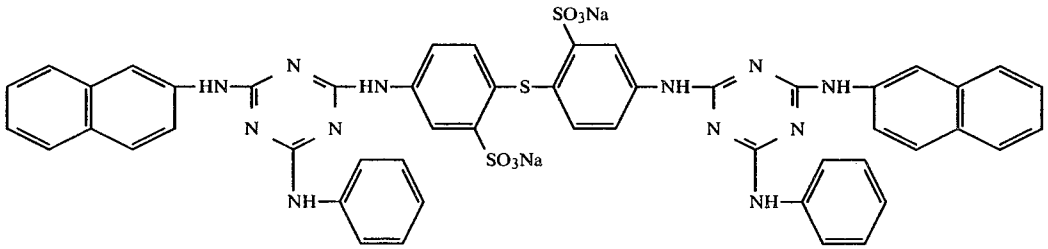

-continued
XII-14
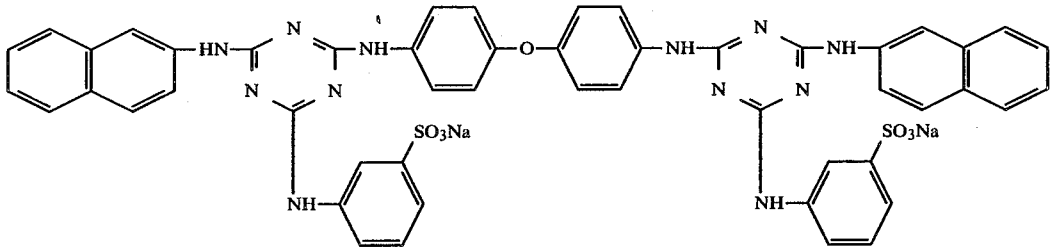
XII-15
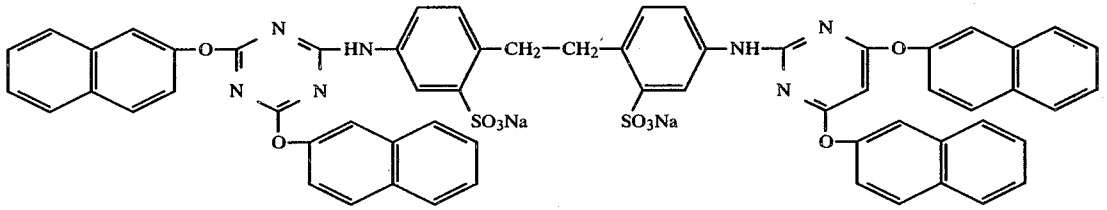
XII-16
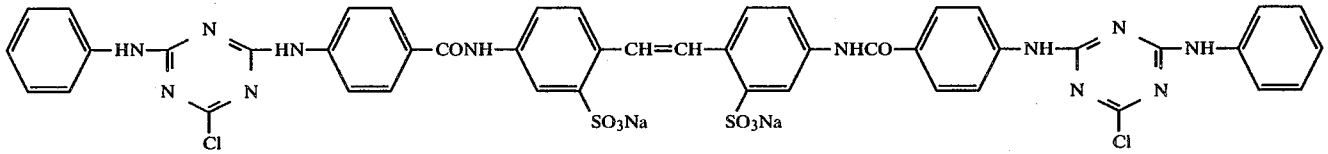
XII-17
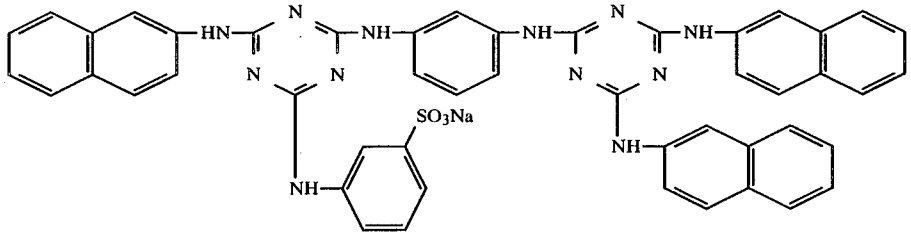

-continued
XII-18
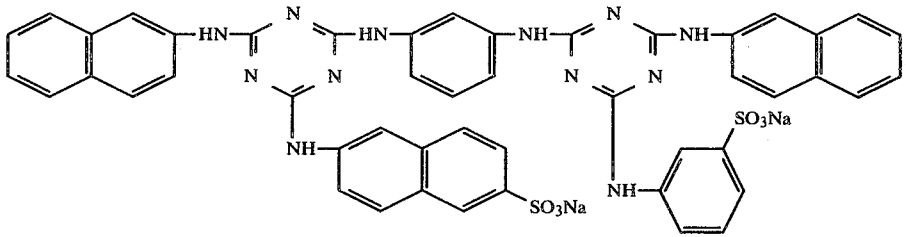
XII-19
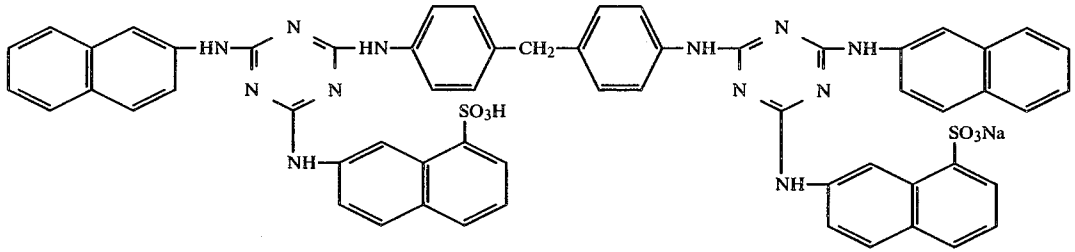
XII-20
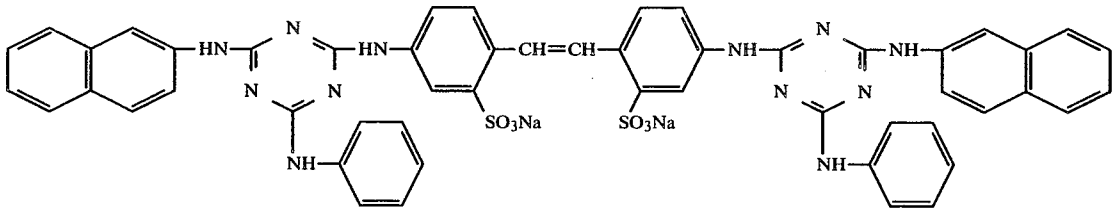
XII-21
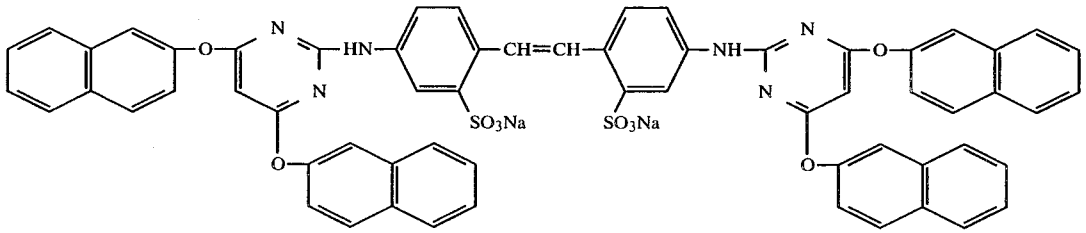

-continued
XII-22
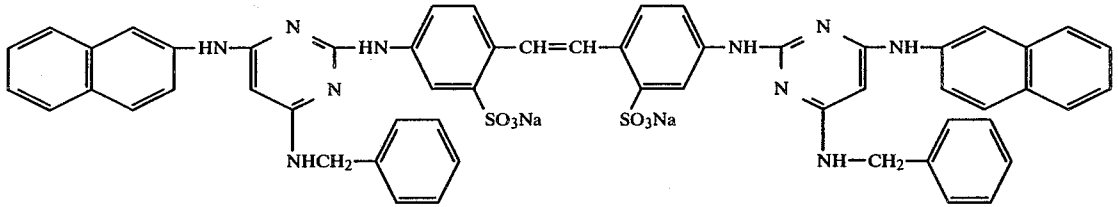
XII-23
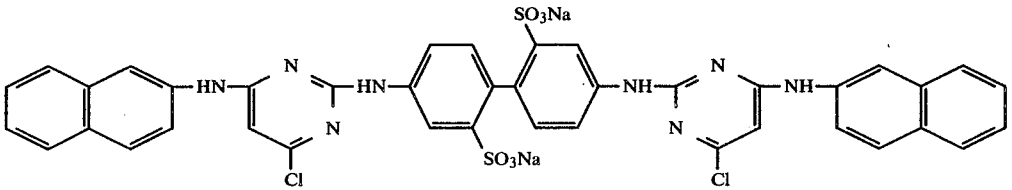
XII-24
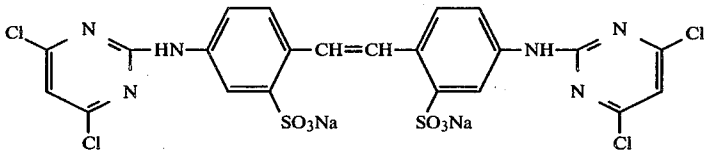

RL, GL and BL used in the present invention are arranged on the support in the following order: BL, GL, and RL; BL, RL and GL; or RL, GL and BL. A protective layer (PL) and an intermediate layer (ML) can be provided above or below each layer or between the layers, and an antihalation layer (HL) or yellow filter layer (YL) can be provided below the layers. The silver halide photosensitive layers can be divided into two or more layers such as a high-speed layer and low speed layer. The structure of the layers may be the same as that of a printing photosensitive material comprising an ordinary film or photographic printing paper as the support.

A finely pulverized organic or inorganic white pigment which contributes to the primary diffuse reflection can be incorporated in at least one of the prime layer and the layers formed thereon in an amount of as small as only 1 g/m$^2$ or less or preferably 0.5 g/m$^2$ or less. When the pigment is used in a larger amount, the excellent properties of the color image, particularly sharpness, are damaged.

The silver halide grains used in the present invention can be provided by any of acid process, neutral process or ammonia process or a combination of them. For example, the silver halide grains can be prepared by preparing nuclei by the acid process and growing them by the ammonia process. The growing process is preferably conducted by introducing only given amounts of silver ion and a halogen ion while the pH and pAg are controlled. The gain diameter is in the range of 0.05 to 1μ, preferably 0.2 to 0.8μ. The system may be either monodisperse or polydisperse system.

The silver halide may be any of pure silver chloride, silver chlorobromide, silver bromide or silver bromoiodide. The silver halide may have any of crystal habits. The silver halide can be sensitized with an active gelatin or chemically sensitized with a chemical sensitizer such as allyl thiocarbamide, cystine or a thiosulfate; a reducing sensitizer such as a polyamine or stannous chloride; a noble metal sensitizer; or a rhodium or iridium complex salt.

An antifoggant selected from the group consisting of mercaptotriazoles, mercaptotetrazles and benzotriazoles can be incorporated in the silver halide emulsion layers.

To conduct the development rapidly, it is preferred to use a silver chlorobromide emulsion or silver chloride emulsion in combination with an antifoggant or stabilizer capable of firmly adsorbing on the silver halide grains such as a mercapto compound, nitrobenzothiazole compound or benzotriazole compound. Ordinary additives such as a development accelerator, halation-preventing agent, irradiation-preventing agent or fluorescent brightener may also be used.

The fluorescent brightener is preferably dispersed in special layers, particularly prime layer, intermediate layer and protective layer.

Usually, a fluorescent brightener is added to a developer before dyeing. However, the stable dyeing is impossible in some cases. Further, a high storage stability of the fluorescent brightener cannot be provided by this method and the removal of dyeing substances contributes to the brightness frequently rather than the brightening effect of the brightener.

The fluorescent brighteners usable in the present invention are compounds described in Japanese Patent Public Disclosure No. 60-154251. They are soluble in organic solvents and dispersible by emulsion dispersion, polymer dispersion or coupler dispersion and, therefore, they can be incorporated in special layers of the photosensitive material in an advantageous manner. Compounds of the following general formulae (XIII), (XIV), (XV) and (XVI) are preferred:

general formula

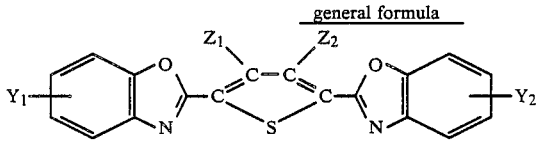

(XIII)

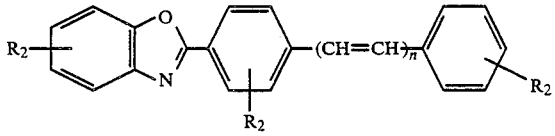

(XIV)

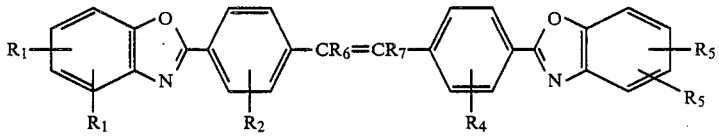

(XV)

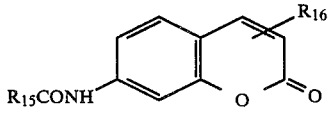

(XVI)

wherein $Y_1$ and $Y_2$ each represent an alkyl group, $Z_1$ and $Z_2$ each represent H or an alkyl group, n represents 1 or 2, $R_1$, $R_2$, $R_4$ and $R_5$ each represent H or an aryl group, alkyl group, alkoxy group,, aryloxy group, hydroxyl group, amino group, cyano group, carboxyl group, amido group, ester group, alkylcarbonyl group, alkylsulfo group or dialkylsulfonyl group, $R_6$ and $R_7$ each represent H, an alkyl group such as methyl or ethyl group or cyano group, $R_{16}$ represents a phenyl group, halogen atom or alkyl-substituted phenyl group and $R_{15}$ represents an amino group or organic primary or secondary amine group.

Examples of these compounds are as follows:

F-1

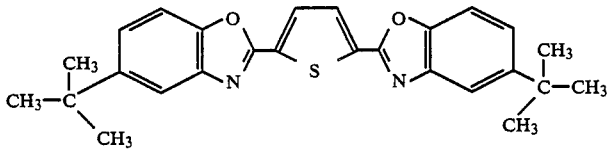

F-2

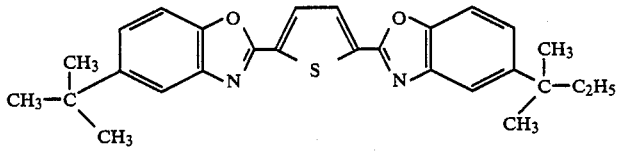

F-3

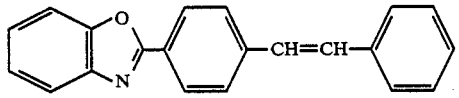

F-4

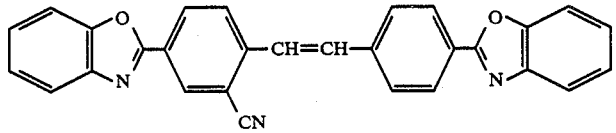

F-5

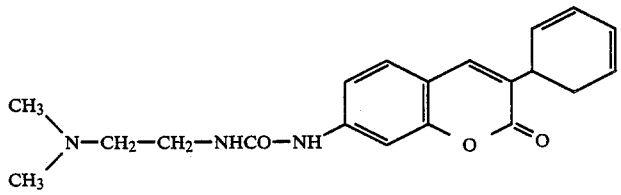

F-6

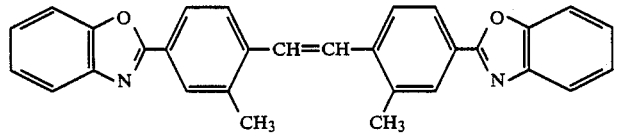

F-7

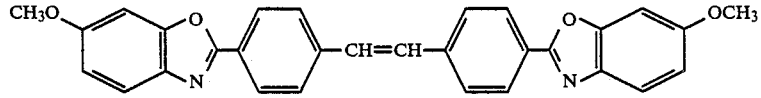

The water-soluble fluorescent brightener is dissolved in a high-boiling organic solvent like a color coupler and the solution is dispersed in a hydrophilic colloid in the presence of a surfactant. This method and the organic solvents are described in, for example, British Pat. No. 1,072,915, Japanese Patent Public Disclosure No. 60-134232, Japanese Patent Publication No. 51-30463, Japanese Patent Public Disclosure Nos. 53-1520 and 55-25057, Japanese Patent Publication No. 45-37376 and U.S. Pat. No. 3,416,933.

The fluorescent brightener can be used also by dissolving it in a low-boiling organic solvent such as acetone, methyl ethyl ketone or methanol and mixing the solution with a prime coating solution such as an ionomer solution. Further, a dispersion of the fluorescent brightener can be mixed in an emulsion for forming a given layer. The brightener is used usually in an amount of 3 to 200 mg/m$^2$. In another method, a polymer is prepared by an ionomer polyaddition wherein the fluorescent brightener is used in place of a hydrophobic substance or color coupler as described in Japanese Patent Public Disclosure No. 57-87429 or by mixing it with a condensation product and the polymer is used for forming the prime layer.

A fluorescent brightener selected from usual stilbene derivatives and diphenyl derivatives can be used in combination with a polyvinylpyrrolidone, polyvinyl acetate or a polymer comprising the following recurring units to fix the brightener and also to form a layer having a high fluorescence as described in Japanese Patent Publication No. 34-7127, Public Disclosure No. 53-147885 and Publication No. 60-21372:

general formula

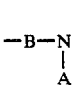

(XVII)

wherein A represents —$COR_1$, —$COOR_2$, $CONHR_3$, —$CONHCOR_4$ or —$SO_2R_5$, $R_1$, $R_2$, $R_3$, $R_4$ and $R_5$ each being H or a substituted or unsubstituted alkyl group, aryl group or cycloalkyl group.

Examples of the compounds are as follows:

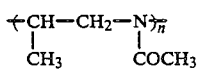

P-1 n = 50

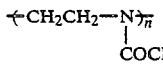

P-2 n = 200

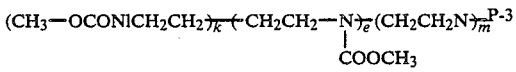

P-3 k:l:m = 23:50:27

Examples of the fluorescent brighteners usable herein are as follows:

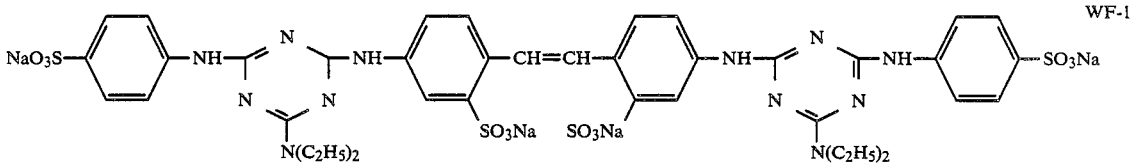

WF-1

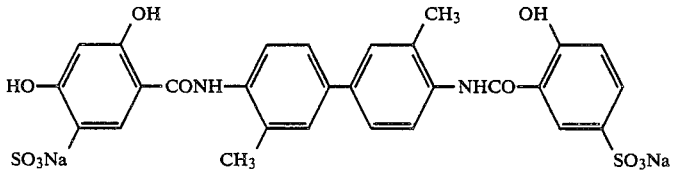

WF-2

For example, 0.1 g of WF-1 is dissolved in 100 ml of water to obtain a solution, to which 0.25 g of P-1 polymer is added to obtain a dispersion to be added to the protective layer or prime layer in such a manner that the amount of WF-1 will be 50 mg/m$^2$.

(Fluorescent brightener 2)

The brightening effect of the fluorescent brightener is exhibited in only highlights of an image but not in the image-forming regions. Usually, in color photographic materials, an ultraviolet absorber is contained in a surface layer or image-forming layers and, therefore, the effect of the fluorescent brightener contained in a layer near the support is weakened. It is preferred, therefore, that a compound having the fluorescent brightening effect is contained in the surface layer, particularly in only the highlights. In the present invention, a fluorescent brightener capable of reacting with an oxidation product of a developing agent to release a residue having a fluorescent brightening effect into the developer may be incorporated in a photosensitive layer containing a silver halide or a intermediate layer adjacent thereto.

The fluorescent brighteners are compounds of the following general formula (XVIII):

$$A-(L)_a-Fl$$

wherein Fl represents a fluorescent brightening compound residue, L represents a bonding group, a represents 1 or 2 and A represents a residue of a compound capable of exchange-reacting with an oxidation product of a developing agent to release Fl such as a color coupler residue, colorless compound-forming coupler residue or hydroquinone residue.

Examples of them include those described in Japanese Patent Public Disclosure No. 52-109927, British Pat. No. 945,542 and West German Public Disclosure No. 1800420.

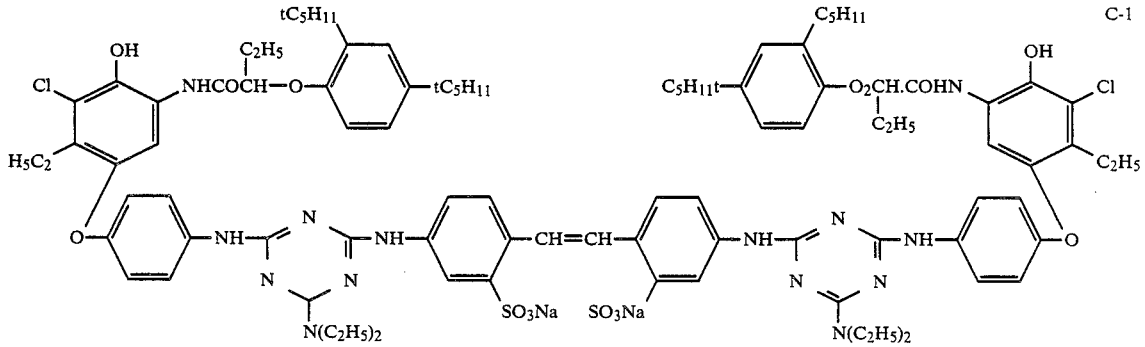

C-1

-continued

C-2

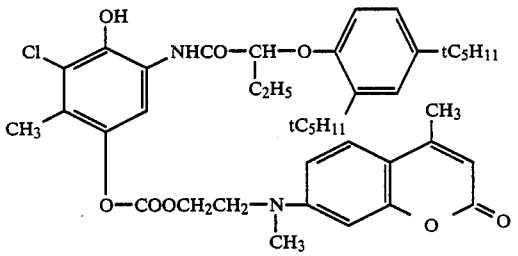

C-3

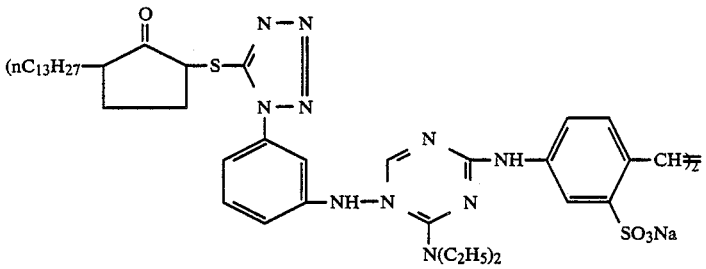

C-4

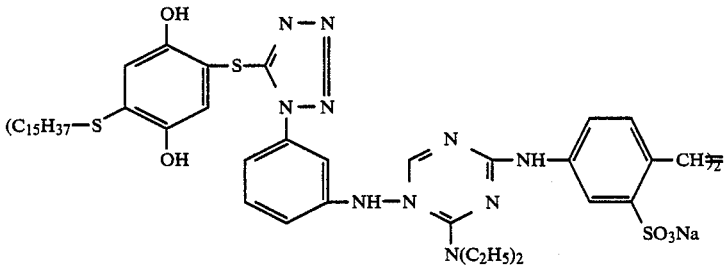

The compound is dissolved in a high-boiling organic solvent like the color coupler, the solution is dispersed in a hydrophilic colloid in the presence of a surfactant and the obtained dispersion is incorporated in a photosensitive layer, particularly a photosensitive surface layer containing a photosensitive silver halide or an intermediate layer or protective layer adjacent thereto. In another method, the compound is dispersed in a water-insoluble, organic solvent-soluble polymer such as polyvinyl alcohol, polyvinyl acetate, polyacrylic ester or copolymer or in the above-mentioned polymer or latex in which the fluorescent brightener is dispersible. By using the above-mentioned compound, only the highlights of the images can be brightened relatively selectively.

The color photosensitive materials of the present invention can be used as all sorts of color photographic reflective materials, particularly photosensitive materials for color printing papers, color reversal printing papers and direct positive color printing papers as well as photosensitive materials for color copies according to photofogging process.

(Color development process)

A color developer usable in the developing process of the photosensitive material of the present invention is preferably an alkaline aqueous solution containing an aromatic primary amine color developing agent as a main component. The color developing agents are aminophenol compounds, and particularly preferably p-phenylenediamine compounds. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides and p-toluenesulfonates. These diamines in the form of their salts are generally more stable than those in the free form, and the former is preferable to the latter.

The color developer contains usually a pH buffering agent such as an alkali metal carbonate, borate or phosphate; a development inhibitor such as a bromide, iodide, benzimidazole, benzothiazole or mercapto compound; and an antifoggant. The color developer may contain further, if necessary, a preservative such as a hydroxyamine or sulfite; an organic solvent such as triethanolamine or diethylene glycol; a development accelerator such as benzyl alcohol, polyethylene glycol, a quaternary ammonium salt or an amine; a dye-producing coupler; a competing coupler; a nucleating agent such as sodium boron hydride; an assistant developer such as 1-phenyl-3-pyrazolidone; a thickening agent; a chelating agent such as an aminopolycarboxylic acid, an aminopolyphosphonic acid, an alkylphosphonic acid or a phosphonocarboxylic acid; and an antioxidant as described in West German Patent Application (OLS) No. 2,622,950.

In the development process for a reversal color photosensitive material, a black-and-white development is conducted before the color development. The black-and-white developer contains a known black-and-white developing agent, for example, a dihydroxybenzene such as hydroquinone, a 3-pyrazolidone such as 1-phenyl-3-pyrazolidone, or an aminophenol such as N-methyl-p-aminophenol. The black-and-white developing agent can be used either singly or as a combination of them.

The photographic emulsion layers are usually bleached after the color development. The bleaching process may be conducted either simultaneously with the fixing treatment or separately from the fixing treatment. The bleaching agents usable herein include, for example, compounds of polyvalent metals such as iron (III), cobalt (III), chromium (VI) and copper (II), peracids, quinones and nitron compounds. Typical examples of the bleaching agents include ferricyanides; dichromates; organic complex salts of iron (III) or cobalt (III) such as complex salts of them with aminopolycarboxylic acids such as ethylenediaminetetraacetic acid, diethylenetriaminepentaacetic acid, nitrilotriacetic acid and 1,3-diamino-2-propanoltetraacetic acid, and organic acids such as citric acid, tartaric acid and malic acid; persulfates; manganates; and nitrosophenol. Among them, iron (III) ethylenediaminetetraacetate and persulfates are preferred from the viewpoints of rapid process and environmental pollution prevention. Iron (III) ethylenediaminetetraacetate is particularly useful in both of independent bleaching bath and combined bleach-fixing bath.

The bleaching solution and bleach-fixing bath can contain, if necessary, a bleaching accelerator. Examples of the usable bleaching accelerators include bromine ion and iodine ion; thiourea compounds described in U.S. Pat. No. 3,706,561, Japanese Patent Publication Nos. 45-8506 and 49-26586 and Japanese Patent Public Disclosure Nos. 53-32735, 53-36233 and 53-37016; thiol compounds described in Japanese Patent Public Disclosure Nos. 53-124424, 53-95631, 53-57831, 53-32736, 53-65732 and 54-52534 and U.S. Pat. No. 3,893,858; heterocyclic compounds described in Japanese Patent Public Disclosure Nos. 49-59644, 50-140129, 53-28426, 53-141623, 53-104232 and 54-35727; thioether compounds described in Japanese Patent Public Disclosure Nos. 52-20832, 55-25064 and 55-26506; tertiary amines described in Japanese Patent Public Disclosure No. 48-84440; and thiocarbamoyls described in Japanese Patent Public Disclosure No. 49-42349. They can be used either singly or as a combination of two or more of them. Among them, bromine ion, iodine ion, thiol compounds and disulfide compounds are preferred bleaching accelerators. The bleaching accelerating agents are particularly effective in the bleach-fix of the color photosensitive materials.

Examples of the fixing agents include thiosulfates, thiocyanates, thioethers, thioureas and a large amount of iodides. Among them, the thiosulfates are usually used. Sulfites, bisulfites and carbonyl/bisulfite adducts are preferred as the preservative for a bleach-fixing solution or fixing solution.

After completion of the bleach-fixing process or fixing process, usually the product is washed with water. Various known additives can be used in order to prevent the precipitation or to save water in the washing step. The additives usable herein include water softeners for preventing the precipitation such as inorganic phosphoric acids, aminopolycarboxylic acids and organic phosphoric acids; germicides and antifungal agents which inhibit the growth of bacteria, algae and molds; hardeners such as magnesium salts and aluminum salts; and sarfactants used for preventing drying load or drying mark. These additives can be used if necessary. In addition, the compounds described in L. E. West, Phot. Sci. Eng., Vol. 6, pp. 344 to 359 (1965) can also be used as additives. Particularly, the addition of chelating agents and antifungal agents are effective.

In the step of water washing, two or more tanks are used to provide a countercurrent system so as to save water. The step of water washing can be replaced by the multistep countercurret stabilization step as described in Japanese Patent Public Disclosure No. 57-8543. In such a case, 2 to 9 countercurrent baths are necessary. Various compounds are added to the stabilization bath in order to stabilize the image, in addition to the above-mentioned additives. Concrete examples of the compounds include buffering agents for controlling the pH of the film at, for example, 3 to 9 (such as suitable combinations of borates, metaborates, borax, phosphates, carbonates, potassium hydroxide, sodium hydroxide, aqueous ammonia, monocarboxylic acids, dicarboxylic acids and polycarboxylic acids) and formalin. If necessary, other additives can also be used. The additives are, for example, water softeners (such a inorganic phosphoric acid, aminopolycarboxylic acids, organic phosphoric acids, aminopolyphosphonic acids and phosphonocarboxylic acids), germicides (such as benzoisothiazolinone, isothiazolone, 4-thiazolinebenzimidazole and halogenated phenols) surfactants, fluorescent brightening agents and hardeners. They can be used either singly or as a combination of two or more of them having the same or different effects.

It is preferred to add various ammonium salts such as ammonium chloride, ammonium nitrate, ammonium sulfate, ammonium phosphate, ammonium sulfate and ammonium thiosulfate as a pH adjustor, after the processing.

The silver halide color photosensitive material of the present invention may contain a color developing agent in order to simplify and to accelerate the processing. In such a case, precursors of the color developing agents are preferably used. Examples of the procursors include indoaniline compounds described in U.S. Pat. No. 3,342,597, Schiff base-type compounds described in U.S. Pat. No. 3,342,599, Research Disclosure Nos. 14850 and 15159, aldol compounds described in Research Disclosure No. 13924, metal complex salts described in U.S. Pat. No. 3,719,492, urethane compounds described in Japanese Patent Public Disclosure No. 53-135628 and various salts described in Japanese Patent Public Disclosure Nos. 56-6235, 56-16133, 56-59232, 56-67842, 56-83734, 56-83735, 56-83736, 56-89735, 56-81837, 56-54430, 56-106241, 56-107236, 57-97531 and 57-83565.

The silver halide color photosensitive material of the present invention may contain, if necessary, a 1-phenyl-3-pyrazolidone in order to accelerate the color development. Typical examples of the 1-phenyl-3-pyrazolidones include those described in Japanese Patent Public Disclosure Nos. 56-64339, 57-144547, 57-211147, 58-50532, 58-50536, 58-50533, 58-50534, 58-50535 and 58-115438.

The processing solutions are used at a temperature of 10° to 50° C. in the present invention. Although the standard temperature is 33° to 38° C., a higher temperature can be employed to accelerate the processing or to reduce the processing time, and a lower temperature can be employed to improve the image quality or the stability of the processing solution. The process described in West German Pat. No. 2,226,770 or U.S. Pat. No. 3,674,499 wherein a cobalt intensifier or hydrogen peroxide intensifier is used for saving silver in the photosensitive material, can also be employed.

The processing baths may have, if necessary, a heater, temperature sensor, liquid level sensor, circulating pump, filter, floating lid, squeegee, etc.

The following examples will further illustrate the present invention, which by no means limit the invention.

EXAMPLE 1

Metallic aluminum was roughly rolled. The aluminum sheets were then rolled in an apparatus comprising a central roller and two rollers arranged above and below the central one each in contact with the central one. In this step, two sheets of annealed metallic aluminum were put together and passed between the upper roller and the central roller and then between the central one and the lower one to prepare aluminum foils having a thickness of about 10μ. Surprisingly, the surfaces of the foils contacted with each other had the secondary diffuse-reflection properties. A photographic white base paper was extrusion-coated with a low-density polyethylene and simultaneously laminated with metallic aluminum. Then the other surface of the support was subjected to a corona discharge and extrusion-coated with the high-density polyethylene to form a polyethylene layer having a thickness of 30μ. A thin layer or an ionomer resin was formed on the aluminum surface to prepare Support Sample 1.

Separately, a polyethylene phthalate film having a thickness of 100μ was placed in a vacuum deposition apparatus R and aluminum was vacuum-deposited thereon in vacuum ($10^{-5}$ Torr) to form an aluminum film having a thickness of 1000 Å according to a process shown in Example 1 of Japanese Patent Application No. 60-52788. The film was then coated wih a low-density polyethylene to form a polyethylene layer having a thickness of 30μ. The product will be referred to as Comparative Sample a.

The Sample 1 (support of the present invention) was superior to the Comparative Sample a, in that the former was free of the reflection of light and had a metallic brightness and a wide visual angle of observation. The thickness of the Sample 1 and the Comparative Sample a were about 120μ.

EXAMPLE 2

The Support Sample 1 prepared in Example 1 was used. The aluminum foil-having surface of the Sample 1 was subjected to the corona discharge. A priming layer was formed by using gelatin and sodium 1-hydroxy-3,5-dichloro-S-triazine (hardener). A silver chlorobromide emulsion layer (halogen composition: 67% AgCl, average grain diameter: 0.4μ) as in ordinary photographic paper was formed thereon and further a protective layer was formed thereon. The amount of silver applied was 2.1 g/m$^2$. After image exposure followed by the development with a developer D-72 (1:2 dilution) and fixing, it was washed with water. On the other hand, a Resin-coated paper sample b (a support prepared by extrusion-coating a surface of a white base paper with polyethylene whitened by mixing titanium oxide therein to impart the primary diffuse-reflecting properties and extrusion-coating the other surface thereof with polyethylene) usually used as a photographic paper was processed in the same manner as above. After the image exposure followed by development, fixing and water washing, an image was obtained. The image formed on the Support sample 1 was superior to that formed on the Comparative support sample b in the brightness in the highlights, gradation in shadows and sharpness. Surprisingly, the maximum density and the saturation of the shadows in the image formed on the Support sample 1 were not inferior to those of the comparative one.

EXAMPLE 3

Reversal color photographic papers were prepared by using the Support sample 1 and Comparative samples a and b according to a process shown in Example 1 of Japanese Patent Application No. 61-99122.

After image exposure, an usual reversal development was conducted which comprised the first development, water washing, reversal exposure, color development, water washing, bleach-fixing and water-washing to obtain an image.

The Sample 1 of the present invention was far superior to the Comparative sample b in saturation and sharpness and, in addition, the former was also superior to the Comparative sample a in that no light was reflected and the visual angle of observation was widened. In particular, when the support of the present invention was used, the gradation in the shadows which had been considered to be a defect of ordinary reversal color photograpic papers was improved and the quite excellent image having a high texture could be obtained because microscopically a hard gradation was provided due to an improved sharpness, while macroscopically the image had a soft tone.

EXAMPLE 4

The Support sample 1 was subjected to corona discharge process and then a priming layer was formed thereon by using gelatin and sodium 1-hydroxy-3,5-dichloro-S-triazine hardener.

Preparation of color emulsions

A core/outer shell-type internal emulsion B was prepared as follows:

Emulsion B 30 g of gelatin was dissolved in 1 l of a solution containing 0.5 mol of KBr, 0.2 mol of NaCl and 0.0015 mol of KI. 700 ml of 1 mol/l silver nitrate solution was added to the solution at 60° C. over 20 min. After physical ripening conducted for 20 min, the product was washed with water to remove water-soluble halides. 20 g of gelatin was added thereto and then water was added thereto to prepare 1200 ml of the mixture. The thus prepared silver halide emulsion had an average grain diameter of 0.4 μm. 500 ml of 1 mol/l aqueous silver nitrate solution and 500 ml of 2 mol/l aqueous sodium chloride solution were added simultaneously to 300 ml of the emulsion to precipitate silver chloride shells. After water washing, a silver halide emulsion B having an average grain diameter of 0.7 μm was obtained.

The first layer-forming emulsion 10 ml of ethyl acetate and 4 ml of solvent (c) were added to a mixture of 10 g of cyan coupler (a) and 2.3 g of color image stabilizer (b) to obtain a solution. The solution was emulsion-dispersed in 90 ml of 10% aqueous gelatin solution containing 5 ml of 10% sodium dodecylbenzenesulfonate. On the other hand, a red-sensitive dye shown below was added to the silver halide emulsion B (containing 70 g/kg of Ag) in an amount of $2.0\times10^{-4}$ mol per mol of the silver halide to prepare 90 g of a red-sensitive emulsion. The emulsion dispersion was mixed with the emuslion to prepare a solution. The concentration of the solution was controlled with gelatin to prepare a composition shown in Table 1. A nucleating agent (compound 2) in an amount of $3\times10^{-4}$ mol per mol of Ag and a nucleating accelerator in an amount of $4.7\times10^{-4}$ mol per mol of Ag were added thereto to prepare the first layer-forming emulsion.

The emulsions for forming the second layer to the seventh layer were prepared in the same manner as in the preparation of the first layer-forming emulsion. Sodium 1-hydroxy-3,5-dichloro-S-triazine was used as the hardener in the respective layers.

TABLE 1

| Layer | Main components | Amount |
|---|---|---|
| The seventh layer (protective layer) | gelatin | 1.33 g/m$^2$ |
| | acrylic copolymer of polyvinyl alcohol (degree of modification: 17%) | 0.17 g/m$^2$ |
| The sixth layer (U.V. absorbing layer) | gelatin | 0.54 |
| | U.V. absorber (h) | $5.10\times10^{-4}$ mol/m$^2$ |
| | solvent (j) | 0.08 |
| The fifth layer (blue-sensitive layer) | emulsion B silver: | 0.40 g/m$^2$ |
| | gelatin | 1.35 g/m$^2$ |
| | yellow coupler (k) | $6.91\times10^{-4}$ mol/m$^2$ |
| | color image stabilizer (1) | 0.13 g/m$^2$ |

TABLE 1-continued

| Layer | Main components | Amount |
|---|---|---|
| | solvent (m) | 0.02 g/m$^2$ |
| The fourth layer (U.V. absorbing layer) | gelatin | 1.60 g/m$^2$ |
| | colloidal silver | 0.10 g/m$^2$ |
| | U.V. absorber (h) | $1.70\times10^{-4}$ mol/m$^2$ |
| | color mixing inhibitor (i) | $1.60\times10^{-4}$ mol/m$^2$ |
| | solvent (j) | 0.24 g/m$^2$ |
| The third layer (green-sensitive layer) | emulsion B silver: | 10.39 g/m$^2$ |
| | gelatin | |
| | magenta coupler (e) | $4.60\times10^{-4}$ mol/m$^2$ |
| | color image stabilizer (f) | 0.14 g/m$^2$ |
| | solvent (g) | 0.42 g/m$^2$ |
| The second layer (color mixing-inhibiting layer) | gelatin | 0.90 g/m$^2$ |
| | color mixing inhibitor (d) | $2.33\times10^{-4}$ mol/m$^2$ |
| The first layer (red-sensitive layer) | emulsion B silver: | 0.39 g/m$^2$ |
| | gelatin | 0.90 g/m$^2$ |
| | cyan coupler (a) | $7.05\times10^{-4}$ mol/m$^2$ |
| | color image stabilizer (b) | $5.20\times10^{-4}$ mol/m$^2$ |
| | solvent (c) | 0.22 g/m$^2$ |

The spectral sensitizers contained in the respective emulsions were as follows:

sensitizing dye in blue-sensitive emulsion layer:

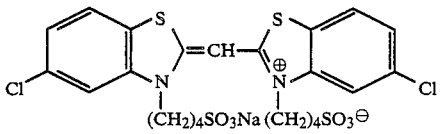

sensitizing dye in green-sensitive emulsion layer:

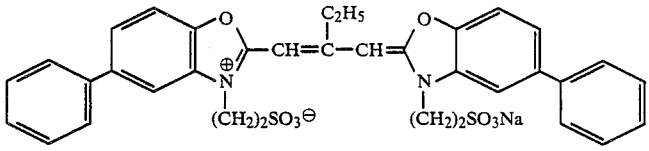

sensitizing dye in red-sensitive emulsion layer:

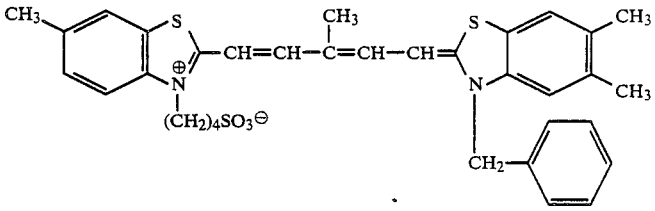

anti-irradiation dye in green-sensitive emulsion layer:

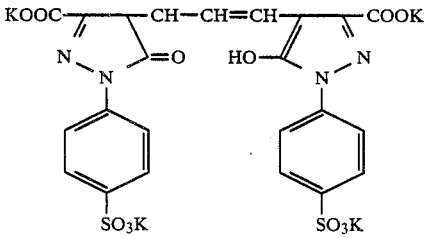

anti-irradiation dye in red-sensitive emulsion layer:
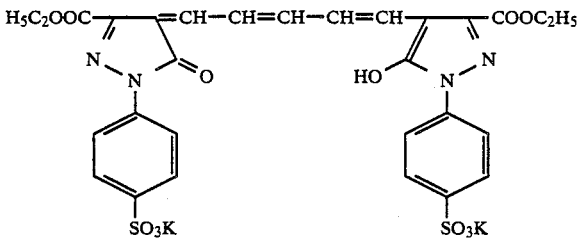
The structural formulae of the compounds used as the couplers etc. in the Example were as follows:
(a) cyan coupler
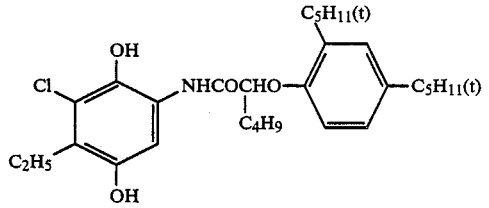
(b) color image stabilizer
a mixing of:
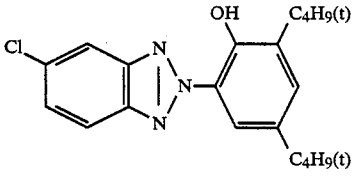
and
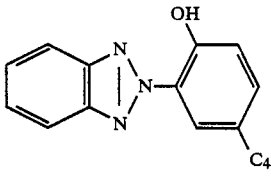
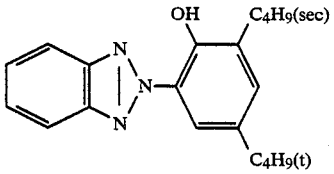
in a molar ratio of 1:3:3
(c) solvent
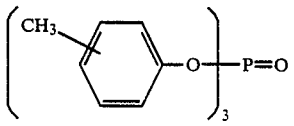
(d) color mixing inhibitor
-continued
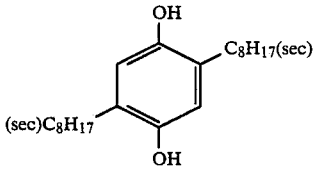
(e) magenta coupler
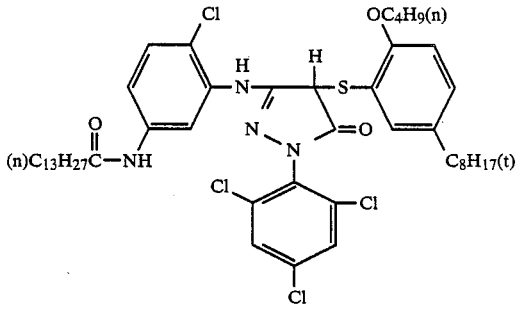
(f) a mixture of:
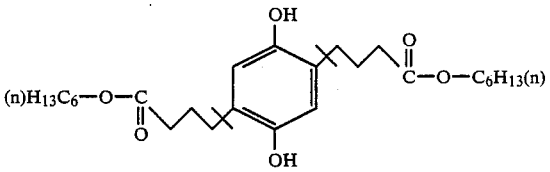
and
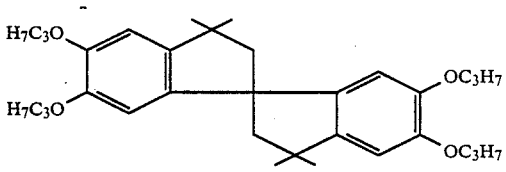
in a weight ratio of 1:1.5.
(Note)
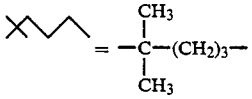
(g) a mixture of:
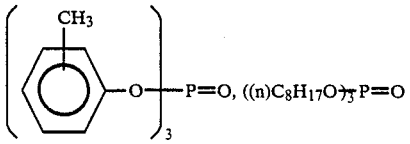
and -continued

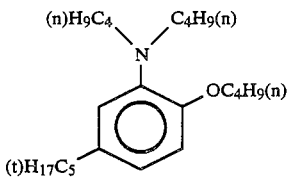

in a weight ratio of 1:2:2.

(h) U.V. absorber a mixture of:

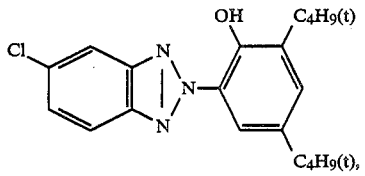

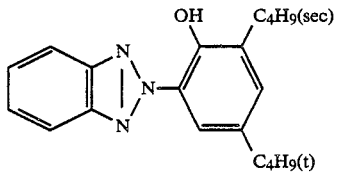

and

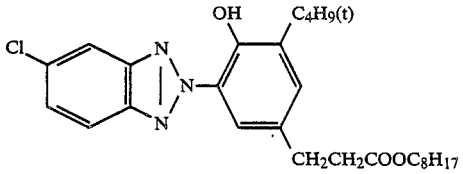

in a molar ratio of 1:5:3

(i) color mixing inhibitor

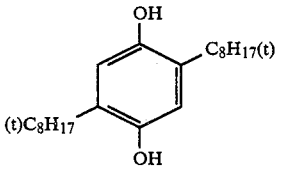

(j) solvent (iso $C_9H_{19}O\frac{}{3}P{=}O$ (k) yellow coupler

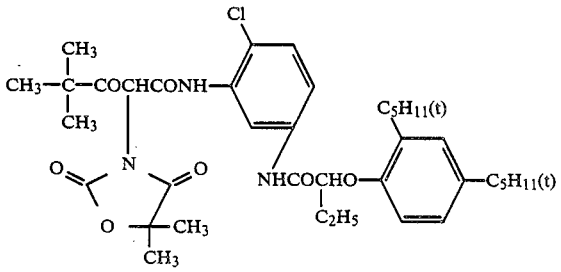

(l) color image stabilizer

-continued

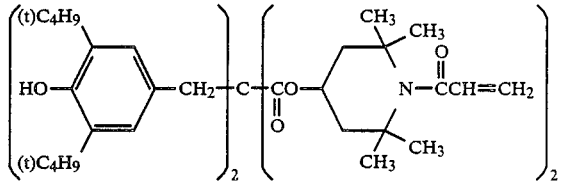

(m) solvent (iso $C_9H_{19}O\frac{}{3}P{=}O$ nucleating agent (compound-2)

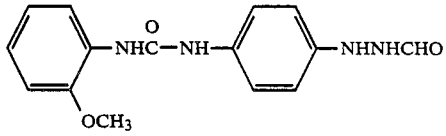

nucleating accelerator 10

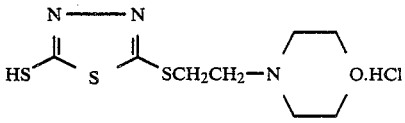

| Processing step A | Time | Temperature |
|---|---|---|
| color development | 3 min 30 sec | 33° C. |
| bleach-fixing | 40 sec | 38° C. |
| stabilization (1) | 20 sec | 38° C. |
| stabilization (2) | 20 sec | 38° C. |
| stabilization (3) | 20 sec | 38° C. |

The replenisher was fed according to a counter current system wherein the replenisher was fed into the stabilization bath (3), an overflow from the bath (3) is introduced in the stabilization bath (2) and an overflow from the bath (2) is introduced in the stabilization bath (1).

| (Color developer) | Mother liquor |
|---|---|
| diethylenetriaminepentaacetic acid | 2.0 g |
| benzyl alcohol | 12.8 g |
| diethylene glycol | 3.4 g |
| sodium sulfite | 2.0 g |
| sodium bromide | 0.26 g |
| hydroxylamine sulfate | 2.60 g |
| sodium chloride | 3.20 g |
| 3-methyl-4-amino-N—ethyl-N—(β-methanesulfonamidoethyl)aniline | 4.25 g |
| potassium carbonate | 30.0 g |
| fluorescent brightening agent (stilbene compound) | 1.0 g |
| water | ad 1000 ml |
| pH | 10.20 |

The pH was adjusted with potassium hydroxide or hydrochloric acid.

| (Bleach-fixing solution) | Mother liquor |
|---|---|
| ammonium thiosulfate | 110 g |
| sodium hydrogensulfite | 10 g |
| ammonium iron (III) diethylenetriaminepentaacetate monohydrate | 56 g |
| disodium ethylenediaminetetraacetate dihydrate | 5 g |
| water | ad 1000 ml |

-continued

| (Bleach-fixing solution) | Mother liquor |
|---|---|
| pH | 6.5 |

The pH was adjusted with aqueous ammonia or hydrochloric acid.

| (Stabilizer) | Mother liquor |
|---|---|
| 1-hydroxyethylidene-1,1'diphosphonic acid (60%) | 1.6 ml |
| bismuth chloride | 0.35 g |
| polyvinylpyrrolidone | 0.25 g |
| aqueous ammonia | 2.5 ml |
| 3Na.nitrilotriacetate | 1.0 g |
| 5-chloro-2-methyl-4-isothiazolin-3-one | 50 mg |
| 2-octyl-4-isothiazolin-3-one | 50 mg |
| fluorescent brightening agent (4,4'-diaminostilbene compound) | 1.0 g |
| water | as 1000 ml |
| pH | 7.5 |

The pH was adjusted with potassium hydroxide or hydrochloric acid.

A sample of comparative photosensitive material was prepared in the same manner as above except that the comparative support sample b was used.

The three samples prepared as above were subjected to the image exposure and developemnt process A.

As compared with the image of the comparative photosensitive sample, the image formed according to the present invention had a higher saturation, much more excellent sharpness and particularly improved gradation reproducibility in the shadows.

EXAMPLE 5

Support sample 2 was prepared in the same manner as in Example 1 except that the patterning of the cylinder was conducted suitably in the rolling step. Further, Support sample 3 was prepared by further reducing the patterning of the cylinder.

A color reversal photographic paper was prepared by using the Support sample 1 in the same manner as in Example 3. It was developed, omitting the exposure, to obtain a Sample 4.

Color Analyzer 307 (a product of Hitachi Ltd.) was used. Regular reflection from light source was eliminated by providing a trap of about 10° in the integrating sphere. The spectral reflectances of the Support Samples 1 to 4 and a were determined using a barium sulfate white plate as the standard. The results are shown in FIG. 1.

The spectral reflectances (550 nm) were as follows:

| Curve No. | Sample No. | | | Spectral reflectance (%) |
|---|---|---|---|---|
| A | Support sample 1 | Present invention | without priming layer (aluminum surface) | 76.5 |
| B | Support sample 2 | " | without priming layer | 28.0 |
| C | Support sample 2 | " | with priming layer | 28.0 |
| D | Support sample 3 | " | without priming layer | 16.0 |
| E | Support sample 4 | " | A priming layer and layers of color reversal photographic paper were formed on the Support sample 1. It was subjected to the development, omitting the exposure, and then bleach-fixed and water-washed. | 75.5 |
| F | Comparative sample a | comparative | | 1.0 |

EXAMPLE 6

Figure 2:
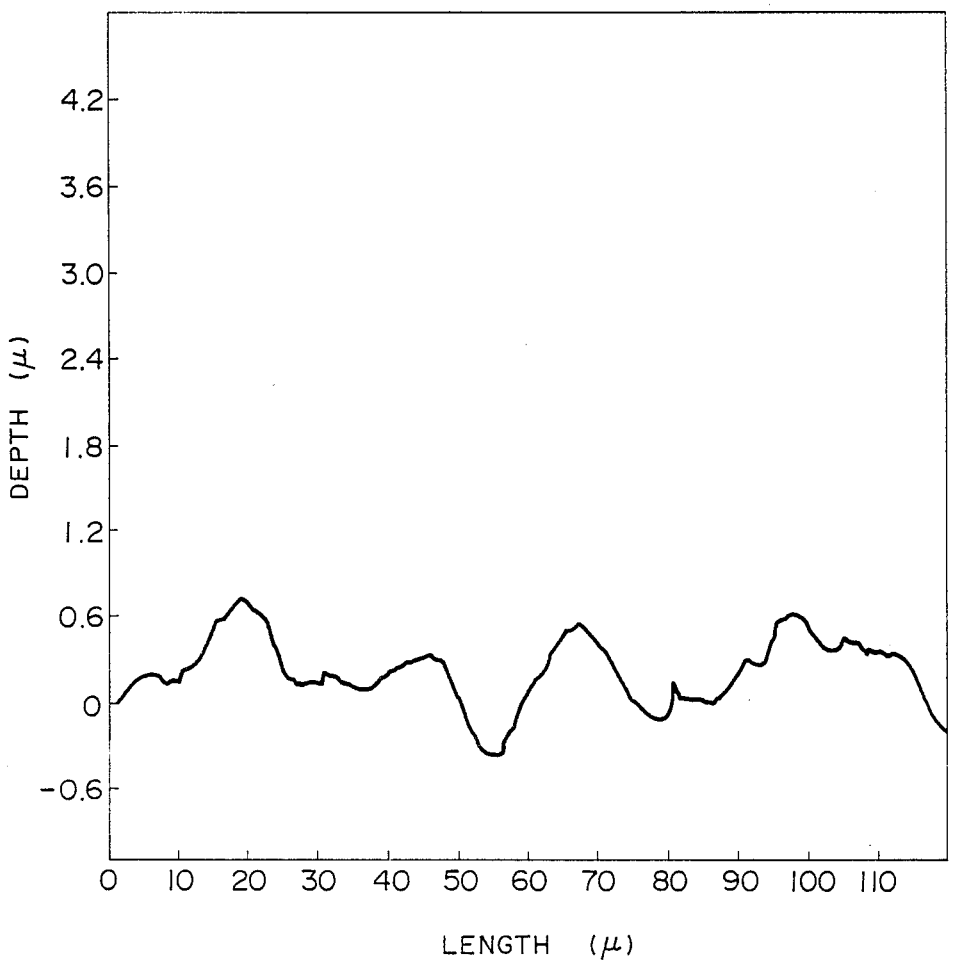
FIGS. 2 to 4 show the results of the examination of the sectional shapes.
Figure 3:
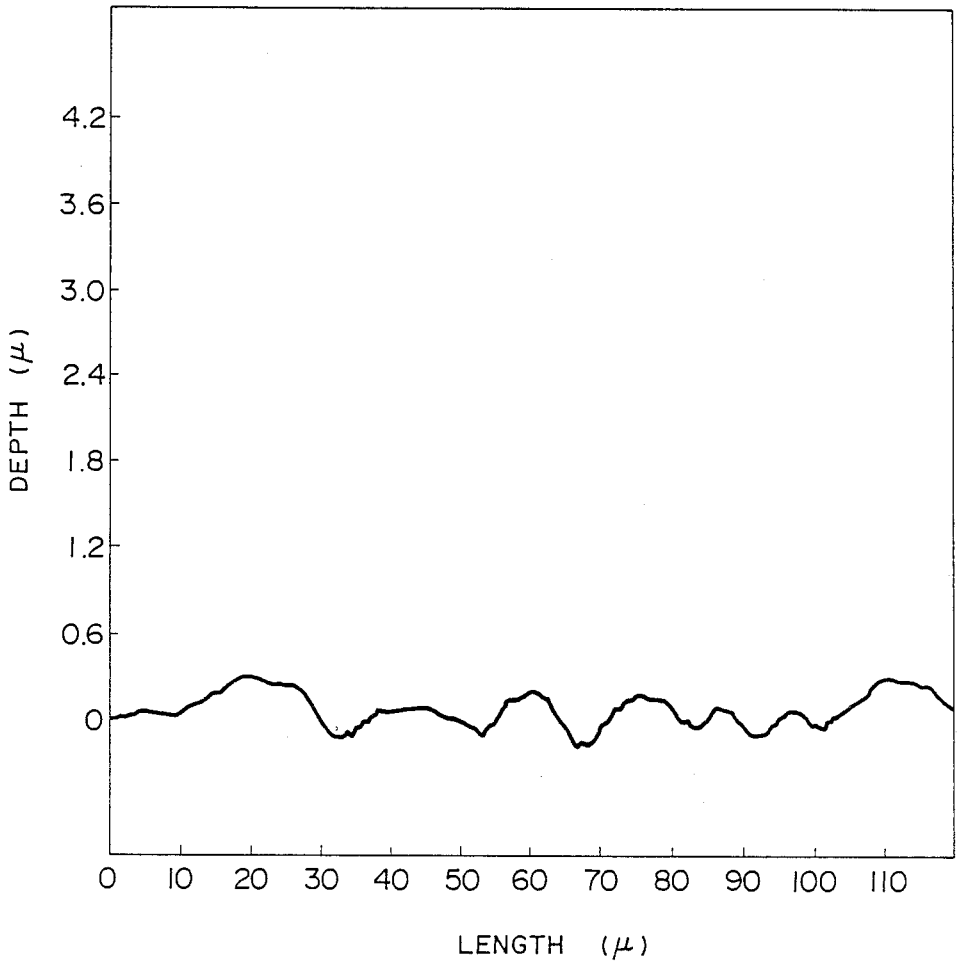
Figure 4:
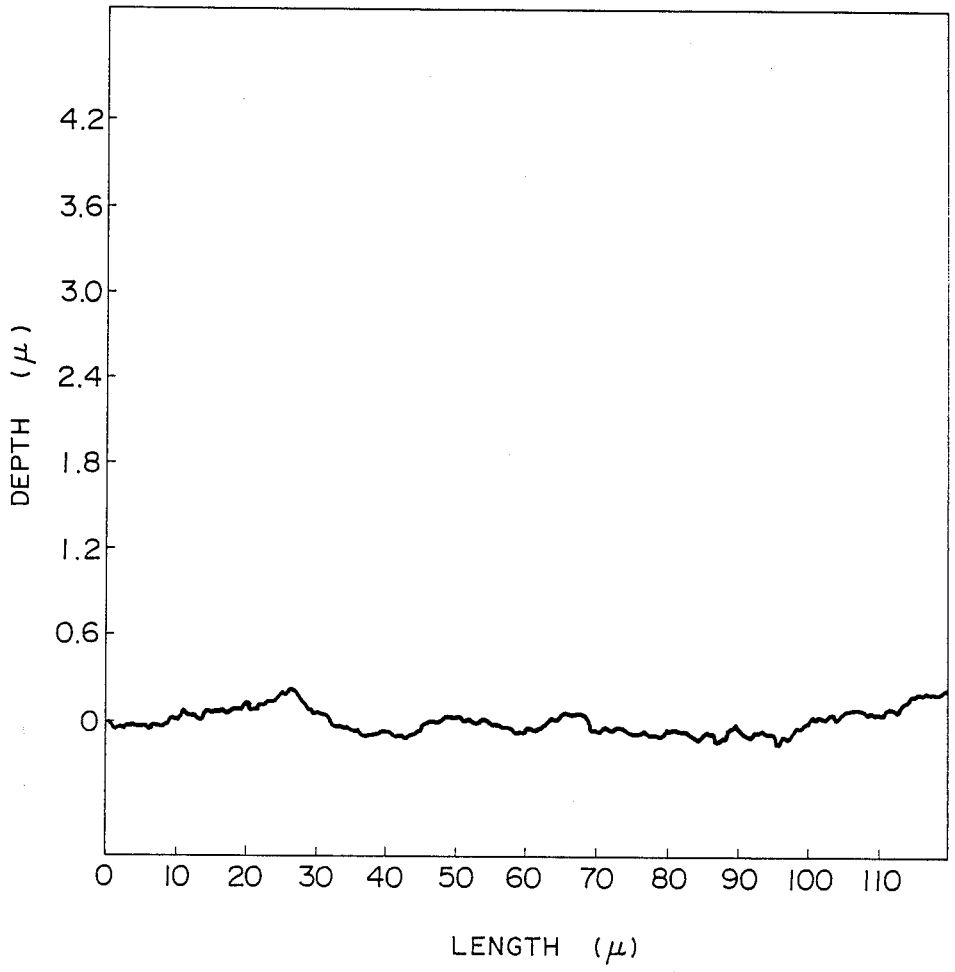

The unevennesses on the surfaces of the Support samples 1, 2 and 3 (having no priming layer) were determined with a device of measuring the sectional shape (Elionix Co., Ltd.) with a precision of up to 0.1μ. The results are shown in FIGS. 2, 3 and 4. The number of the unevennesses (frequency) was 100 ±50/mm (Support sample 1), 180 ±50/mm (Support sample 2) and 600 ±100/mm (Support sample 3).

EXAMPLE 7

A development photosensitive material having the layer structures as shown in Table 2 was prepared. The preparation methods of emulsions (I), (VI) and (VII) and organic silver salts (1) and (2) will be shown below. Then, a mordant, etc. were applied to the support to prepare a color fixing material. A color image was formed on the material by heat development.

TABLE 2

| Layer No. | Layer | Additive | | Amount |
|---|---|---|---|---|
| The sixth layer | Protective layer | gelatin | | 0.9 |
| | | matting agent | silica | 0.116 |
| | | water-soluble polymer (1) | | 0.228 |
| | | surfactant (1) | | 0.064 |
| | | surfactant (2) | | 0.036 |
| | | hardener | | 0.018 |
| | | surfactant (3) | | 0.06 |
| | | surfactant (6) | | 0.072 |
| The fifth layer | Green-sensitive layer | emulsion (I) | | 0.4 |
| | | organic silver salt (2) | silver | 0.036 |
| | | actylene compound | | 0.022 |
| | | yellow dye-donating substance (1) | | 0.036 |
| | | yellow dye-donating substance (2) | | 0.09 |
| | | high-boiling organic solvent (1) | | 0.025 |
| | | reducing agent (1) | | 0.009 |
| | | mercapto compound (1) | | 0.009 |
| | | surfactant (3) | | 0.06 |
| | | water-soluble polymer (2) | | 0.02 |
| | | hardener | | 0.013 |
| | | gelatin | | 0.64 |

TABLE 2-continued

| Layer No. | Layer | Additive | | Amount |
|---|---|---|---|---|
| | | surfactant (5) | | 0.045 |
| The fourth layer | Intermediate layer | gelatin | | 0.7 |
| | | $Zn(OH)_2$ | | 0.3 |
| | | surfactant (1) | | 0.001 |
| | | water-soluble polymer (2) | | 0.03 |
| | | hardener | | 0.014 |
| | | surfactant (4) | | 0.029 |
| The third layer | Red-sensitive layer | emulsion (IV) | | 0.21 |
| | | organic silver salt (1) | silver | 0.035 |
| | | organic silver salt (2) | silver | 0.035 |
| | | gelatin | | 0.44 |
| | | magenta dye-donating substance | | 0.3 |
| | | high-boiling organic solvent (1) | | 0.15 |
| | | reducing agent (1) | | 0.006 |
| | | mercapto compound (1) | | 0.003 |
| | | surfactant (4) | | 0.029 |
| | | water-soluble polymer (2) | | 0.013 |
| | | surfactant (5) | | 0.03 |
| | | hardener | | 0.009 |
| The second layer | Intermediate layer | gelatin | | 0.77 |
| | | $Zn(OH)_2$ | | 0.3 |
| | | surfactant (4) | | 0.047 |
| | | water-soluble polymer (2) | | 0.038 |
| | | surfactant (1) | | 0.046 |
| | | hardener | | 0.016 |
| The first layer | I.R. sensitive layer | emulsion (VII) | | 0.026 |
| | | organic silver salt (1) | silver | 0.035 |
| | | organic silver salt (2) | silver | 0.035 |
| | | mercapto compound (2) | | $4 \times 10^{-4}$ |
| | | sensitizing dye | | $5 \times 10^{-5}$ |
| | | cyan dye-donating substance | | 0.325 |
| | | high-boiling organic solvent (1) | | 0.162 |
| | | reducing agent (1) | | $8.7 \times 10^{-3}$ |
| | | mercapto compound (1) | | 0.013 |
| | | surfactant (4) | | 0.094 |
| | | surfactant (5) | | 0.032 |
| | | water-soluble polymer (2) | | 0.018 |
| | | gelatin | | 0.5 |
| | | hardener | | 0.01 |
| Support (polyethylene terephthalate; thickness: 100μ) | | | | |
| Back layer | | carbon black | | 0.44 |
| | | polyester | | 0.30 |
| | | polyvinyl chloride | | 0.30 |

high-boiling organic solvent (1): trinonyl phosphate
water-soluble polymer (high water-soluble polymer) (1):
Sumika Gel L-5 (H) (a product of Sumitomo Chemical Co., Ltd.)
water-soluble polymer (high water-absorbing polymer)
(2):

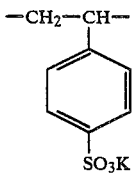

surfactant (1): Aerosol OT
surfactant (2):

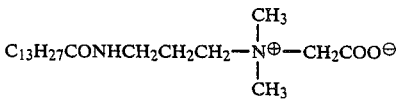

surfactant (3):

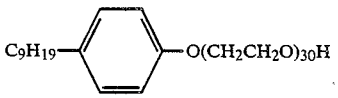

surfactant (4):

TABLE 2-continued
| Layer No. | Layer | Additive | Amount |
|---|---|---|---|
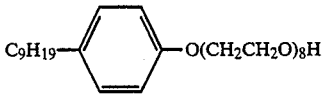
surfactant (5):
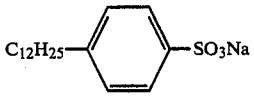
surfactant (6):
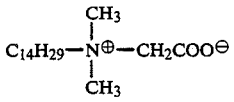
hardener: 1,2-bis(vinylsulfonylacetamido)ethane
silicone oil:
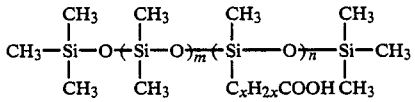
acetylene compound:
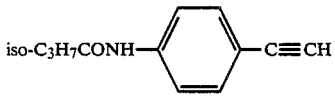
reducing agent (1):
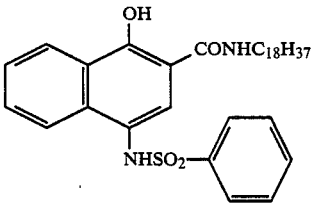
mercapto compound (1):
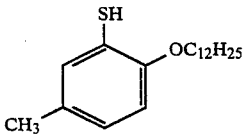
mercapto compound (2):
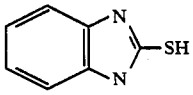
sensitizing dye TABLE 2-continued

| Layer No. | Layer | Additive | Amount |
|---|---|---|---|

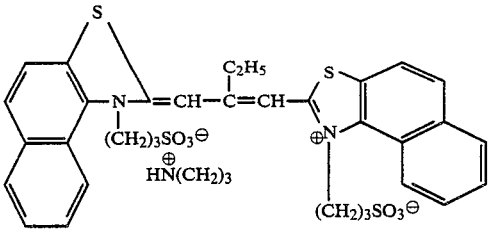

The emulsion used for forming the fifth layer was prepared as follows:

Emulsion (I)

The following solutions I and II were added slowly to an aqueous gelatin solution (prepared by dissolving 20 g of gelatin, 3 g of sodium chloride and 0.015 g of a compound of the formula:

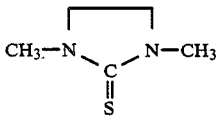

in 800 ml of water and kept at 65° C.) under thorough stirring over 70 min. Simultaneously with the start of the addition of the solutions I and II, the addition of a dye solution prepared by dissolving 0.24 g of a sensitizing dye (A):

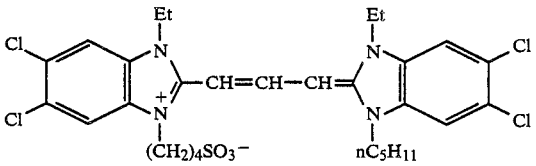

in a solution comprising 120 ml of methanol and 120 ml of water was also started and continued for 60 min.

| | Solution I (600 ml in total) | Solution II (600 ml in total) |
|---|---|---|
| $AgNO_3$(g) | 100 | — |
| KBr (g) | — | 56 |
| NaCl (g) | — | 7 |

Immediately after completion of the addition of the solutions I and II, a solution of 2 g of KBr in 20 ml of water was added thereto and the mixture was left to stand for 10 min.

After water washing followed by desalting, 25 g of gelatin and 100 ml of water were added thereto and the pH and pAg were adjusted to 6.4 and 7.8, respectively.

The obtained emulsion was a disperse emulsion comprising cubic grains having a size of about 0.5μ.

The emulsion was kept at 60° C. 1.3 mg of triethylthiourea and 100 mg of 4-hydroxy-6-methyl-1,3,3a,7-tetrazaindene were added simultaneously to the emulsion to conduct the optimum chemical sensitization. The yield was 650 g.

The emulsion used for forming the third layer was prepared as follows:

Emulsion (VI)

The following solutions I and II were added slowly to an aqueous gelatin solution (prepared by dissolving 20 g of gelatin, 2 g of sodium chloride and 0.015 g of a compound of the formula:

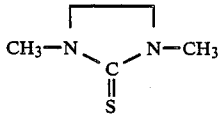

in 800 ml of water and kept at 55° C.) under thorough stirring over 60 min.

Simultaneously with the start of the addition of the solutions I and II, the addition of a dye solution prepared by dissolving 0.16 g of a sensitizing dye (B):

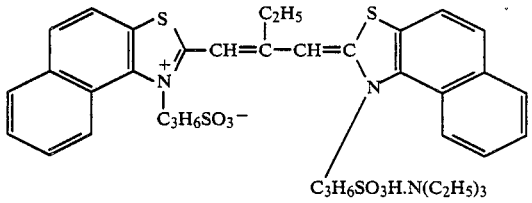

in 80 ml of methanol was also started and continued for 40 min.

| | Solution I (600 ml in total) | Solution II (600 ml in total) |
|---|---|---|
| $AgNO_3$(g) | 100 | — |
| KBr (g) | — | 56 |
| NaCl (g) | — | 7 |

After completion of the addition of the solutions I and II, the mixture was left to stand for 10 min, cooled, washed with water and desalted. 25 g of gelatin and 100 ml of water were added thereto and the pH and pAg were adjusted to 6.5 and 7.8, respectively.

Thereafter, triethylthiourea and 4-hydroxy-6-methyl-1,3,3a,7-tetrazaindene were added thereto to conduct the optimum chemical sensitization.

The obtained emulsion was a monodisperse emulsion comprising cubic grains having a size of about 0.35μ. The yield was 650 g.

The emulsion used for forming the first layer was prepared as follows:

Emulsion (VII)

600 ml of an aqueous solution containing 49 g of potassium bromide and 10.5 g of sodium chloride and an aqueous silver nitrate solution (prepared by dissolving 0.59 mol of silver nitrate in 600 ml of water) were simultaneously added at the same flow rate to an aqueous gelatin solution (prepared by dissolving 20 g of gelatin, 4 g of sodium chloride and 0.02 g of a compound of the formula:

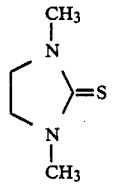

in 1000 ml of water and kept at 60° C.) under thorough stirring over 50 min. After water washing followed by desalting, 25 g of gelatin and 200 ml of water were added thereto and the pH was adjusted to 6.4. The optimum chemical sensitization was conducted with triethylthiourea and 4-hydroxy-6-methyl-1,3,3a,7-tetrazaindene to obtain 700 g of a monodisperse emulsion (I) comprising cubic grains having an average size of 0.4μ.

The organic silver salts were prepared as follows:

Organic silver salt (1)

A silver/benzotriazole emulsion was prepared as follows:

28 g of gelatin and 13.2 g of benzotriazole were dissolved in 300 ml of water. The obtained solution was kept at 40° C. under stirring. A solution of 17 g of silver nitrate in 100 ml of water was added to the solution over 2 min.

The pH of the silver/benzotriazole emulsion was adjusted to form precipitates. The excess salt was removed. The pH was adjusted to 6.30 to prepare 400 g of the silver/benzotriazole emulsion.

Organic silver salt (2)

20 g of gelatin and 5.9 g of 4-acetylaminophenylpropiolic acid were dissolved in a mixture of 1000 ml of 0.1% aqueous sodium hydroxide solution and 200 ml of ethanol.

The obtained solution was kept at 40° C. under stirring.

A solution of 4.5 g of silver nitrate in 200 ml of water was added to the solution over 5 min.

The pH of the thus prepared dispersion was adjusted to form precipitates and the excess salt was removed. The pH was adjusted to 6.3 to prepare 300 g of the organic silver salt (2) dispersion.

The dispersions of the dye-donating substance in gelatin were prepared as follows:

12 g of a yellow dye-donating substance (Y-1), 3 g of (Y-2), 7.5 g of high-boiling organic solvent (1), 0.3 g of reducing agent (1) and 0.3 g of mercapto compound (1) were dissolved in 45 ml of ethyl acetate. The solution was stirred together with 100 g of 10% gelatin solution and 60 ml of 2.5% aqueous sodium dodecylbenzenesulfonate solution. The mixture was treated in a homogenizer at 10000 rpm for 10 min to obtain a dispersion, which will be called "dispersion of yellow dye-donating substance".

15 g of the magenta dye-donating substance (M), 7.5 g of the high-boiling organic solvent (1), 0.3 g of the reducing agent (1) and 0.15 g of the mercapto compound (1) were dissolved in 25 ml of ethyl acetate. The solution was stirred together with 100 g of 10% aqueous gelatin solution and 60 ml of 2.5% aqueous sodium dodecylbenzenesulfonate. The mixture was treated in a homogenizer at 10000 rpm for 10 min to obtain a dispersion, which will be called "dispersion of magenta dye-donating substance".

15 g of the cyan dye-dontaing substance (C), 7.5 g of the high-boiling organic solvent (1), 0.4 g of the reducing gent (1) and 0.6 g of the mercapto compound (1) were dissolved in 40 ml of ethyl acetate. The solution was stirred together with 100 g of 10% gelatin solution and 60 ml of 2.5% aqueous sodium dodecylbenzenesulfonate solution. The mixture was treated in a homogenizer at 10000 rpm for 10 min to obtain a dispersion, which will be called "dispersion of cyan dye-donating substance".

(Y-1)

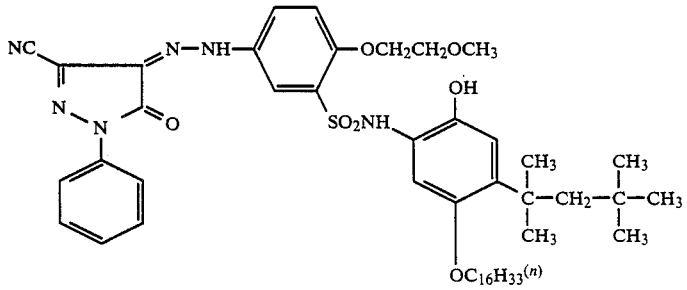

-continued (Y-2)

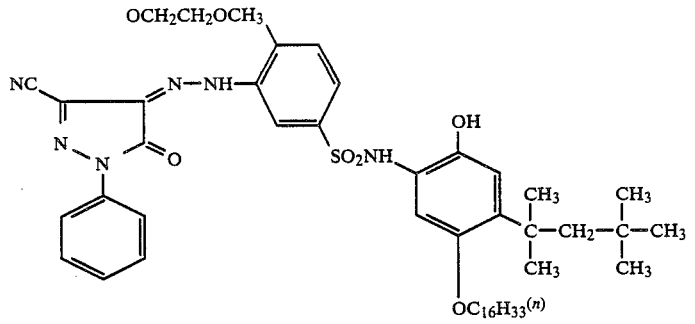

(M)

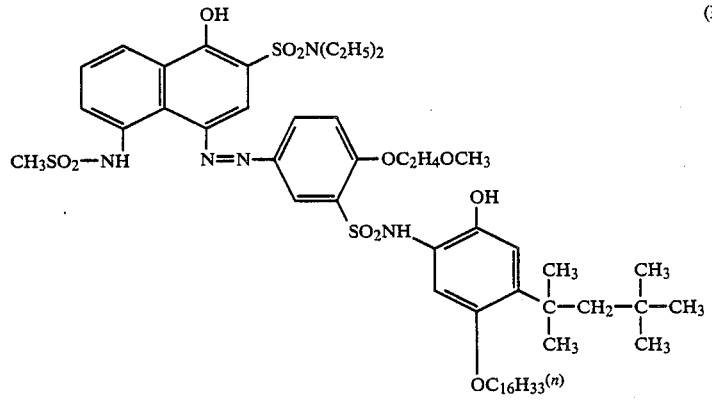

(C)

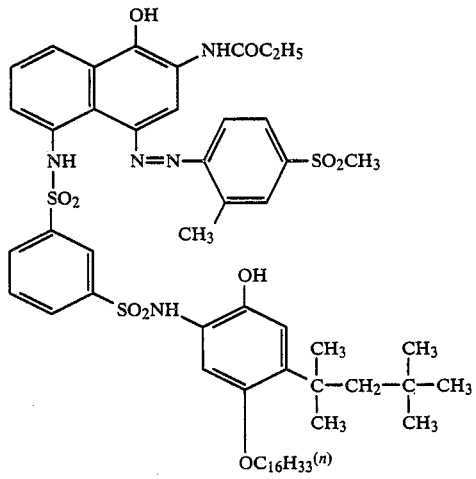

The dye-fixing material was prepared as follows:

The following layers were formed on the photographic support of the present invention having the same gelatin priming layer as in the above example to prepare the dye-fixing material.

| | |
|---|---|
| The second layer | gelatin (0.7 g/m$^2$) |
| | hardener*1 (0.24 g/m$^2$) |
| The first layer | gelatin (1.4 g/m$^2$) |
| | mordant*2 (2.6 g/m$^2$) |
| | guanidium picolate (2.5 g/m$^2$) |

-continued

| Support |
|---|
| *1 1,2-bis(vinylsulfonylacetamido)ethane |
| *2 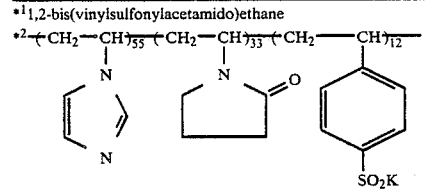 |

The color photosensitive material comprising the above-mentioned layers was exposed with a xenon flash tube for $1/10^{-4}$ sec through a separation filter of G, R and IR (the density being changed continuously).

12 ml/m$^2$ of water was applied to the emulsion surface of the exposed photosensitive material with a wire bar and then it was put on the dye-fixing material in such a manner that the layer surfaces were brought in contact with each other. It was heated with a heat roller having a temperature controlled so that the temperature of the water-absorbed film would be 90° C. for 20 sec. Then, the dye-fixing material was peeled off from the photosensitive material to obtain a yellow, magenta and cyan image corresponding to the separation filter of G, R and IR on the dye-fixing material.

Thus, by using the support of the present invention, the transferred dye image having more excellent gradation and higher sharpness than those obtained when an ordinary paper support having the both surfaces laminated with polyethylene was used could be obtained.

EXAMPLE 8

Silver halide emulsion (1) used in this example was prepared as follows:

| | |
|---|---|
| (Solution 1) | |
| $H_2O$ | 1000 cc |
| NaCl | 5.5 g |
| gelatin | 32 g |
| (Solution 2) | |
| 1N sulfuric acid | 24 cc |
| (Solution 3) | |
| the following solvent for silver halide (1%) | 3 cc |

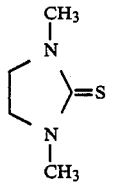

| | |
|---|---|
| (Solution 4) | |
| KBr | 15.66 g |
| NaCl | 3.30 g |
| $H_2O$ | ad 200 cc |
| (Solution 5) | |
| $AgNO_3$ | 32 g |
| $H_2O$ | ad 200 cc |
| (Solution 6) | |
| KBr | 62.72 g |
| NaCl | 13.22 g |
| $K_2IrCl_6$ (0.001%) | 4.54 cc |
| $H_2O$ | ad 600 cc |
| (Solution 7) | |
| $AgNO_3$ | 128 g |
| $H_2O$ | ad 600 cc |

The Solution 1 was heated at 56° C. The Solution 2 and Solution 3 were added to the Solution 1. Then the Solution 4 and Solution 5 were simultaneously added thereto over 30 min 10 min after completion of the addition, the Solution 6 and Solution 7 were simultaneously added thereto over 20 min 5 min after completion of the addition, the temperature was lowered to conduct desalting. Water and gelatin were added thereto and the pH was adjusted to 6.2 to prepare a monodisperse silver chlorobromide emulsion comprising cubic grains having an average grain size of 0.45 μm, coefficient of variation (calculated by dividing the standard deviation by the average grain size: a/d) of 0.08 and silver bromide content of 70 molar %. Sodium thiosulfate was added to the emulsion and the optimum chemical sensitization was conducted.

Silver halide emulsions (2), (3), (4) and (5) having different silver chloride contents were prepared in the same manner as above except that the amounts of KBr and NaCl in the above Solution 4 and Solution 6 and the time required for the simultaneous addition of the Solution 4 and Solution 5 were modified as shown in Table 3.

TABLE 3

| Emulsion | Solution 4 KBr | Solution 4 NaCl | Solution 6 KBr | Solution 6 NaCl | Time required for addition of Solutions 4 and 5 |
|---|---|---|---|---|---|
| (2) | 6.71 g | 7.70 g | 26.88 g | 30.84 g | 12 min |
| (3) | 3.36 g | 9.35 g | 13.44 g | 37.44 g | 10 min |
| (4) | 1.12 g | 10.45 g | 4.48 g | 41.85 g | 9 min |
| (5) | 0.22 g | 10.89 g | 0.90 g | 43.61 g | 8 min |

The average grain sizes, coefficients of variation and halogen composition in the Silver halide emulsions (1) to (5) are shown in Table 4.

TABLE 4

| Emulsion | Average grain size (μm) | Coefficient of variation (s/d) | Halogen composition (%) Br | Halogen composition (%) Cl |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 5 | 95 |
| (5) | 0.45 | 0.08 | 1 | 99 |

Support (I) of the present invention and a Comparative support (A) used in an ordinary process were prepared as follows:

Support (I): Polyethylene was applied to both surfaces of a photographic white base paper to form a laminate. Separately, metallic aluminum was rolled to form a foil. In the rolling by two cylinders, the foil was patterned by means of unevennesses provided on the cylinder surface to make the acid-resistant mirror surface of the aluminum foil uneven and to provide a secondary diffuse-reflective surface.

The metallic aluminum foil could be applied to a low-density polyethylene layer, with the diffuse-reflective surface of the foil facing outside, under heating to form a laminate. A gelatin prime layer was formed on the thus obtained aluminum foil in the same manner as in the preparation of the Support (I).

Comparative support (A): white fine powder fo titanium oxide was mixed previously into polyethylene in such a manner that its amount in the resulting laminate would be about 4 g/m$^2$. The mixture was applied to the surface of a photographic white base paper and, simultaneously, polyethylene was applied to the other surface of the base paper to form a laminate, i.e. RC paper. A gelatin prime layer was formed on the white polyethylene surface in the same manner as in the preparation of the Support (I).

The first to the seventh layers shown in Table 5 were formed on each support to prepare a laminate, i.e. color photographic material.

The first layer: Sensitizing dye (a) was added to Silver halide emulsion (5) in an amount of $7.0\times10^{-4}$ mol per mol of AgX to conduct the spectral sensitization. Yellow coupler (d), Color image stabilizer (e) and Solvent (f) were mixed together to obtain a solution, which was added to the emulsion in a given amount. The mixture was applied to the support to form the first layer.

The third layer: Sensitizing dye (b) was added to Silver halide emulsion (3) in an amount of $4.0\times10^{-4}$ mol per mol of AgX to conduct the spectral sensitization. Magenta coupler (h) and Color image stabilizer (i) were mixed with Solvent (j) to obtain a solution, which was added to the sensitized emulsion in a given amount. The resulting mixture was for forming the third layer.

The fifth layer: Sensitizing dye (c) was added to Silver halide emulsion (2) in an amount of $1.0\times10^{-4}$ mol per mol of AgX to conduct the spectral sensitization. Cyan coupler (n) and Color image stabilizer (o) were mixed with Solvent (f) to obtain a solution, which was added to the sensitized emulsion in a given amount. The resulting mixture was for forming the fifth layer.

Emulsions for forming the second layer, the fourth layer, the sixth layer and the seventh layer were prepared in the same manner as above.

The emulsions for forming the first, second, third, fourth, fifth, sixth and seventh layers were applied successively on the prime layer formed on the support to prepare Samples 1 and 2 and Comparative Sample a.

| | Support | Coating composition |
|---|---|---|
| Sample 1 | Support I | Table 3 |
| Comparative sample a | Support A | " |

The above prepared samples were subjected to sensitometric gradation exposure through a blue/green/red separation filter or to enlargement print image exposure through a negative film by using 2854° K. light source.

After the color development, bleach fixing and rinse, a photographic image was obtained.

TABLE 5

| Layer | Main components | Amount |
|---|---|---|
| The seventh layer (protective layer) | gelatin | 1.33 g/m$^2$ |
| | Acryl-modified polyvinyl alcohol copolymer (degree of modification: 17%) | 0.17 g/m$^2$ |
| The sixth layer (U.V. absorbing layer) | gelatin | 0.54 |
| | U.V. absorber (k) | 0.21 g/m$^2$ |
| | solvent (m) | 0.09 cc/m$^2$ |
| The fifth layer (red-sensitive layer) | silver halide emulsion silver: (2) | 0.22 g/m$^2$ |
| | gelatin | 0.90 g/m$^2$ |
| | cyan coupler (n) | 0.36 g/m$^2$ |
| | color image stabilizer (o) | 0.17 g/m$^2$ |
| | solvent (f) | 0.22 cc/m$^2$ |
| | red-sensitive sensitizing dye (c) | |
| The fourth layer (U.V. absorbing layer) | gelatin | 1.60 g/m$^2$ |
| | U.V. absorber (k) | 0.62 g/m$^2$ |
| | color mixing inhibitor (1) | 0.05 g/m$^2$ |
| | solvent (m) | 0.26 g/m$^2$ |
| The third layer (green-sensitive layer) | silver halide emulsion silver: (3) | 0.15 g/m$^2$ |
| | gelatin | 1.80 g/m$^2$ |
| | magenta coupler (h) | 0.38 g/m$^2$ |
| | color image stabilizer (i) | 0.16 g/m$^2$ |
| | solvent (j) | 0.38 g/m$^2$ |
| | green-sensitive sensitizing dye (b) | |
| The second layer (color mixing-inhibiting layer) | gelatin | 0.99 g/m$^2$ |
| | color mixing inhibitor (g) | 0.08 g/m$^2$ |
| The first layer | silver halide emulsion silver: (5) | 0.26 g/m$^2$ |
| | gelatin | 1.83 g/m$^2$ |
| | yellow coupler (d) | 0.91 g/m$^2$ |
| | color image stabilizer (e) | 0.19 g/m$^2$ |
| | solvent (f) | 0.36 cc/m$^2$ |
| | blue-sensitive sensitizing dye (a) | |

(a) blue sensitive sensitizing dye

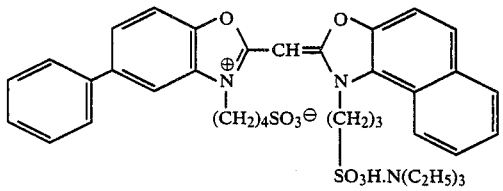

TABLE 5-continued
| Layer | Main components | Amount |
|---|---|---|
(b) green-sensitive sensitizing dye
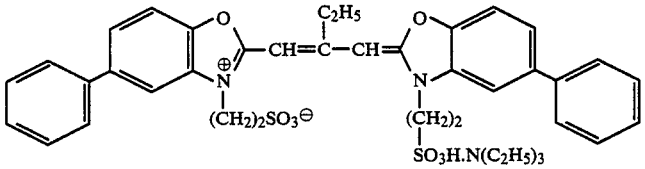
(c) red-sensitive sensitizing dye
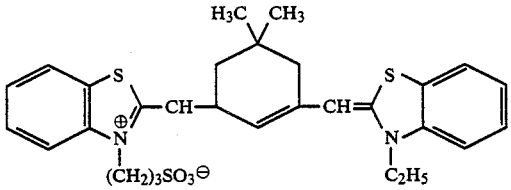
(d) yellow coupler
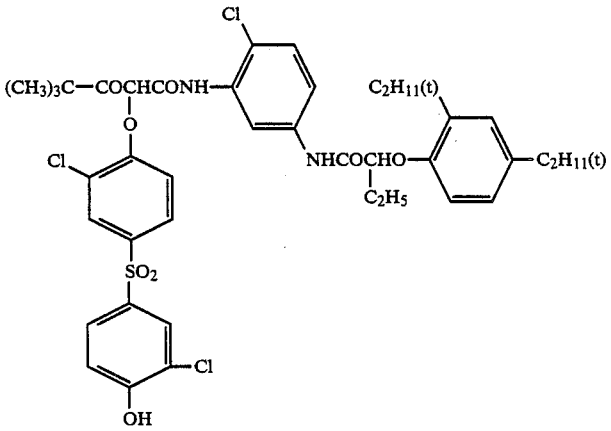
(e) color image stabilizer
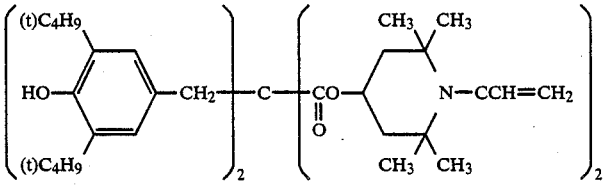
(f) solvent
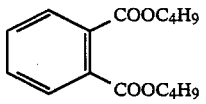
(g) color-mixing inhibitor
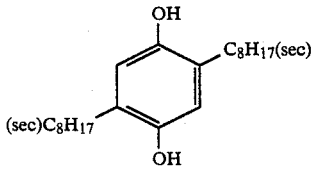
(h) magenta coupler TABLE 5-continued
| Layer | Main components | Amount |
|---|---|---|
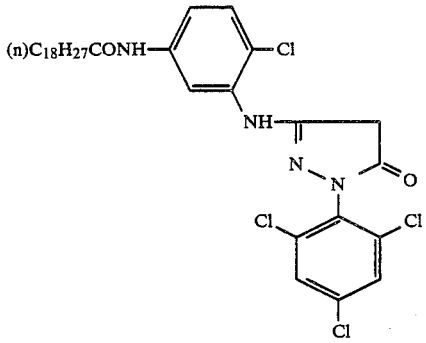
(i) color image stabilizer
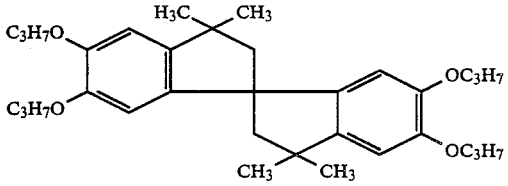
(j) solvent
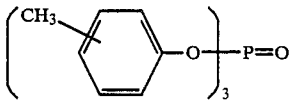
(k) I.R. absorber
mixture of
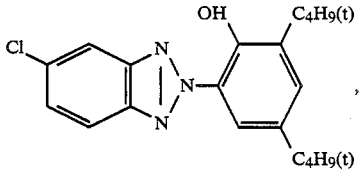
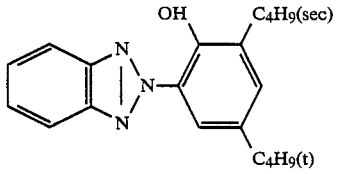
and
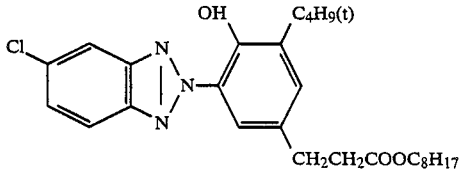
in molar ratio of 1:5:3
(l) color-mixing inhibitor
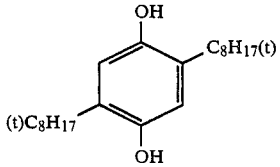

TABLE 5-continued
| Layer | Main components | Amount |
|---|---|---|
(m) solvent
(iso $C_9H_{18}O)_3P{=}O$
(n) cyan coupler
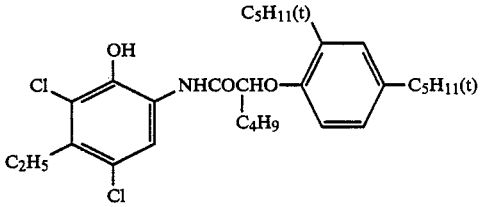
(o) color image stabilizer
mixture of
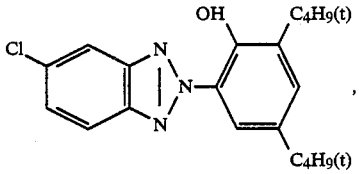
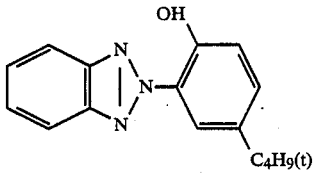
and
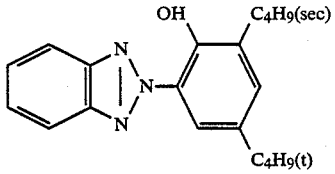
in a molar ratio of 1:3:3
(p) magenta coupler
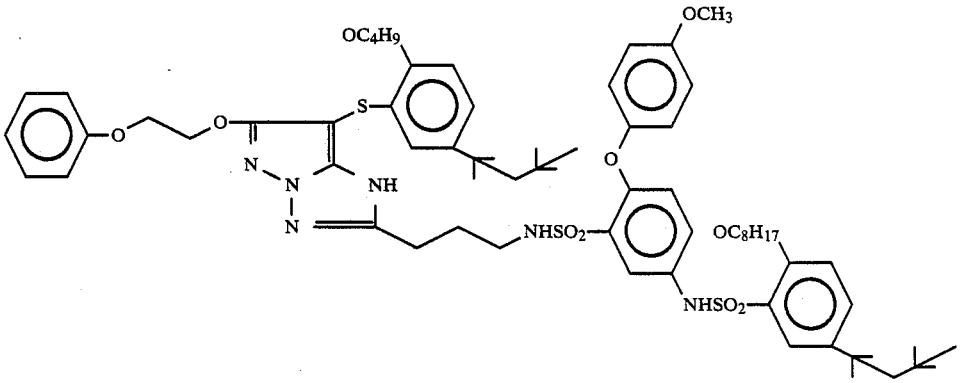
(Note)
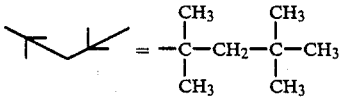
(q) cyan coupler TABLE 5-continued

| Layer | Main components | Amount |
|---|---|---|

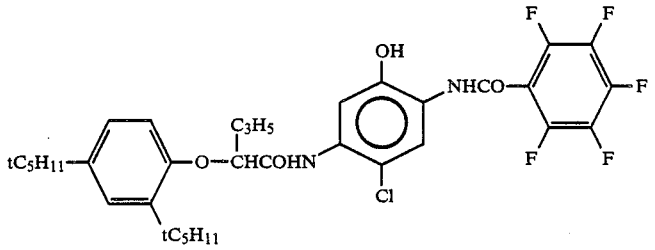

| | |
|---|---|
| Color developer A: | |
| water | 800 cc |
| diethylenetriaminepentaacetic acid | 1.0 g |
| sodium sulfite | 0.2 g |
| N,N—diethylenehydroxylamine | 4.2 g |
| potassium bromide | 0.6 g |
| sodium chloride | 1.5 g |
| triethanolamine | 8.0 g |
| potassium carbonate | 30 g |
| N—ethyl-N—(β-methanesulfonamidoethyl)-3-methyl-4-aminoaniline sulfate | 4.5 g |
| 4,4'-diaminostilbene fluorescent brightener (White × 4; a product of Sumitomo Chemical Co., Ltd.) | 2.0 g |
| water ad | 1000 cc |
| pH adjusted with KOH to 10.25 | |
| Bleach-fixing solution A: | |
| ammonium thiosulfate (54 wt. %) | 150 ml |
| $Na_2SO_3$ | 15 g |
| $NH_4(Fe(III)(EDTA))$ | 55 g |

In the visual inspection of the photographic image, it was noted that the saturation, particularly that of yellow and magenta, was quite excellent. Surprisingly, the sharpness was remarkably improved. Further, the details of the shade gradation were reproduced clearly. The results of the inspection will be shown below as the photographic physical properties.

EXAMPLE 9

Silver halide emulsion (6) used in this example was prepared as follows:

| | |
|---|---|
| (Solution 8) | |
| $H_2O$ | 1000 cc |
| NaCl | 5.5 g |
| gelatin | 32 g |
| (Solution 9) | |
| 1N sulfuric acid | 20 cc |
| (Solution 10) | |
| the following solvent for silver halide (1%) | 3 cc |

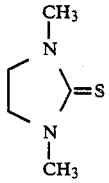

| | |
|---|---|
| (Solution 11) | |
| KBr | 0.18 g |
| NaCl | 8.51 g |
| $H_2O$ | ad 130 g |
| (Solution 12) | |
| $AgNO_3$ | 25 g |

-continued

| | |
|---|---|
| $NH_4NO_3$ (50%) | 0.5 cc |
| $H_2O$ | 130 cc |
| (Solution 13) | |
| KBr | 0.70 g |
| NaCl | 34.06 g |
| $K_2IrCl_6$ (0.001%) | 0.7 cc |
| $H_2O$ | ad 285 cc |
| (Solution 14) | |
| $AgNO_3$ | 100 g |
| $NH_4NO_3$ (50%) | 2.0 cc |
| $H_2O$ | ad 285 cc |

The solution 8 was heated to 62° C. The solutions 9 and 10 were added thereto. Then the Solutions 11 and 12 were simultaneously added thereto over 60 min. 10 min after completion of the addition, the Solutions 13 and 14 were simultaneously added thereto over 25 min. 5 min after completion of the addition, the temperature was lowered to conduct desalting. Water and dispersed gelatin were added thereto and the pH was adjusted to 6.2 to prepare a monodisperse silver chlorobromide emulsion comprising cubic grains having an average grain size of 1.01 μm, coefficient of variation (calculated by dividing the standard deviation by the average grain size: s/d) of 0.08 and silver bromide content of 1 molar %. Sodium thiosulfate was added to the emulsion and the optimum chemical sensitization was conducted.

The same procedure as in Example 8 was repeated using the Support (I) except that the Silver halide emulsion (5) used for forming the first layer was replaced with the emulsion (6) and yellow coupler (j) was replaced with yellow coupler (y); the silver halide emulsion (3) used for forming the third layer was replaced with the emulsion (4) and magenta coupler (h) was replaced with magenta coupler (p); and cyan coupler (n) in the fifth layer was replaced with cyan coupler (q). A laminate was prepared in the same manner as in Example 8 to prepare Sample 2.

The exposure and the process were conducted in the same manner as in Example 8 except that a color developer B was used to obtain a color image.

| | |
|---|---|
| Color developer B: | |
| water | 800 cc |
| diethylenetriaminepentaacetic acid | 1.0 g |
| sodium sulfite | 0.2 g |
| N,N—diethylenehydroxylamine | 4.2 g |
| potassium bromide | 0.01 g |
| sodium chloride | 1.5 g |
| triethanolamine | 80 g |
| potassium carbonate | 30 g |
| N—ethyl-N—(β-methanesulfonamidoethyl)-3-methyl-4-aminoaniline sulfate | 4.5 g |
| 4,4'-diaminostilbene fluorescent brightener (White × 4; a product of | 2.0 g |

-continued

| | |
|---|---|
| Sumitomo Chemical Co., Ltd.) | |
| water ad | 1000 cc |
| pH adjusted with KOH to 10.25 | |

An image having a high saturation and excellent sharpness could be obtained as in Example 8.

When the silver halide emulsion (3) in the third layer was replaced with the emulsion (1) to prepare Sample 3 and the color development time was prolonged from 45 seconds to 60 seconds, an excellent image substantially the same as that obtained as above could be obtained. When the color development time was limited to 45 seconds, the trichromatic balance was yet insufficient.

EXAMPLE 10

Silver halide emulsion layers were formed as shown in Table 6. The thus obtained Sample 4 was subjected to the sensitometric stepwise exposure and printing image-wise exposure by using a white light source and developed under the following conditions:

| (processing step) | | |
|---|---|---|
| the first development (black-and-white development) | 38° C. | 1'15" |
| water washing | 38° C. | 1'30" |
| reversal exposure | 100 Lux or above | 1"or longer |
| color development | 38° C. | 2'15" |
| water washing | 38° C. | 45" |
| bleach-fixing | 38° C. | 2'00" |
| water washing | 38° C. | 2'15" |

The processing solutions had the following compositions:

TABLE 6

| Layer | Main components | Amount |
|---|---|---|
| The eleventh layer (protective layer) | fine grains of silver chlorobromide (AgCl 77 molar %, average grain diameter: 0.2μ) | 0.07 g/m$^2$ (in term of silver) |
| | gelatin | 1.0 |
| | hardener *20 | 0.17 |
| The tenth layer (U.V. absorbing layer) | gelatin | 1.50 |
| | U.V. absorbing agent *19 | 1.0 |
| | solvent for U.V. absorbing agent *18 | 0.30 |
| | color mixing inhibitor *17 | 0.08 |
| The ninth layer (high-speed blue-sensitive layer) | silver bromoiodide emulsion spectrally sensitized with sensitizing dye *16 (AgI content: 2.5 molar %, average grain diameter: 1.4μ) | 0.20 (in terms of silver) |
| | gelatin | 0.5 |
| | yellow coupler *15 | 0.20 |
| | solvent for the coupler *18 | |
| The eighth layer (low-speed blue-sensitive layer) | silver bromoiodide emulsion spectrally sensitized with sensitizing dye *16 AgI content: 2.5 molar %, average grain diameter: 0.5μ) | 0.15 (in terms of silver) |
| | gelatin | 0.5 |
| | yellow coupler *15 | 0.20 |
| | solvent for the coupler *18 | 0.05 |
| The seventh layer (yellow filter layer) | yellow colloidal silver | 0.20 |
| | gelatin | 1.00 |
| | color mixing inhibitor *14 | 0.06 |
| | " *13 | 0.24 |
| | anti-irradiation dye *23, *34 | |
| The sixth layer (high-speed green-sensitive layer) | silver bromoiodide emulsion spectrally sensitized with sensitizing dye *12 (AgI content: 3.5 molar %, average grain diameter: 0.9μ) | 0.20 g/m$^2$ (in terms of silver) |
| | gelatin | 0.70 |
| | magenta coupler *11 | 0.40 |
| | decoloration inhibitor A *10 | 0.05 |
| | " B *9 | 0.05 |
| | " C *8 | 0.02 |
| | solvent for the coupler *7 | 0.15 |
| The fifth layer (low-speed green-sensitive layer) | silver bromoiodide emulsion spectrally sensitized with sensitizing dye *12 (AgI content: 3.5 molar %, average grain diameter: 0.4μ) | 0.20 g/m$^2$ (in terms of silver) |
| | gelatin | 0.70 |
| | magenta coupler *11 | 0.40 |
| | decoloration inhibitor A *10 | 0.05 |
| | " B *9 | 0.05 |
| | decoloration inhibitor C *8 | 0.02 |
| | solvent for the coupler *7 | 0.15 |
| The fourth layer (intermediate layer) | yellow colloidal silver | 0.02 |
| | gelatin | 1.00 |
| | color mixing inhibitor *14 | 0.08 |
| | solvent for the color mixing inhibitor *13 | 0.16 |
| | polymer latex *6 | 0.10 |
| The third layer (high-speed red-sensitive layer) | silver bromoiodide emulsion spectrally sensitized with sensitizing dyes *5 and *4 (AgI content: 8.0 molar %, average grain diameter: 0.7μ) | 0.10 g/m$^2$ (in terms of silver) |
| | gelatin | 0.50 |
| | cyan coupler *3 | 0.10 |
| | decoloration inhibitor *2 | 0.05 |
| | solvent for the coupler *18 and *1 | 0.02 |
| The second layer (low-speed red-sensitive layer) | silver bromoiodide emulsion spectrally sensitized with sensitizing dyes *5 and *4 (silver iodide content: 3.5 molar %, average grain diameter: 0.7μ) | 0.15 (in terms of silver) |
| | gelatin | 1.0 |
| | cyan coupler *3 | 0.30 |
| | decoloration inhibitor *2 | 0.15 |
| | solvent for the coupler *18 and *1 | 0.06 |
| The first layer (antihalation layer) | black-and-white colloidal silver | 0.10 |

TABLE 6-continued

| Layer | Main components | Amount |
|---|---|---|
| | gelatin | 2.0 |

*1 dioctyl phthalate
*2 2-(2-hydroxy-3-sec-butyl-5-t-butylphenyl)benzotriazole(compound VI-12)
*3 2-[α-(2,4-di-t-amylphenoxy)butanamido]-4,6-dichloro-5-methylphenol
*4 Na salt of 5,5'-dichloro-3,3'-di(3-sulfobutyl)-9-ethylthiacarbonylcyanine
*5 triethylammonium 3-[2-{2-[3-(3-sulfopropyl)naphtho(1,2-d)thiazolin-2-ylidenemethyl]-1-butenyl}-3-naphtho(1,2-d)thiazoli]propanesulfonate
*6 polyethyl acrylate
*7 trioctyl phosphate
*8 2,4-di-t-hexylhydroquinone
*9 di(2-hydroxy-3-t-butyl-5-methylphenyl)methane
*10 3,3,3',3'-tetramethyl-5,6,5',6'-tetrapropoxy-1,1'-bisspiroindane
*11 1-(2,4,6-trichlorophenyl)-3-(2-chloro-5-tetradecanamido)-anilino-2-pyrazolin-5-one
*12 Na salt of 5,5'-diphenyl-9-ethyl-3,3'disulfopropyloxacarbocyanine
*13 o-cresyl phophate
*14 2,4-di-t-octylhydroquinone
*15 α-pivaloyl-α-[(2,4-dioxo-1-benzylhydantoin-3-yl)-2-chloro-5-(γ-2,4-dioxo-t-amylphenoxy)butaneamino]acetanilide
*16 triethylammonium 3-[2-(3-benzylrhodanin-5-ylidene)-3-benzoxazolinyl]propanesulfonate
*17 2,4-di-sec-octylhydroquinone
*18 trinonyl phosphate
*19 5-chloro-2-(2-hydroxy-3-t-butyl-5-t-octyl)phenylbenztriazole
*20 1,4-bis vinylsulfonylacetamido)ethane
*21 2-[α-(2,4-di-t-amylphenoxy)butanamido]-4,6-dichloro-5-ethylphenol
*22 4-chloro-2-(2-chlorobenzamido)-5-[α(4-t-amyl-2-chlorophenoxy)octanamido]-phenol
*23

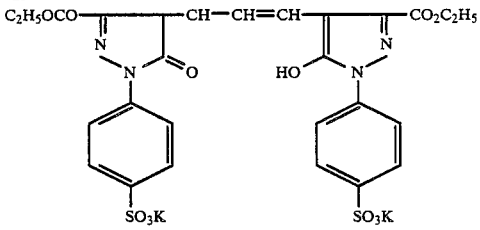

*24

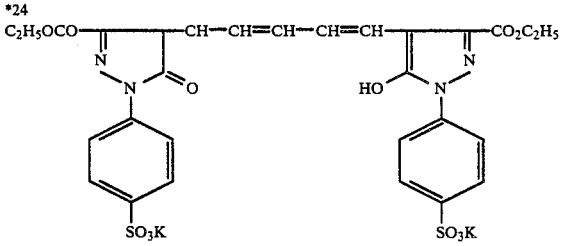

(Compositions of processing solutions)

| | |
|---|---|
| The first developer | |
| pentasodium nitrilo-N,N,N—trimethylene-phosphonate | 0.6 g |
| pentasodium diethylenetriamine-pentaacetate | 4.0 g |
| potassium sulfite | 30.0 g |
| potassium thiocyanate | 1.2 g |
| potassium carbonate | 35.0 g |
| potassium hydroquinonemonosulfonate | 25.0 g |
| diethylene glycol | 15.0 ml |
| 1-phenyl-4-hydroxymethyl-4-methyl-3-pyrazolidone | 2.0 g |
| potassium bromide | 0.5 g |
| potassium iodide | 5.0 mg |
| water ad | 1 l |
| | (pH 9.70) |
| Color developer | |
| benzyl alcohol | 1.5 ml |
| diethylene glycol | 1.2 ml |
| pentasodium nitrilo-N,N,N—trimethylenephosphonate | 0.5 g |
| pentasodium diethylenetriaminepenta-acetate | 2.0 g |
| potassium sulfite | 2.0 g |
| potassium carbonate | 25.0 g |
| hydroxylamine sulfate | 3.0 g |
| N-ethyl-N-(μ-methanesulfonamido-ethyl)-3-methyl-4-aminoaniline sulfate | 5.0 g |
| potassium bromide | 0.5 g |
| potassium iodide | 1.0 mg |
| water ad | 1 l |
| | (pH: 10.70) |
| Bleach-fixing solution | |
| disodium ethylenediaminetetra-acetate dihydrate | 5.0 g |
| ammonium Fe(III) ethylenediaminetetra-acetate monohydrate | 80.0 g |
| potassium sulfite | 15.0 g |
| sodium thiosulfate (700 g/l) | 160.0 ml |
| glacial acetic acid | 5.0 ml |
| water ad | 1 l |
| | (pH: 6.50) |

A comparative sample b was prepared in the same manner as in Example 10 except that the Comparative support A was used as the support. The development process was conducted in the same manner as above to obtain an image. As compared with the image formed by using the Comparative sample b, the image formed by using the Sample 4 had remarkably improved saturation, gradation reproduction in the shades and particularly sharpness as shown in Example 8.

Experimental Example 1

Figure 5:
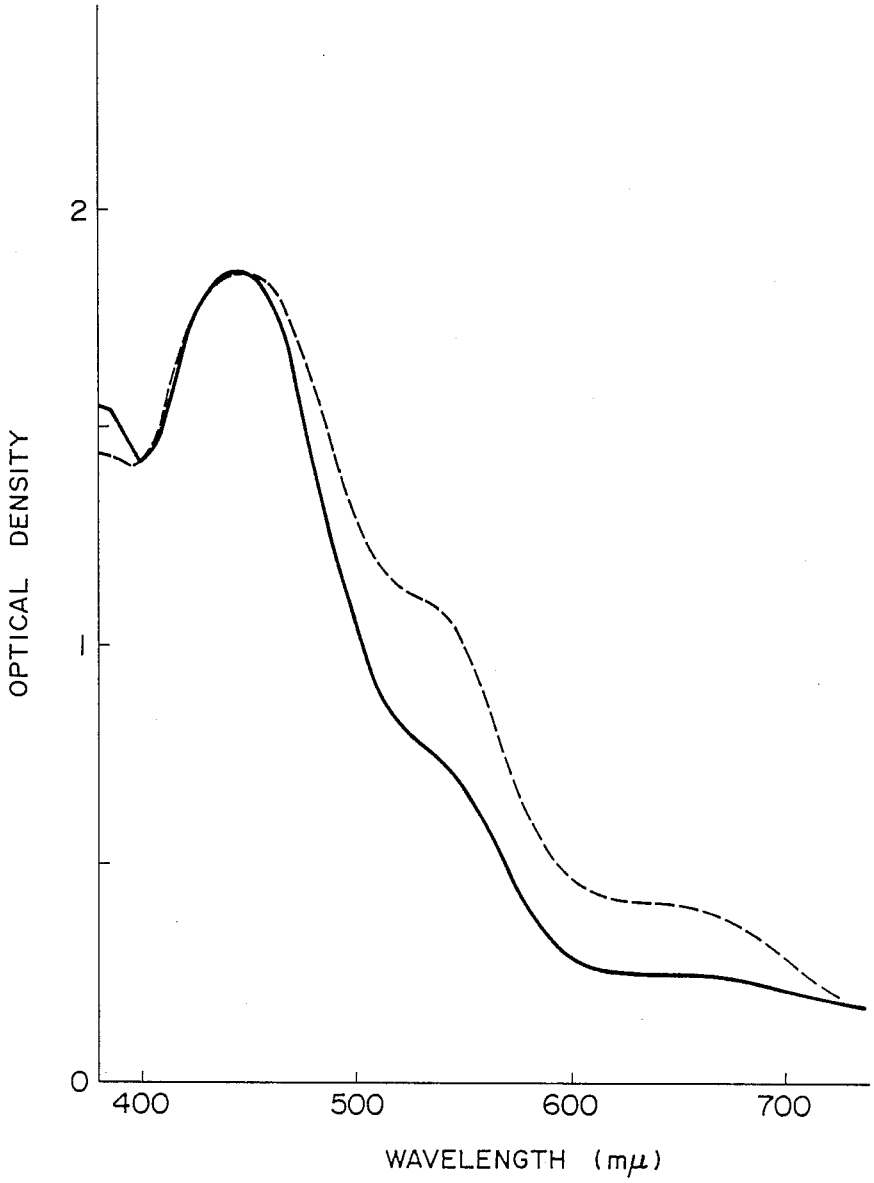
FIGS. 5 to 7 show spectral absorption curves.
Figure 6:
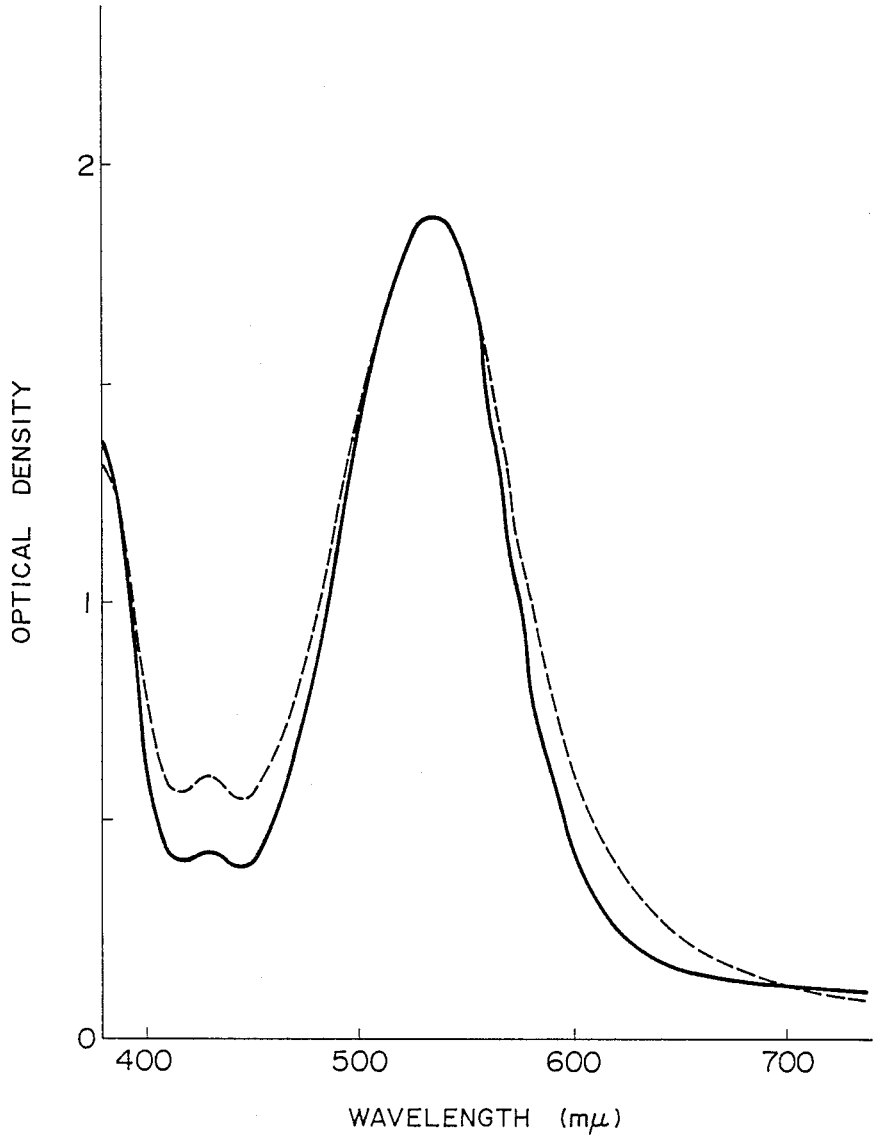
Figure 7:
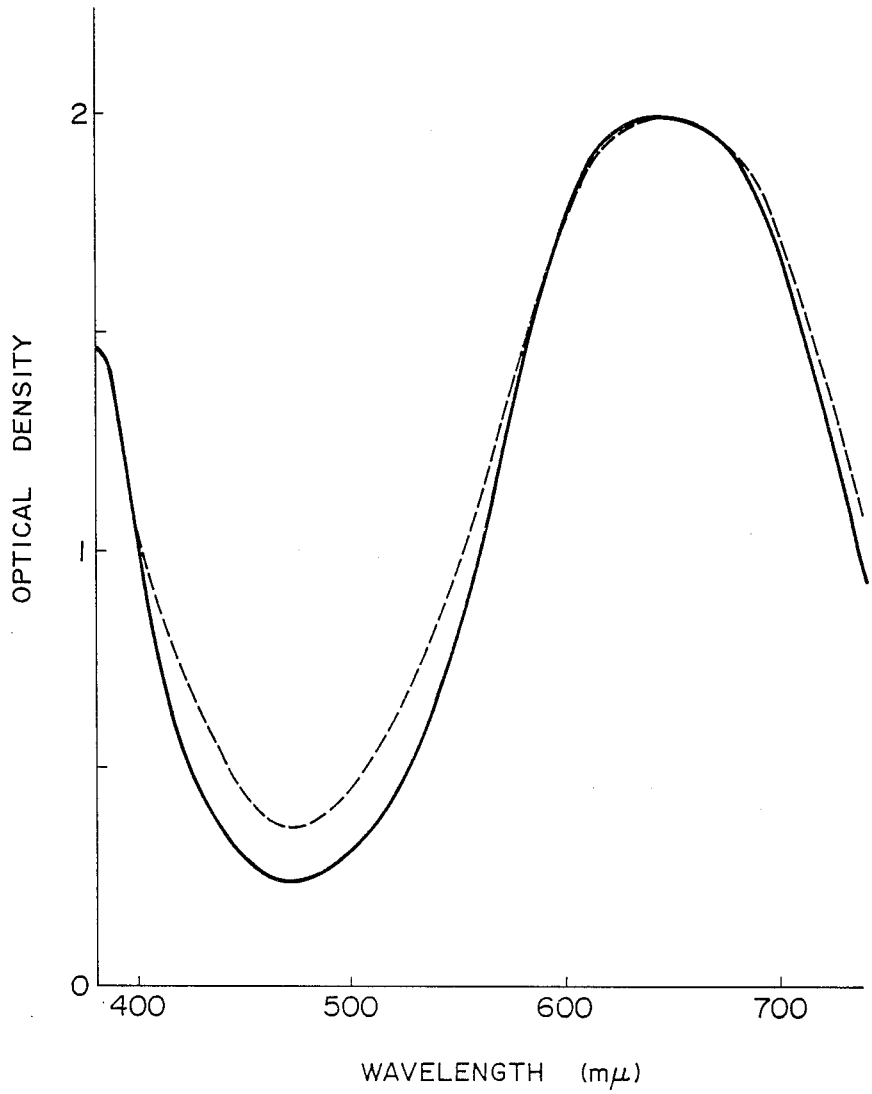
Figure 9:
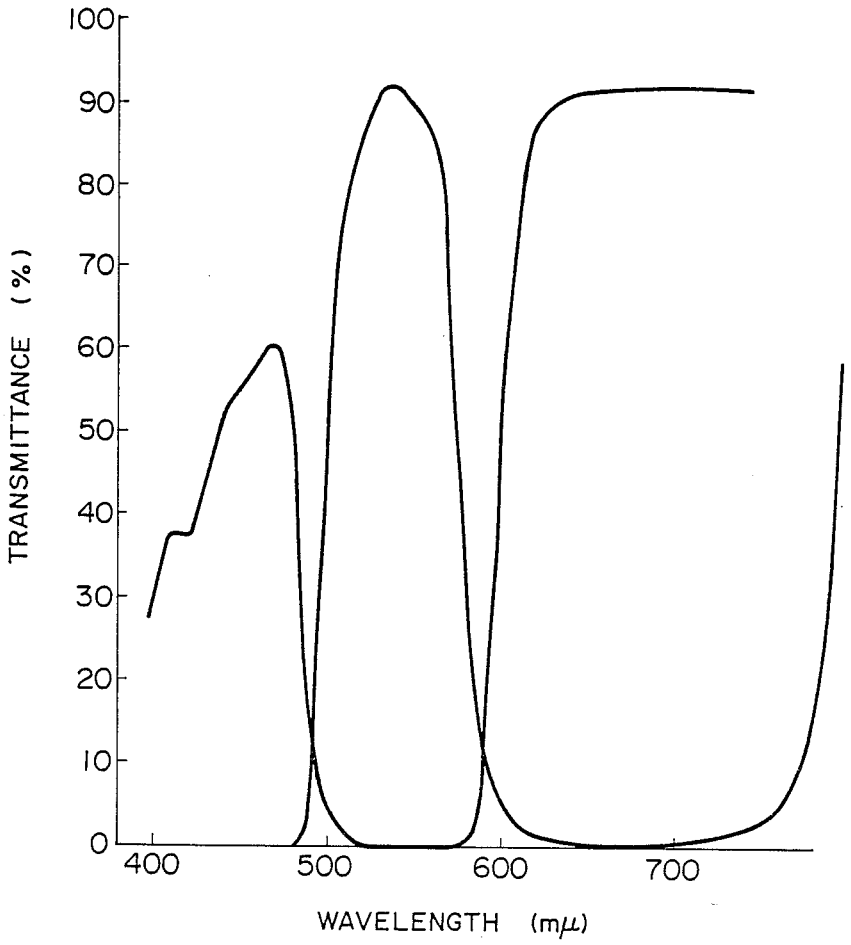
FIG. 9 shows spectral transmission curves obtained through a band-pass filter.
Figure 10:
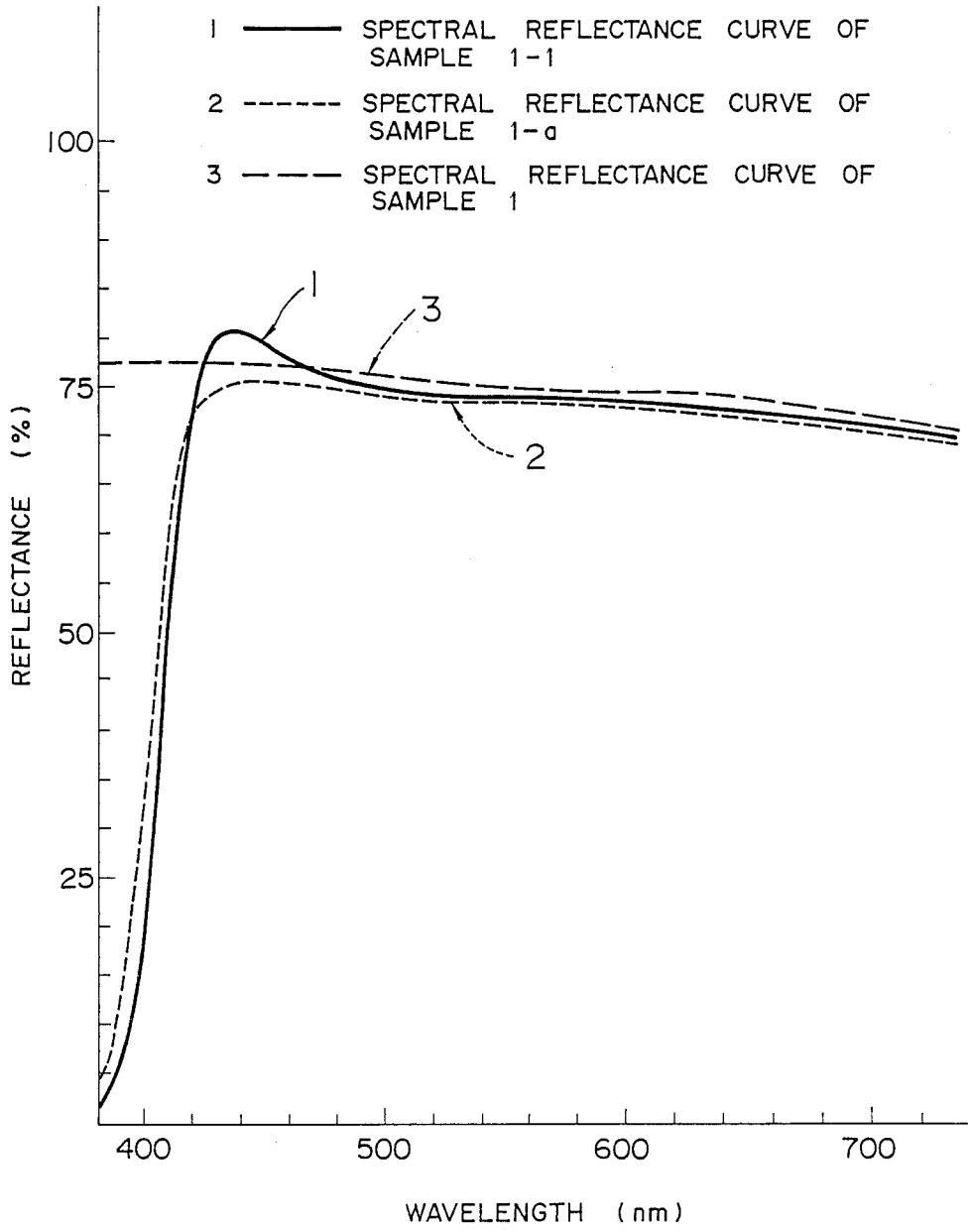
FIG. 10 shows spectral reflectance curves.

The Sample 1 prepared in Example 8 and Comparative sample a were subjected to the separation exposure through a band-pass color filter (light source: 2854° K.). The spectral transmittance is shown in FIG. 9. After the color development, bleach-fixing and rinsing steps conducted in the same manner as in Example 8, a color image (yellow, magenta and cyan) was formed. The spectral absorption characters thereof were examined by means of Color Analyzer 307 (a product of Hitachi, Ltd.) to obtain the results shown in FIG. 5 (BL, yellow color image), FIG. 6 (GL, magenta color image) and FIG. 7 (RL, cyan color image). The results obtained by using the Sample 1 of the present invention are shown by a solid line and those obtained by using the Comparative sample a are shown by a broken line. The maximum density is represented as 1.0. It will be understood that the color image according to the present invention had a sharp spectral absorption distribution and an improved saturation.

Experimental Example 2

CTF of each of RL, GL and BL of the color photosensitive material of the present invention was determined. CTF is a ratio of a density amplitude at a frequency of substantially 0 to a density amplitude at a varied frequency.

Figure 8:
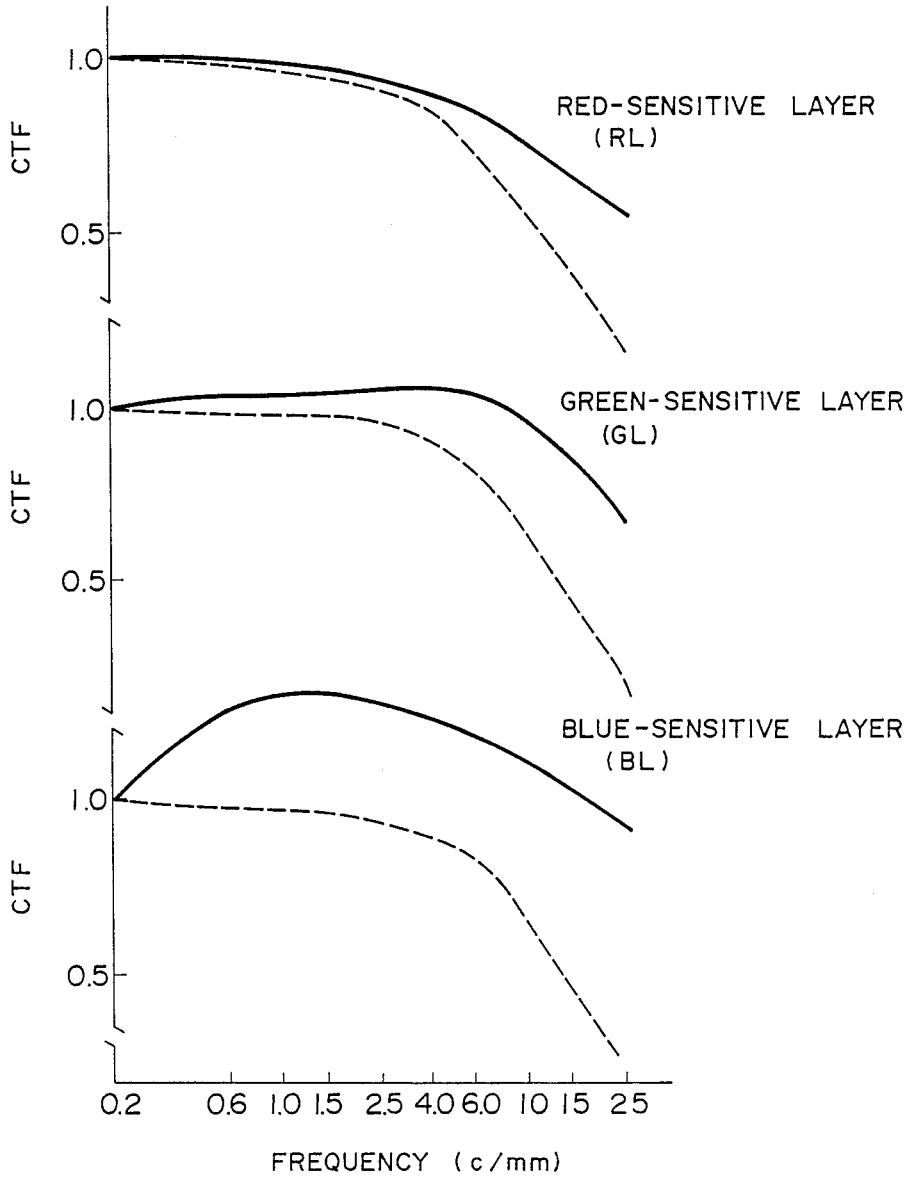
FIG. 8 shows a relationship between CTF and the frequency.

The Sample 1 of the present invention and the Comparative sample a to which a square waves chart of varied frequency was closely applied were exposed through an R, G, B separation filter and then subjected to a given development process in the same manner as in Example 8. The thus obtained image was with a microdensitometer (aperture: $2\mu \times 100\mu$ width) to obtain the results shown in FIG. 8. The results obtained by using the Sample 1 are shown by a solid line and those obtained by using the Comparative sample are shown by a broken line. These results indicated that the image obtained by using the Sample 1 of the present invention had a remarkably high sharpness. The closer the silver halide layer to the support, the higher the sharpness. This is a surprising effect.

EXAMPLE 11

Metallic aluminum was roughly rolled. The aluminum sheets were then rolled in an apparatus comprising a central roller and two rollers arranged above and below the central one each in contact with the central one. In this step, two sheets of annealed metallic aluminum were put together and passed between the upper roller and the central roller and then between the central one and the lower one to prepare aluminum foils having a thickness of about 10μ. Surprisingly, the surfaces of the foils contacted with each otehr had the secondary diffuse-reflecting properties. A photographic white base paper was extrusion-coated with a low-density polyethylene and laminated with the metallic aluminum. Then the other surface of the support was subjected to a corona discharge and extrusion-coated with the high-density polyethylene to form a polyethylene layer having a thickness of 30μ. The thus prepared support having the secondary diffuse-reflective aluminum surface will be referred to as Support Sample 1. Separately, an ionomer resin was applied to the aluminum surface. After drying followed by corona discharge treatment, a prime layer comprising gelatin and 2,4-dichloro-6-hydroxy-1,3,5-triazine was formed thereon. The product will be referred to as Sample 1-a.

Fluorescent brightener WF-1 was dissolved in a mixture of methanol and water (1:1). The mixture was mixed in an ionomer resin/latex dispersion and the obtained mixture was applied to the aluminum surface in such a manner that the amount of WF-1 in the ionomer resin layer would be 50 mg/m$^2$. A gelatin prime layer was formed thereon in the same manner as in Sample 1-a to obtain Sample 1—1.

The spectral reflectances of the three Samples 1, 1-a and 1—1 were determined with Color Analyzer 307 (a product of Hitachi, Ltd.) with a xenon lamp to obtain the results shown in FIG. 9. It will be understood that by providing the prime layer, the defect, i.e. yellowing could be overcome by changing it into white or blue under the irradiation with a light of about 420 to 470 nm.

EXAMPLE 12

A polyethylene phthalate film having a thickness of 100μ was placed in a vacuum deposition apparatus and aluminum was deposited thereon in vacuum ($10^{-5}$ Torr) to form an aluminum film having a thickness of 100 Å according to a process shown in Example 1 of Japanese Patent Application No. 60-52788 (Japanese Patent Public Disclosure No. 61-210346). The film was then coated with a low-density polyethylene to form a polyethylene layer having a thickness of about 15μ. The product will be referred to as Sample 2.

4.25 g of gelatin was swelled and dissolved in 50 ml of water. 0.25 g of Polymer P-1 was stirred thoroughly with a mixture of methanol and water (1:4). The solution was thoroughly stirred together with the thus obtained mixture. 1.5 ml of 2% solution of 1,3-bisvinylsulfonyl-2-propanol (hardener) in methanol was added to the mixture. The Sample-2 was subjected to the corona discharge treatment and the coating solution to which a suitable amount of water had been added was applied thereto in such a manner that WF-2 content would be 80 mg/m$^2$ to form a prime layer. The product will be referred to as Sample 2-1. On the other hand, a prime layer comprising gelatin and the hardener was formed on the support to prepare Sample 2-a. A silver chlorobromide emulsion layer (halogen composition: 67% AgCl, average grain diameter: 0.4μ) which was the same as that in ordinary photographic paper was formed thereon and further a protective layer was formed thereon. The products will be referred to as Sample 3 and Sample 3-a. The amount of silver applied was 2.1 g/m$^2$.

After exposure through a negative film followed by the development with a developer D-72 (1:2 dilution) for 2 min, it was fixed and water washed.

In both samples, the highlights were bright and the gradation in the shades was excellent and sharp. Surprisingly, the Sample 2-1 was superior to the Sample 2-a in degree of whiteness in the highlights, and the maximum density and shadow saturation of the former were not inferior to those of the latter.

EXAMPLE 13

1 g of C-4 was dissolved in a mixture of methanol and toluene. 1 g of polyvinyl alcohol and 0.5 g of p-ethoxyacetanilide were dissolved in ethyl acetate. The solutions were dispersed in gelatin and the dispersion was dispersed in the silver halide emulsion of Sample 3-a in such a manner that the amount of C-4 would be 80 mg/m$^2$ as in Example 2. The product will be referred to as Sample 4. This product was processed in the same manner as in Example 12 to prepare a photograph, in which the degree of whiteness in the highlights was higher than that in a photograph of Sample 3-a.

EXAMPLE 14

Silver halide emulsion (1) used in this example was prepared as follows:

| | |
|---|---|
| (Solution 1) | |
| $H_2O$ | 1000 cc |
| NaCl | 5.5 g |
| gelatin | 32 g |
| (Solution 2) | |
| 1N sulfuric acid | 24 cc |
| (Solution 3) | |
| the following solvent for silver halide (1%) | 3 cc |

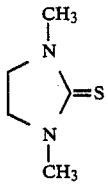

| | |
|---|---|
| (Solution 4) | |
| KBr | 15.66 g |
| NaCl | 3.30 g |
| $H_2O$ | ad 200 cc |
| (Solution 5) | |
| $AgNO_3$ | 32 g |
| $H_2O$ | ad 200 cc |
| (Solution 6) | |
| KBr | 62.72 g |
| NaCl | 13.22 g |
| $K_2IrCl_6$ (0.001%) | 4.54 cc |
| $H_2O$ | ad 600 cc |
| (Solution 7) | |
| $AgNO_3$ | 128 g |
| $H_2O$ | ad 600 cc |

The Solution 1 was heated at 56° C. The Solution 2 and Solution 3 were added to the Solution 1. Then the Solution 4 and Solution 5 were simultaneously added thereto over 30 min 10 min after completion of the addition, the Solution 6 and Solution 7 were simultaneously added thereto over 20 min. 5 min after completion of the addition, the temperature was lowered to conduct desalting. Water and gelatin were added thereto and the pH was adjusted to 6.2 to prepare a monodisperse silver chlorobromide emulsion comprising cubic grains having an average grain size of 0.45 μm, coefficient of variation (calculated by dividing the standard deviation by the average grain size: S/d̄) of 0.08 and silver bromide content of 70 molar %. Sodium thiosulfate was added to the emulsion and the optimum chemical sensitization was conducted.

Silver halide emulsions (2), (3), (4) and (5) having different silver chloride contents were prepared in the same manner as above except that the amounts of KBr and NaCl in the above Solution 4 and Solution 6 and the time required for the simultaneous addition of the Solution 4 and Solution 5 were modified as shown in Table 7.

TABLE 8

| | Solution 4 | | Solution 6 | | Time required for addition of Solutions 4 |
|---|---|---|---|---|---|
| Emulsion | KBr | NaCl | KBr | NaCl | and 5 |
| (2) | 6.71 g | 7.70 g | 26.88 g | 30.84 g | 12 min |
| (3) | 3.36 g | 9.35 g | 13.44 g | 37.44 g | 10 min |
| (4) | 1.12 g | 10.45 g | 4.48 g | 41.85 g | 9 min |
| (5) | 0.22 g | 10.89 g | 0.90 g | 43.61 g | 8 min |

The average grain sizes, coefficients of variation and halogen composition in the Silver halide emulsions (1) to (5) are shown in Table 9.

TABLE 9

| Emulsion | Average grain size (μm) | Coefficient of variation (s/d) | Halogen composition (%) Br | Cl |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 5 | 95 |
| (5) | 0.45 | 0.08 | 1 | 99 |

The Samples 1-1 and 1-a prepared in Example 11 were used as the supports.

The first to the seventh layers shown in Table 10 were formed on each supports to prepare a laminate, i.e. color photosensitive material.

TABLE 10

| Layer | Main components | Amount |
|---|---|---|
| The seventh layer (protective layer) | gelatin | 1.33 g/m$^2$ |
| | Acryl-modified polyvinyl alcohol copolymer (degree of modification: 17%) | 0.17 g/m$^2$ |
| The sixth layer (U.V.-absorbing layer) | gelatin | 0.54 g/m$^2$ |
| | U.V. absorber (k) | 0.11 g/m$^2$ |
| | solvent (m) | 0.09 cc/m$^2$ |
| The fifth layer (red-sensitive layer) | silver halide emulsion (2) silver: | 0.02 g/m$^2$ |
| | gelatin | 0.90 g/m$^2$ |
| | cyan coupler (n) | 0.36 g/m$^2$ |
| | color image stabilizer (o) | 0.17 g/m$^2$ |
| | solvent (f) | 0.22 cc/m$^2$ |
| | red-sensitive sensitizing dye (c) | |
| The fourth layer (U.V.-absorbing layer) | gelatin | 1.60 g/m$^2$ |
| | U.V. absorber (k) | 0.62 g/m$^2$ |
| | color mixing inhibitor (l) | 0.05 g/m$^2$ |
| | solvent (m) | 0.26 cc/m$^2$ |
| The third layer (green-sensitive layer) | silver halide emulsion (3) silver: | 0.15 g/m$^2$ |
| | gelatin | 1.80 g/m$^2$ |
| | magenta coupler (h) | 0.38 g/m$^2$ |
| | color image stabilizer (i) | 0.16 g/m$^2$ |
| | solvent (j) | 0.38 cc/m$^2$ |
| | green-sensitive sensitizing dye (b) | |
| The second layer (color-mixing inhibiting layer) | gelatin | 0.99 g/m$^2$ |
| | color-mixing inhibitor (g) | 0.08 g/m$^2$ |
| The first layer | silver halide emulsion (5) silver: | 0.26 g/m$^2$ |
| | gelatin | 1.83 g/m$^2$ |
| | yellow coupler (d) | 0.91 g/m$^2$ |
| | color image stabilizer (e) | 0.19 g/m$^2$ |
| | solvent (f) | 0.36 cc/m$^2$ |
| | blue-sensitive sensitizing dye (a) | |

The first layer: Sensitizing dye (a) was added to Silver halide emulsion (5) in an amount of $7.0\times10^{-4}$ mol per mol of AgX to conduct the spectral sensitization. Yellow coupler (d), Color image stabilizer (e) and Solvent (f) were mixed together to obtain a solution, which was added to the emulsion in a given amount. The mixture was applied to the support to form the first layer.

The third layer: Sensitizing dye (b) was added to Silver halide emulsion (3) in an amount of $4.0\times10^{-4}$ mol per mol of AgX to conduct the spectral sensitization. Magenta coupler (h) and Color image stabilizer (i) were mixed with Solvent (j) to obtain a solution, which was added to the sensitized emulsion in a given amount. The resulting mixture was for forming the third layer.

The fifth layer: Sensitizing dye (c) was added to Silver halide emulsion (2) in an amount of $1.0\times10^{-4}$ mol per mol of AgX to conduct the spectral sensitization. Cyan coupler (n) and Color image stabilizer (o) were mixed with Solvent (f) to obtain a solution, which was added to the sensitized emulsion in a given amount. The resulting mixture was for forming the fifth layer.

Emulsions for forming the second layer, the fourth layer, the sixth layer and the seventh layer were prepared in the same manner as above.

The emulsions for forming the first, second, third, fourth, fifth, sixth and seventh layers were applied successively on the prime layer formed on the support to prepare Samples 5 and 6 and Comparative Sample A.

Sample 7 was prepared using the supports of Sample 1-1 and Sample 1-a in the same manner as above except that 0.11 g/m$^2$ of F-1 was incorporated in the sixth layer and that the composition forming the fifth layer was modified as follows:

TABLE 11

| | | | |
|---|---|---|---|
| The fifth layer (red-sensitive | silver halide emulsion (2) | silver: | 0.25 g/m$^2$ |

TABLE 11-continued

| | | |
|---|---|---|
| layer) | | |
| | gelatin | 0.80 g/m$^2$ |
| | cyan coupler (n) | 0.30 g/m$^2$ |
| | *C-1 | 0.30 |
| | *P-1 | 0.05 |
| | color image stabilizer (o) | 0.17 |
| | solvent (f) | 0.20 |
| | red-sensitive sensitizing dye (c) | |

*C-1, P-1 and Solvent (f) were dissolved in ethyl acetae and the solution was dispersed in 12% aqueous gelatin solution in the presence of a small amount of ordinarily used sodium nonylbenzenesulfonate.

| Photo-sensitive material | Support | Coating composition | Characteristics |
|---|---|---|---|
| 5 | 1-1 | Table 8 | F-1 was added to the sixth layer and WF-1 was added to the prime layer |
| A (comparative) | 1-a | " | — |
| 6 | 1-1 | Table 11 | WF-1 was added to the prime layer and C-1/P-1 was added to the fifth layer |
| 7 | 1-a | " | C-1/P-1 was added to the fifth layer |

The above prepared samples were subjected to sensitometric gradation exposure through a blue/green/red separation filter or to enlargement print image exposure through a negative film by using 2854° K. light source.

After the color development, bleach-fixing and rinse, a photographic image was obtained.

In the visual inspection of the photographic image, it was noted that the saturation, particularly that of yellow and magenta, was quite excellent. Surprisingly, the sharpness was remarkably improved. Further, the details of the shade gradation were reproduced clearly.

The image had a saturation and image sharpness equivalent to those obtained in Example 1 of Japanese Patent Application No. 61-168802. As compared with the Sample A, samples I and II had an improved degree of whiteness. Particularly, an improvement in the degree of whiteness and brightness was observed in the highlights of the Sample II and a photograph having a high natural sense was obtained when the Sample II was used.

blue-sensitive sensitizing dye

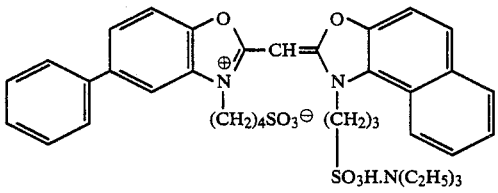

(a)

green-sensitive sensitizing dye

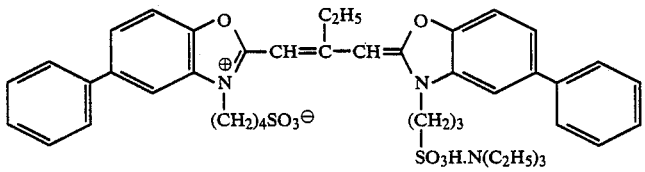

(b)

red-sensitive sensitizing dye

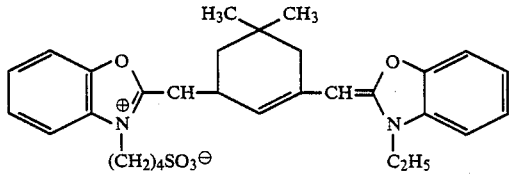

(c)

yellow coupler

-continued
(d)
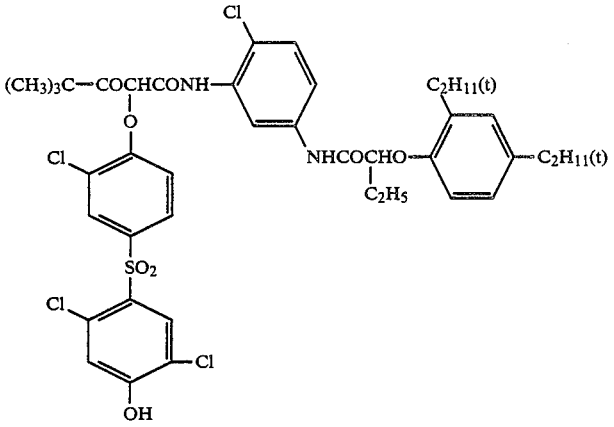
color image stabilizer
(e)
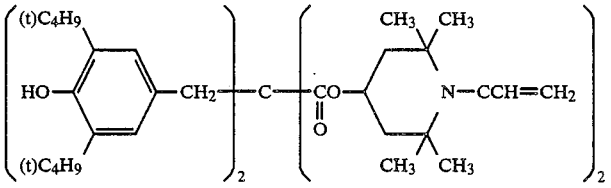
solvent
(f)
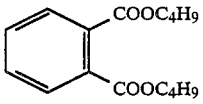
color mixing inhibitor
(g)
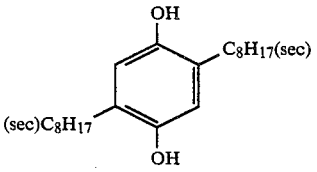
magenta coupler
(h)
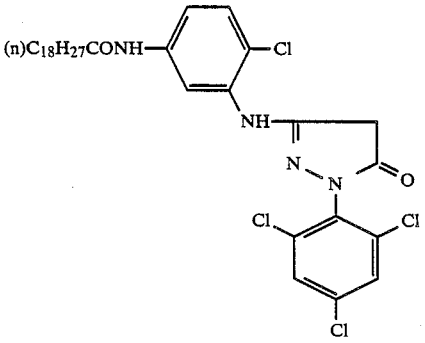
color image stabilizer -continued
(i)
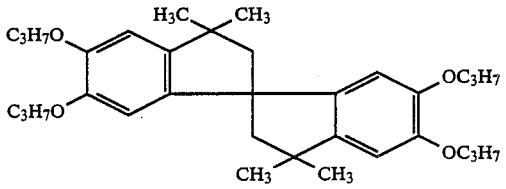
solvent
(j)
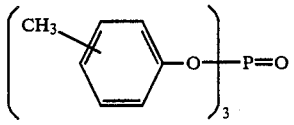
U.V. absorber
(k)
mixture of
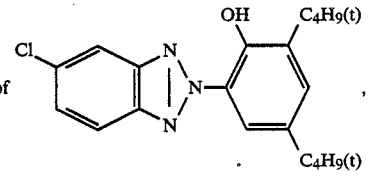
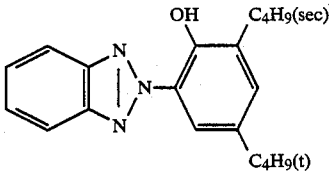
and
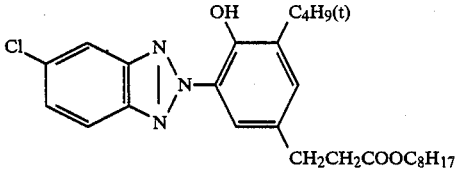
in a molar ratio of 1:5:3
mixing inhibitor
(l)
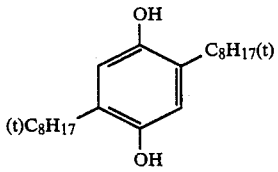
solvent
(m)
(iso $C_9H_{18}O)_3P{=}O$
cyan coupler
(n)
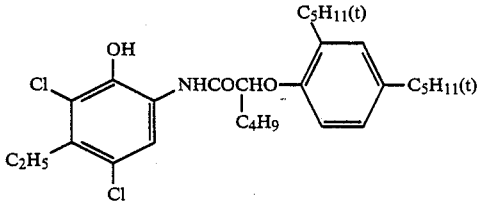
color image stabilizer -continued
(o)
mixture of
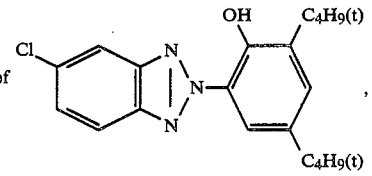
,
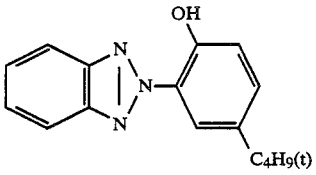
and
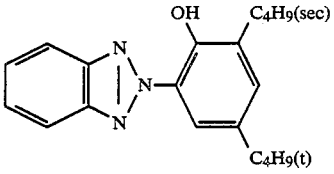
in a molar rating of 1:3:3
magenta coupler
(p)
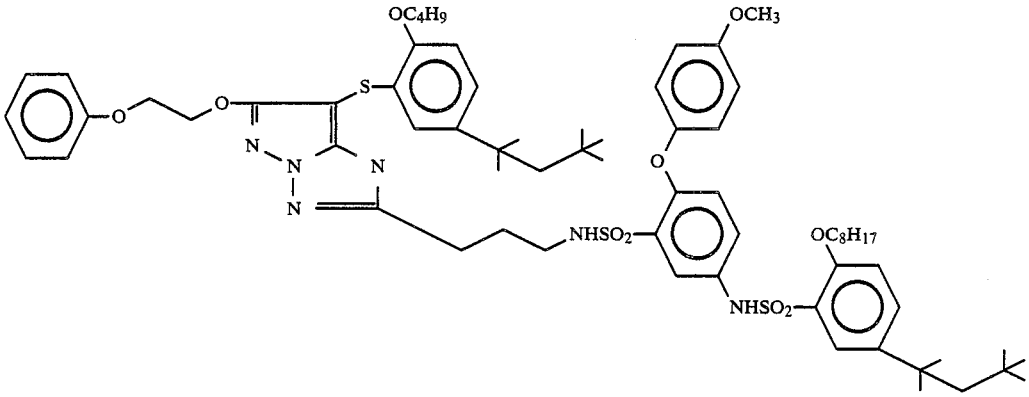
cyan coupler
(q)
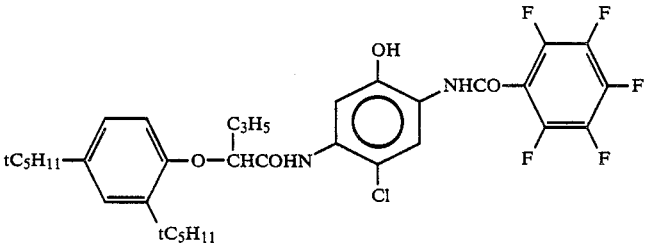
(Note)
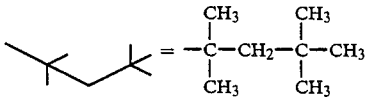
| Bleach-fixing solution A: | |
|---|---|
| ammonium thiosulfate (54 wt. %) | 150 ml |
| $Na_2SO_3$ | 15 g |
| $NH_4(Fe(III)(EDTA))$ | 55 g |
-continued
| | |
|---|---|
| EDTA.2Na | 4 g |
| glacial acetic acid | 8.61 g |
| water | ad 1000 ml |
| | (pH 5.4) |

-continued

| Rinsing solution A | | |
|---|---|---|
| EDTA.2Na.2$H_2O$ | | 0.4 g |
| water | | ad 1000 ml (pH 7.0) |

| | | | |
|---|---|---|---|
| Development | Developer A | 35° C. | 45 sec |
| Bleach-fixing | Bleach-fixing solution A | 35° C. | 45 sec |
| Rinsing | Rinsing solution A | 28 to 35° C. | 1 min 30 sec |

| Color developer A: | |
|---|---|
| water | 800 cc |
| diethylenetriaminepentaacetic acid | 1.0 g |
| sodium sulfite | 0.2 g |
| N,N—diethylenehydroxylamine | 4.2 g |
| potassium bromide | 0.6 g |
| sodium chloride | 1.5 g |
| triethanolamide | 8.0 g |
| potassium carbonate | 30 g |
| N—ethyl-N—(β-methanesulfonamidoethyl)-3-methyl-4-aminoaniline sulfate | 4.5 g |
| water | ad 1000 cc |
| pH adjusted with KOH to 10.25 | |

EXAMPLE 15

The diffuse-reflectivity of the support of this invention was measured.

Figure 11:
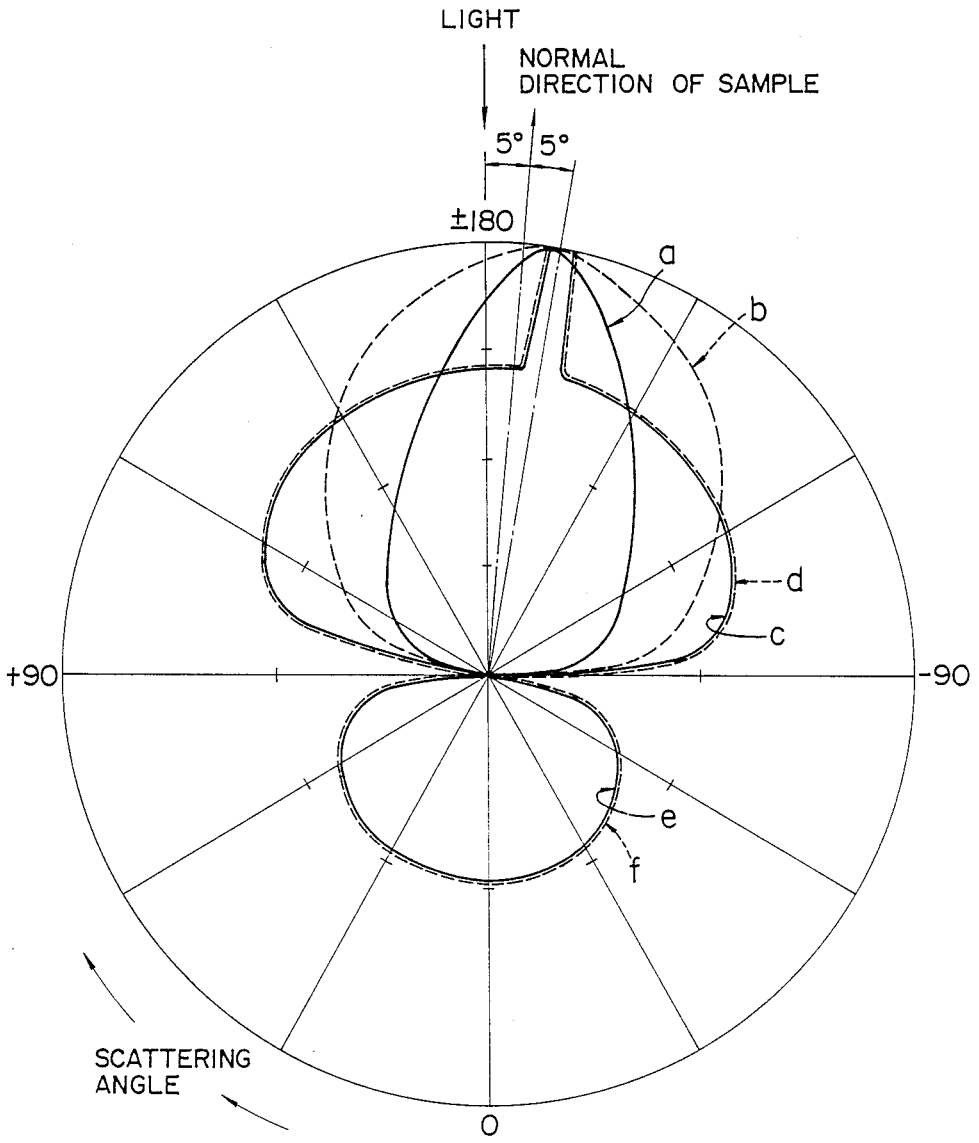
FIG. 11 shows dependence of diffuse-reflected light on angle distribution.

The Sample 1 of this invention prepared in the Example 1 and the Comparative sample b (resin coated paper) used in the Example 2 were used as samples for the measurement. Light from light source A was directed onto each sample at an angle of 5° from normal and the angle distribution of the scattered light was measured by a goniophotometer (type GP-1R, manufactured by Murakami shikisai Gijutsu Kenkyusho). The result is shown in FIG. 11. In the figure, relative reflectance (logarithmic scale) is shown in the area over the straight line between −90° and 90° and relative transmittance is shown in the area below the straight line between −90° and 90°. In FIG. 11, the solid line a and the broken line b are reflectance of the Sample 1, the solid line c and the broken line d are reflectance of the Comparative sample b, and the solid line e and the broken line f are transmittance of the Comparative sample b. The reflectance and transmittance shown by the solid lines were measured by directing light onto the samples at an angle of 5° from normal in the longitudinal direction of the samples. The reflectance and transmittance shown by the broken lines were measured by directing light onto the samples at an angle of 5° from normal in the transverse direction of the samples.

As seen from FIG. 11, the support of the present invention (Sample 1) has stronger reflectance than the conventional support (Comparative sample b) within the visual angle (±40°), which is important for the observation of a color photograph, and no light transmitted through the Sample 1 was observed. Further, the anisotoropy observed on the sample 1 was relatively small.

What is claimed is:

1. A color photosensitive element comprising two or more silver halide emulsion layers having different spectral sensitivities, a thin solid metal film layer having a secondary diffuse-reflective surface, and a support, wherein said thin solid film layer is located between the emulsion layers and the support, and wherein said thin solid metal film layer has a reflectance of at least 0.5 and an average unevenness of about 0.1 to 2000 unevenness/mm.

2. The color photosensitive material of claim 1 wherein the metal is aluminum, silver, gold, nickel, magnesium or an alloy of them.

3. The color photosensitive material of claim 1 wherein a thermoplastic resin layer or an adhesive layer is provided between the thin solid film layer and the support.

4. The color photosensitive material of claim 1 wherein the secondary diffuse-reflective surface of the thin solid film layer is obtained by making a mirror surface of the thin solid film layer uneven to form about 0.1 to 2000 unevennesses/mm.

5. The color photosensitive material of claim 1 wherein the support is a paper.

6. The color photosensitive material of claim 5 wherein a thermoplastic resin layer or a water-resistant resin layer is provided on the surface of the support opposite to that having the thin solid film layer.

7. The color photosensitive material of claim 1 which comprises an emulsion layer (BL) containing silver halide grains having a spectral sensitivity in a wave length region of 400 to 500 mμ and finely dispersed yellow color coupler grains, an emulsion layer (GL) containing silver halide grains having a spectral sensitivity in a wave length region of 500 to 580 mμ and finely dispersed magenta color coupler grains and an emulsion layer (RL) containing silver halide grains having a spectral sensitivity in a wave length region of 580 to 740 mμ and finely dispersed cyan color coupler grains in an any order.

8. The color photographic sensitive material of claim 1 wherein a resin layer is provided between the film layer and the silver halide emulsion layer.

9. The color photosensitive material of claim 1 wherein a fluorescent brightener is contained in at least one of the layers on the film layer.

10. The color photosensitive material of claim 9 wherein the layers on the film layer are a prime layer, photosensitive layer, intermediate layer and protective layer.

11. The color photosensitive material of claim 10 wherein the fluorescent brightener is contained in at least one of the prime layer, intermediate layer and protective layer.

12. The color photosensitive material of claim 1 wherein a fluorescent brightener which liberates a fluorescent brightening residue upon the reaction with an oxidation product of a developing agent is contained in a photosensitive layer, or intermediate layer or protective layer adjacent to the photosensitive layer on the film layer.

13. The color photosensitive material of claim 12 wherein the fluorescent brightener is a compound of the general formula (I):

$$A—(L)_a—Fl \qquad (I)$$

wherein Fl represents a fluorescent brightening compound residue, L represents a connecting group, a represents a number of 1 or 2 and A represents a color compound-forming coupler residue, colorless compound-forming coupler residue or hydroquinone residue, the residue being that of a compound capable of participating in an exchange reaction with an oxidation product of a developing agent.

* * * * *